US008357023B2

(12) United States Patent
Van de Rostyne et al.

(10) Patent No.: US 8,357,023 B2
(45) Date of Patent: Jan. 22, 2013

(54) HELICOPTER

(75) Inventors: Alexander Jozef Magdalena Van de Rostyne, Bornem (BE); Chi Pok Billy Wai, Causeway Bay (HK)

(73) Assignee: Silverlit Limited, Causeway Bay (HK)

( * ) Notice: Subject to any disclaimer, the term of this patent is extended or adjusted under 35 U.S.C. 154(b) by 561 days.

(21) Appl. No.: 12/551,531

(22) Filed: Aug. 31, 2009

(65) Prior Publication Data

US 2010/0022157 A1 Jan. 28, 2010

Related U.S. Application Data

(63) Continuation-in-part of application No. 11/627,919, filed on Jan. 26, 2007, now Pat. No. 7,662,013, which is a continuation-in-part of application No. 11/465,781, filed on Aug. 18, 2006, now Pat. No. 7,815,482, which is a continuation-in-part of application No. 11/462,177, filed on Aug. 3, 2006, now abandoned.

(51) Int. Cl.
*A63H 27/127* (2006.01)
*B64C 27/00* (2006.01)

(52) U.S. Cl. ..... 446/36; 244/17.11

(58) Field of Classification Search ..... 446/36–38; 244/17.11, 17.13, 17.19, 17.21, 17.23, 17.25
See application file for complete search history.

(56) References Cited

U.S. PATENT DOCUMENTS

| | | | |
|---|---|---|---|
| 934,771 | A | 9/1909 | Turnbull |
| 1,403,909 | A | 1/1922 | Moir |
| 1,446,522 | A | 2/1923 | Smith |
| 1,446,718 | A | 2/1923 | Newbauer |
| 1,470,017 | A | 10/1923 | Lougheed |
| 1,773,281 | A | 8/1930 | Scott |
| 1,800,470 | A | 4/1931 | Oehmichen |
| 1,828,783 | A | 10/1931 | Oehmichen |
| 1,925,156 | A | 9/1933 | Vaughn |

(Continued)

FOREIGN PATENT DOCUMENTS

| | | |
|---|---|---|
| BE | 338599 | 12/1926 |
| BE | 1016960 | 11/2007 |

(Continued)

OTHER PUBLICATIONS

Davis: Vectron Ultralite Battery Operated Radio/Infrared Controlled Flying Saucer Toy; U.S. Copyright Registration. VA 1-285-847.

(Continued)

*Primary Examiner* — Gene Kim
*Assistant Examiner* — Alyssa Hylinski
(74) *Attorney, Agent, or Firm* — Greenberg Traurig, LLP

(57) ABSTRACT

A helicopter includes a system to effect motion in a horizontal dimension thereby to direct the desired direction. The rotor blades are driven by a rotor shaft and which is hinge mounted on this rotor shaft, such that the angle between the plane of rotation of the main rotor and the rotor shaft may vary. A control for moving the angle of incidence of at least one blade of the rotor cyclically along at least part of a 360-degree rotation path around the rotor shaft. This causes a variation in a lift force of the blade along at least part of the rotations path. This causes the body to be urged in a relatively horizontal direction from a relative position of rest. The control includes an actuator for engaging with an assembly depending from the rotor, the inter-engagement of the actuator and assembly effecting a change in the angle of incidence of at least the one blade of the rotor. The system includes a rotor, preferably complemented with a stabilizer rotor. There is a control ring attached to the main rotor, and an actuator device connected with the helicopter body structure. The control ring is generally centered around the vertical rotor axis, and moves with the rotor when tilted around the feather axis.

16 Claims, 43 Drawing Sheets

U.S. PATENT DOCUMENTS

| | | | | |
|---|---|---|---|---|
| 2,030,578 | A | | 2/1936 | Flettner |
| 2,110,563 | A | | 3/1938 | Thaon |
| 2,272,643 | A | | 2/1942 | Peters et al. |
| 2,275,094 | A | | 3/1942 | Taylor |
| 2,307,381 | A | | 1/1943 | Bess |
| D140,480 | S | | 2/1945 | Maycen |
| 2,368,698 | A | | 2/1945 | Young |
| 2,384,516 | A | | 9/1945 | Young |
| 2,411,596 | A | | 11/1946 | Shapiro |
| 2,413,831 | A | | 1/1947 | Jordan |
| 2,429,502 | A | | 10/1947 | Young |
| D149,130 | S | | 3/1948 | Katenberter et al. |
| 2,439,143 | A | | 4/1948 | Nemeth |
| D153,314 | S | | 4/1949 | Piasecki |
| D153,315 | S | | 4/1949 | Piasecki |
| D153,316 | S | | 4/1949 | Piasecki |
| D153,317 | S | | 4/1949 | Piasecki |
| 2,466,821 | A | | 4/1949 | Owen |
| 2,469,144 | A | | 5/1949 | Baggott |
| 2,481,750 | A | | 9/1949 | Hiller, Jr. et al. |
| 2,486,059 | A | | 10/1949 | Pentecost |
| 2,487,020 | A | | 11/1949 | Gilcrease |
| 2,514,822 | A | | 7/1950 | Wolfe, Jr. |
| 2,532,683 | A | | 12/1950 | Traver |
| 2,554,938 | A | | 5/1951 | Catalano |
| D163,938 | S | | 7/1951 | Douglas |
| 2,563,731 | A | | 8/1951 | Masterson |
| 2,599,957 | A | | 6/1952 | Walker |
| 2,614,637 | A | | 10/1952 | Landgraf |
| 2,629,568 | A | | 2/1953 | Croshere, Jr. et al. |
| 2,629,570 | A | | 2/1953 | Carnahan |
| 2,633,924 | A | | 4/1953 | Young |
| 2,639,874 | A | | 5/1953 | Stalker |
| 2,646,848 | A | | 7/1953 | Young |
| D171,569 | S | | 3/1954 | Apostolescu |
| 2,720,928 | A | | 10/1955 | Warto |
| 2,725,494 | A | | 11/1955 | Anderson |
| D178,081 | S | | 6/1956 | Papadakos |
| 2,750,131 | A | | 6/1956 | Thomson |
| 2,801,494 | A | | 8/1957 | Ernst |
| D181,643 | S | | 12/1957 | Graham |
| 2,818,123 | A | | 12/1957 | Hiller, Jr. |
| 2,822,994 | A | | 2/1958 | Warto |
| D184,501 | S | | 2/1959 | Wlaschin et al. |
| 2,923,494 | A | | 2/1960 | Strong |
| D187,625 | S | | 4/1960 | Apostolescu |
| D187,895 | S | | 5/1960 | Douglas |
| 2,950,074 | A | | 8/1960 | Apostolescu |
| 2,980,187 | A | | 4/1961 | Smyth-Davila |
| 2,987,848 | A | | 6/1961 | Neuhaus et al. |
| 3,029,048 | A | | 4/1962 | Brooks et al. |
| 3,035,643 | A | | 5/1962 | Kelley et al. |
| 3,068,611 | A | | 12/1962 | Lauderdale |
| 3,080,001 | A | | 3/1963 | Culver et al. |
| 3,093,929 | A | | 6/1963 | Robbins et al. |
| 3,106,964 | A | | 10/1963 | Culver et al. |
| 3,116,896 | A | | 1/1964 | Sigler et al. |
| 3,135,334 | A | | 6/1964 | Culver |
| 3,180,424 | A | | 4/1965 | Serriades |
| 3,213,944 | A | | 10/1965 | Nichols et al. |
| 3,228,478 | A | | 1/1966 | Edenborough |
| 3,231,222 | A | | 1/1966 | Scheutzow |
| D205,326 | S | | 7/1966 | Postelson-Apostolescu |
| 3,308,888 | A | * | 3/1967 | Arcidiacono ..... 416/114 |
| 3,321,022 | A | | 5/1967 | Oguri |
| 3,370,809 | A | | 2/1968 | Leoni |
| 3,371,886 | A | | 3/1968 | Schertz |
| 3,391,746 | A | | 7/1968 | Cardoso |
| 3,409,249 | A | | 11/1968 | Bergquist et al. |
| 3,448,810 | A | | 6/1969 | Vogt |
| 3,450,374 | A | | 6/1969 | Moore |
| 3,460,628 | A | | 8/1969 | Tankersley |
| 3,481,559 | A | | 12/1969 | Apostolescu |
| 3,554,467 | A | | 1/1971 | Yowell |
| 3,558,081 | A | | 1/1971 | Williams |
| 3,572,616 | A | * | 3/1971 | Ulisnik ..... 244/17.23 |
| 3,592,559 | A | | 7/1971 | Ward |
| D221,453 | S | | 8/1971 | Swamberg |
| 3,625,631 | A | | 12/1971 | Covington, Jr. et al. |
| 3,662,487 | A | | 5/1972 | Seefluth |
| 3,759,629 | A | | 9/1973 | Abramopaulos |
| 3,771,924 | A | | 11/1973 | Buchstaller |
| D232,168 | S | | 7/1974 | Leoni |
| D232,170 | S | | 7/1974 | Diamond et al. |
| D234,350 | S | | 2/1975 | Beckert et al. |
| 3,905,565 | A | | 9/1975 | Kolwey |
| 3,933,324 | A | | 1/1976 | Ostrowski |
| D239,930 | S | | 5/1976 | Ulisnik |
| 4,025,230 | A | | 5/1977 | Kastan |
| 4,053,123 | A | | 10/1977 | Chadwick |
| 4,073,086 | A | | 2/1978 | Ogawa |
| 4,084,345 | A | | 4/1978 | Tanaka |
| 4,118,143 | A | * | 10/1978 | Kavan ..... 416/18 |
| 4,142,697 | A | | 3/1979 | Fradenburgh |
| D253,003 | S | | 9/1979 | Tanaka |
| 4,173,321 | A | | 11/1979 | Eickmann |
| 4,195,439 | A | | 4/1980 | Kramer |
| 4,227,856 | A | | 10/1980 | Verrill et al. |
| 4,307,533 | A | | 12/1981 | Sims et al. |
| 4,519,746 | A | | 5/1985 | Wainauski et al. |
| 4,522,563 | A | | 6/1985 | Reyes et al. |
| 4,629,440 | A | | 12/1986 | McKittrick et al. |
| D287,738 | S | | 1/1987 | Bollinger et al. |
| D294,605 | S | | 3/1988 | Matsumoto |
| 4,759,514 | A | | 7/1988 | Burkam |
| 4,789,305 | A | * | 12/1988 | Vaughen ..... 416/131 |
| 4,880,355 | A | | 11/1989 | Vuillet et al. |
| 4,941,803 | A | | 7/1990 | Wainauski et al. |
| 4,958,786 | A | * | 9/1990 | Ogawa et al. ..... 244/17.13 |
| 4,981,456 | A | | 1/1991 | Sato et al. |
| 5,015,187 | A | | 5/1991 | Lord |
| 5,108,043 | A | | 4/1992 | Canavespe |
| 5,151,014 | A | | 9/1992 | Greenwald et al. |
| 5,190,242 | A | | 3/1993 | Nichols |
| 5,203,520 | A | | 4/1993 | Przygodzki et al. |
| 5,209,429 | A | | 5/1993 | Doolin et al. |
| 5,240,204 | A | | 8/1993 | Kunz |
| 5,252,100 | A | * | 10/1993 | Osawa et al. ..... 446/44 |
| 5,255,871 | A | | 10/1993 | Ikeda |
| 5,259,729 | A | | 11/1993 | Fujihira et al. |
| 5,304,090 | A | | 4/1994 | Vanni |
| 5,370,341 | A | | 12/1994 | Leon |
| 5,388,785 | A | | 2/1995 | Rollet et al. |
| 5,395,275 | A | | 3/1995 | Johnson et al. |
| D357,894 | S | | 5/1995 | Arnold et al. |
| 5,505,407 | A | | 4/1996 | Chiappetta |
| 5,511,947 | A | | 4/1996 | Schmuck |
| D372,741 | S | | 8/1996 | Tsai |
| D378,606 | S | | 3/1997 | Tamagnini |
| 5,609,312 | A | | 3/1997 | Arlton et al. |
| 5,628,620 | A | * | 5/1997 | Arlton ..... 416/114 |
| D388,048 | S | | 12/1997 | Taylor et al. |
| D390,942 | S | | 2/1998 | Mei |
| 5,749,540 | A | | 5/1998 | Arlton |
| 5,836,545 | A | | 11/1998 | Arlton et al. |
| 5,879,131 | A | | 3/1999 | Arlton et al. |
| 5,906,476 | A | | 5/1999 | Arlton |
| 5,915,649 | A | | 6/1999 | Head |
| 5,971,320 | A | | 10/1999 | Jermyn et al. |
| 6,000,911 | A | | 12/1999 | Toulmay et al. |
| D421,279 | S | | 2/2000 | Tsai |
| 6,032,899 | A | * | 3/2000 | Mondet et al. ..... 244/17.25 |
| 6,039,541 | A | | 3/2000 | Parker et al. |
| D425,853 | S | | 5/2000 | Caporaletti |
| 6,086,016 | A | | 7/2000 | Meek |
| 6,231,005 | B1 | * | 5/2001 | Costes ..... 244/17.25 |
| 6,302,652 | B1 | | 10/2001 | Roberts |
| 6,398,618 | B1 | | 6/2002 | Wu |
| 6,435,453 | B1 | | 8/2002 | Carter, Jr. |
| 6,460,802 | B1 | | 10/2002 | Norris |
| 6,467,726 | B1 | | 10/2002 | Hosoda |
| D467,861 | S | | 12/2002 | Lee |
| 6,499,690 | B1 | | 12/2002 | Katayama et al. |
| 6,543,726 | B2 | | 4/2003 | Illingworth |
| 6,632,119 | B2 | | 10/2003 | Chernek et al. |
| 6,659,395 | B2 | | 12/2003 | Rehkemper et al. |
| 6,659,721 | B1 | | 12/2003 | Parker et al. |

| | | | | |
|---|---|---|---|---|
| 6,688,936 | B2 | 2/2004 | Davis | |
| 6,702,552 | B1 | 3/2004 | Harman | |
| 6,719,244 | B1 | 4/2004 | Gress | |
| 6,732,973 | B1 | 5/2004 | Rehkemper | |
| 6,745,977 | B1 | 6/2004 | Long et al. | |
| 6,749,401 | B2 | 6/2004 | Vanmoor | |
| 6,758,436 | B2 | 7/2004 | Rehkemper et al. | |
| D496,695 | S | 9/2004 | Davis | |
| 6,789,764 | B2 | 9/2004 | Bass et al. | |
| 6,843,699 | B2 | 1/2005 | Davis | |
| 6,884,034 | B1 | 4/2005 | Parker et al. | |
| 6,886,777 | B2 | 5/2005 | Rock | |
| 6,899,586 | B2 | 5/2005 | Davis | |
| 6,929,215 | B2 | 8/2005 | Arlton | |
| 6,938,853 | B2 | 9/2005 | Pines et al. | |
| 6,960,112 | B2 | 11/2005 | Helmlinger et al. | |
| 6,978,969 | B1 | 12/2005 | Neal | |
| D524,227 | S | 7/2006 | Stille et al. | |
| D524,228 | S | 7/2006 | Scott et al. | |
| D524,229 | S | 7/2006 | Stille et al. | |
| D524,230 | S | 7/2006 | Stille et al. | |
| D524,718 | S | 7/2006 | Scott et al. | |
| 7,100,866 | B2 | 9/2006 | Rehkemper et al. | |
| 7,178,757 | B1 | 2/2007 | Breese et al. | |
| 7,178,758 | B2 | 2/2007 | Rehkemper | |
| 7,188,803 | B2 | 3/2007 | Ishiba | |
| 7,198,223 | B2 | 4/2007 | Phelps, III et al. | |
| 7,204,453 | B2 | 4/2007 | Muren | |
| D544,825 | S | 6/2007 | Van de Rostyne et al. | |
| D545,755 | S | 7/2007 | Van de Rostyne et al. | |
| D546,269 | S | 7/2007 | Van de Rostyne et al. | |
| 7,246,769 | B2 | 7/2007 | Yoeli | |
| D548,803 | S | 8/2007 | Zimet | |
| 7,255,623 | B2 | 8/2007 | Davis | |
| 7,264,199 | B2 | 9/2007 | Zientek | |
| 7,273,195 | B1 | 9/2007 | Golliher | |
| D552,531 | S | 10/2007 | Van de Rostyne et al. | |
| D554,040 | S | 10/2007 | Van de Rostyne et al. | |
| 7,306,186 | B2 | 12/2007 | Kusic | |
| D559,764 | S | 1/2008 | Wai | |
| D561,084 | S | 2/2008 | Wai | |
| D561,085 | S | 2/2008 | Wai | |
| D561,676 | S | 2/2008 | Wai | |
| D561,677 | S | 2/2008 | Wai | |
| D561,678 | S | 2/2008 | Wai | |
| D561,679 | S | 2/2008 | Wai | |
| D568,947 | S | 5/2008 | Van De Rostyne et al. | |
| D576,215 | S | 9/2008 | Van De Rostyne et al. | |
| 7,422,505 | B2 | 9/2008 | Van de Rostyne | |
| 7,425,167 | B2 | 9/2008 | Van de Rostyne | |
| 7,425,168 | B2 | 9/2008 | Van de Rostyne | |
| D579,403 | S | 10/2008 | Van de Rostyne et al. | |
| D580,343 | S | 11/2008 | Van de Rostyne et al. | |
| D580,344 | S | 11/2008 | Wai | |
| D580,845 | S | 11/2008 | Van de Rostyne et al. | |
| D581,341 | S | 11/2008 | Van de Rostyne et al. | |
| D581,856 | S | 12/2008 | Van de Rostyne et al. | |
| D582,336 | S | 12/2008 | Van de Rostyne et al. | |
| D582,833 | S | 12/2008 | Van De Rostyne et al. | |
| D583,297 | S | 12/2008 | Van De Rostyne et al. | |
| 7,467,984 | B2 | 12/2008 | Van de Rostyne | |
| D585,810 | S | 2/2009 | Van de Rostyne et al. | |
| 7,494,397 | B2 | 2/2009 | Van de Rostyne | |
| 7,497,759 | B1 | 3/2009 | Davis | |
| 7,662,013 | B2 * | 2/2010 | Van de Rostyne et al. | 446/36 |
| 2002/0008759 | A1 | 1/2002 | Hoyos | |
| 2002/0049518 | A1 * | 4/2002 | Yamamoto | 701/2 |
| 2002/0109044 | A1 | 8/2002 | Rock | |
| 2002/0134883 | A1 | 9/2002 | Stamps et al. | |
| 2004/0087241 | A1 | 5/2004 | Agostini et al. | |
| 2004/0162001 | A1 | 8/2004 | Davis | |
| 2004/0184915 | A1 | 9/2004 | Kunii et al. | |
| 2004/0222329 | A1 | 11/2004 | Kuhns et al. | |
| 2004/0245376 | A1 | 12/2004 | Muren | |
| 2005/0061909 | A1 | 3/2005 | Winston | |
| 2005/0121552 | A1 | 6/2005 | Rehkemper | |
| 2005/0121553 | A1 | 6/2005 | Isawa et al. | |
| 2006/0102777 | A1 | 5/2006 | Rock | |
| 2006/0121819 | A1 | 6/2006 | Isawa | |
| 2006/0231677 | A1 | 10/2006 | Zimet et al. | |
| 2007/0012818 | A1 | 1/2007 | Miyazawa et al. | |
| 2007/0017724 | A1 | 1/2007 | Rajasingham | |
| 2007/0105475 | A1 | 5/2007 | Gotou et al. | |
| 2007/0158494 | A1 | 7/2007 | Burrage | |
| 2007/0164148 | A1 | 7/2007 | Van De Rostyne | |
| 2007/0164149 | A1 | 7/2007 | Van de Rostyne | |
| 2007/0164150 | A1 | 7/2007 | Van de Rostyne et al. | |
| 2007/0178798 | A1 | 8/2007 | Lai | |
| 2007/0181742 | A1 | 8/2007 | Van de Rostyne et al. | |
| 2007/0187549 | A1 | 8/2007 | Owen | |
| 2007/0215750 | A1 | 9/2007 | Shantz et al. | |
| 2007/0262197 | A1 | 11/2007 | Phelps et al. | |
| 2008/0031734 | A1 * | 2/2008 | Chen | 416/114 |
| 2008/0067284 | A1 | 3/2008 | Bakker | |
| 2008/0111399 | A1 | 5/2008 | Zierten | |
| 2008/0112808 | A1 | 5/2008 | Schmaling et al. | |
| 2008/0207079 | A1 | 8/2008 | Corsiglia et al. | |
| 2008/0299867 | A1 | 12/2008 | Van de Rostyne et al. | |
| 2009/0008479 | A1 | 1/2009 | Domizio | |
| 2009/0047861 | A1 | 2/2009 | Van de Rostyne et al. | |
| 2009/0047862 | A1 | 2/2009 | Van de Rostyne et al. | |
| 2009/0104836 | A1 | 4/2009 | Van de Rostyne et al. | |
| 2009/0117812 | A1 | 5/2009 | Van de Rostyne et al. | |
| 2009/0163110 | A1 | 6/2009 | Van de Rostyne et al. | |
| 2010/0022157 | A1 | 1/2010 | Van de Rostyne et al. | |

FOREIGN PATENT DOCUMENTS

| | | | |
|---|---|---|---|
| CN | 1496923 | A | 5/2004 |
| DE | 1698494 | | 5/1955 |
| DE | 1 270 408 | | 6/1968 |
| DE | 24 09 227 | A1 | 9/1975 |
| DE | 40 17 402 | A1 | 12/1991 |
| DE | 94 14 652 | U1 | 11/1994 |
| DE | 203 14 041 | U1 | 4/2004 |
| DE | 102 56 916 | A | 9/2004 |
| DE | 20 2007 000987 | U1 | 4/2007 |
| EM | 000111869-0001 | | 3/2004 |
| EP | 0 250 135 | | 12/1987 |
| EP | 0 727 350 | | 8/1996 |
| EP | 1 462 362 | A1 | 9/2004 |
| EP | 1462362 | A1 | 9/2004 |
| ES | P0233821 | | 8/1957 |
| ES | P0234258 | | 9/1957 |
| ES | P0245313 | | 4/1959 |
| ES | P0283794 | | 1/1963 |
| ES | 490715 | | 4/1980 |
| ES | 275141 | | 7/1982 |
| ES | 0298826 | | 1/1989 |
| ES | 0464158 | | 1/1992 |
| ES | 2 074 010 | | 8/1995 |
| ES | 0727350 | | 8/1996 |
| ES | 1238185 | | 9/2002 |
| ES | 2172562 | | 9/2002 |
| ES | 2251668 | | 9/2004 |
| FR | 1 040 719 | A | 10/1953 |
| FR | 1 265 789 | A | 5/1961 |
| GB | 255936 | | 7/1926 |
| GB | 272871 | | 5/1927 |
| GB | 281721 | | 8/1928 |
| GB | 916894 | A | 1/1963 |
| GB | 956536 | | 4/1964 |
| GB | 958536 | | 5/1964 |
| GB | 1081341 | A | 8/1967 |
| GB | 1533251 | | 11/1978 |
| GB | 2 436 258 | A | 9/2007 |
| JP | 30-7668 | | 10/1930 |
| JP | 32-003535 | | 6/1932 |
| JP | 1269699 | | 10/1989 |
| JP | 5192452 | | 8/1993 |
| JP | 8150818 | | 6/1996 |
| JP | 9048398 | | 2/1997 |
| JP | 9512515 | | 12/1997 |
| JP | 10076996 | | 3/1998 |
| JP | 2000-272594 | | 10/2000 |
| JP | 2003-103066 | | 4/2003 |
| JP | 2003-220999 | | 8/2003 |
| JP | 2004-121798 | | 4/2004 |
| JP | 2004121798 | A | 4/2004 |

| | | | |
|---|---|---|---|
| JP | 2005-193905 | | 7/2005 |
| JP | 2005193905 | A | 7/2005 |
| JP | 2006-051217 | | 2/2006 |
| WO | WO03/080433 | A1 | 10/2003 |
| WO | WO 2004/080556 | A2 | 9/2004 |
| WO | WO2006/075096 | | 7/2006 |
| WO | WO 2007/052246 | A1 | 5/2007 |

OTHER PUBLICATIONS

Rotory Modeler Magazine; Mar./Apr. 2005 issue; 62 pages; Moneta, VA US; www.rotory.com.
Rotory Modeler Magazine; Jan./Feb. 2005 issue; 2 pages; Moneta, VA US: www.rotory.com.
Hirobo Indoor Flight Helicopter, X.R.B SRlama Sky Robo; product Manuel; Jul. 2004; 37 pages; http://model.hirobo.co.jp/; (Japanese text).
Hirobo Indoor Flight Helicopter, S.R.B SRlama sky Robo; product manuel; Jul. 2004; 37 pages; http://model.hirobo.co.jp/; (English translation).
Rotory Modeler Magazine; Mar./Apr. 2005 issue; 12 pages; Moneta, VA US; www.rotory.com.
Rotoryworld Magazine; Issue Seven; Dec./Jan. 2005 issue; 4 pages; Bedfordshire UK.
FLYRC Magazine; Mar. 2005 issue; 6 pages; US.
Model Helicopter World Magazine; Mar. 2005 issue; 7 pages; UK.
Rotory Modeler Magazine; Jan./Feb. 2005 issue; 2 pages; Moneta, VA US; www.rotory.com.
Parts List; Hirobo S.R.B. Price List; Jul./Jan./Oct. 2004; 4 pages; Edison, NJ US.
Cambridge Aerospace Series, Principles of Helicopter Aerodynamics; 2000; 5 pages; New York, NY US; www.cambridge.org/9780521660600.
Photographic prior art reference #1, helicopter.
Photographic prior art reference #2, helicopter displaying writing in French on the tail.
Photographic prior art reference #3, explanation of the function of the flybar.
Photographic prior art reference #4, toy helicopter, www.raidentech.com.
Photographic prior art reference #5, toy helicopter.
Photographic prior art reference #6, helicopter.
Photographic prior art reference #7, helicopter with M40297 or MA0297 displayed on the tail.
Photographic prior art reference #8, toy helicopter #AHS-23900, hstoy.en.alibaba.com.
Photographic prior art reference #9, toy helicopter, toys999.en.alibaba.com.
Mill, Colin. "Practical Theories, Part 9", W3MH—World Wide Web *Model Helicopter Magazine*, Jul. 1996, http://www.w3mh.co.uk/articles/html/csm9-11.htm.
Day, David. "Moving swashplates & CCPM", 2001-2006. See http://www.iroquois.free-online.co.uk.
Selberg, B.P.; Cronin, D.L.; Rokhsaz, K.; Dykman, J.R., Yager, C. J. "Aerodynamic-Structural Analysis of Dual Bladed Helicopter Systems (Field Technical Report", Report No. NASA-CR-162754, Feb. 1980 46p (Abstract).
Ham, Normand. Helicopter individual-blade-control research at MIT 1977-1985; DGLR, European Rotorcraft Forum, 12th, Garmisch-Partenkirchen, West Germany; Germany, Federal Republic of; Sep. 22-25, 1986 10 pp. 1986 (Abstract).
Proctor, Paul. "Aviation Week & Space Technology", v146, n13, p. 47(1), Mar. 31, 1997 (Abstract).
Zein-Sabatto, S.; Zheng, Y. "Intelligent Flight Controllers for Helicopter Control"; 1997 IEEE International Conference on Neural Networks, Proceedings (Cat. No. 97CH36109) Part vol. 2 p. 617-21 vol. 2 (Abstract).
Mirick, Paul H. "A Comparison of Theory and Experiment for Coupled Rotor Body Stability of a Bearingless Rotor Model in Hover and Forward Flight", Jun. 1, 1988, IP Document Id 19880017770 pp. 87-101 (Abstract).
US District Court, Eastern District of Virginia, Norfolk Division, *Silverlit Toys Manufactory, Ltd.*, et. al. v. *Westminster, Inc.*, et al., Case No. 2:07--cv-472-JBF/JEB.
US District Court, Northern District of Georgia, Atlanta Division, *Westminster, Inc.* v. *Silverlit Toys Manufactory, Ltd.*, et al., Case No. 1:07-cv-2450-JOF.
US District Court, Central District of California, Southern Division, *Innovage LLC* v. *Silverlit Toys Manufactory, Ltd.*, et al., Case No. SACV07-1334 DOC (ANx).
"Declaration of Alexander Van De Rostyne in Support of Defendants and Counterclaimants Silverlit Toys Manufactory Ltd.'s and Spin Master Ltd.'s Motion for Preliminary Injunction", with relevant Exhibits A, C and E-Q, filed on Dec. 3, 2007, in USDC Case No. SACV07-1334 DOC (ANx).
"Declaration of Kei Fung ("Kevin") Choi in Support of Defendants and Counterclaimants' Motion for Preliminary Injunction", with relevant Exhibits A, C, and E, filed on Dec. 3, 2007, in USDC Case No. SACV07-1334 DOC (ANx).
"Declaration of L. Kenneth Rosenthal in Support of Counterclaimants Silverlit Toys Manufactory Ltd.'s and Spin Master Ltd.'s Motion for Preliminary Injunction", with relevant Exhibits O, P, S, V, Y, BB, MM and NN, filed on Dec. 3, 2007, in USDC Case No. SACV07-1334 DOC (ANx).
"Memorandum of Points and Authorities in Support of Motion for Preliminary Injunction of Silverlit Manufactory Ltd. and Spin Master Ltd.", filed on Dec. 3, 2007, in USDC Case No. SACV07-1334 DOC (ANx).
"Declaration of Valerie W. Ho in Support of Defendants and Counterclaimants' Motion for Preliminary Injunction", with relevant Exhibits A, B and M, filed on Dec. 3, 2007, in USDC Case No. SACV07-1334 DOC (ANx).
"Declaration of Conor Forkan in Support of Counterclaimants Silverlit Toys Manufactory Ltd.'s and Spin Master Ltd.'s Reply to Innovage's Opposition to Motion for Preliminary Injunction", with relevant Exhibits A-D, filed on Dec. 26, 2007, in USDC Case No. SACV07-1334 DOC (ANx).
"Declaration of L. Kenneth Rosenthal in Support of Counterclaimants Silverlit Toys Manufactory Ltd.'s and Spin Master Ltd.'s Reply to Innovage's Opposition to Motion for Preliminary Injunction", with relevant Exhibits A-D, filed on Dec. 26, 2007, in USDC Case No. SACV07-1334 DOC (ANx).
"Counterclaimants Silverlit Toys Manufactory Ltd.'s and Spin Master Ltd.'s Reply in Support of Motion for Preliminary Injunction", filed on Dec. 26, 2007, in USDC Case No. SACV07-1334 DOC (ANx).
"Innovage's Memorandum of Points and Authorities in Opposition to Silverlit and Spin Master's Motion for Preliminary Injunction", filed on Dec. 19, 2007, in USDC Case No. SACV07-1334 DOC (ANx).
"Declaration of Francisco Rubio-Campos in Support of Plaintiff Innovage LLC's Opposition to Silverlit and Spin Master's Motion for Preliminary Injunction", filed on Dec. 19, 2007, in USDC Case No. SACV07-1334 DOC (ANx).
"Declaration of Jennifer Hamilton in Support of Plaintiff Innovage LLC's Opposition to Silverlit and Spin Master's Motion for Preliminary Injunction", filed on Dec. 19, 2007, in USDC Case No. SACV07-1334 DOC (ANx).
"Counterclaim Defendant Merchsource's Opposition to Preliminary Injunction", filed on Dec. 19, 2007, in USDC Case No. SACV07-1334 DOC (ANx).
"Declaration of Lowell Anderson in Opposition to Preliminary Injunction", filed on Dec. 19, 2007, in USDC Case No. SACV07-1334 DOC (ANx).
"Supplemental Declaration of Francisco Rubio-Campos in Support of Plaintiff Innovage LLC's Opposition to Silverlit and Spin Master's Motion for Preliminary Injunction", filed on Jan. 4, 2008, in USDC Case No. SACV07-1334 DOC (ANx).
"Declaration of Nicholas Ringold in Support of Defendants and Counterclaimants' Reply to Merchsource LLC's Opposition to Ex Parte Application to Shorten Time for Hearing on Preliminary Injunction", with relevant Exhibits B-I, filed on Dec. 5, 2007, in USDC Case No. SACV07-1334 DOC (ANx).
"Declaration of Kei Fung ("Kevin") Choi in Support of Defendants and Counterclaimants' Reply to Merchsource LLC's Opposition to Ex Parte Application to Shorten Time for Hearing on Preliminary Injunction", with Exhibit A, filed on Dec. 6, 2007, in USDC Case No. SACV07-1334 DOC (ANx).

"Counterclaimants Silverlit Toys Manufactory Ltd.'s and Spin Master's Reply to Merchsource LLC's Opposition to Ex Parte Application to Shorten Time on Hearing on Motion for Preliminary Injunction", filed on Dec. 6, 2007, in USDC Case No. SACV07-1334 DOC (ANx).
"Counterclaimants Silverlit Toys Manufactory Ltd.'s and Spin Master's 1) Reply to Innovage LLC's Opposition to Ex Parte Application to Shorten Time on Hearing on Motion for Preliminary Injunction, and 2) Opposition to Innovage LLC's Ex Parte Application for Order to Extend Time to Oppose Motion for Preliminary Injunction", filed on Dec. 5, 2007, in USDC Case No. SACV07-1334 DOC (ANx).
"Declaration of Lowell Anderson in Opposition to Ex parte Application to Shorten Time for Hearing on Preliminary Injunction", filed on Dec. 4, 2007, in USDC Case No. SACV07-1334 DOC (ANx).
"Counterclaim Defendant Merchsource's Opposition to Ex Parte Application to Shorten Time for Hearing on Motion for Preliminary Injunction", filed on Dec. 4, 2007, in USDC Case No. SACV07-1334 DOC (ANx).
"Plaintiff Innovage LLC's Opposition to Defendant Silverlit and Spin Master's Ex Parte Application for Order to Shorten Time for Hearing on Defendants' Motion for Preliminary Injunction; Declaration of Barry Messner in Support", filed on Dec. 4, 2007, in USDC Case No. SACV07-1334 DOC (ANx).
"Plaintiff Innovage LLC's Ex Parte Application for Order to Extend Time to Oppose Defendants' Motion for Preliminary Injunction; Memorandum of Points and Authorities; Declaration of Barry Messner", filed on Dec. 4, 2007, in USDC Case No. SACV07-1334 DOC (ANx).
"Amended Answer, Affirmative Defenses and Counterclaims for: (1) Patent Infringement; (2) Trade Dress Infringement; (3) Unfair Competition and False Designation of Origin; (4) Unfair Competition Under California Business & Professions Code § 17200; and (5) Copyright Infringement", filed on Dec. 11, 2007, in USDC Case No. SACV07-1334 DOC (ANx).
"Innovage's Reply in Opposition of Silverlit and Spin Master to Plaintiff Innovage LLC's Ex Parte Application for Order to Extend Time to Oppose Defendant's Motion for Preliminary Injunction", filed on Dec. 7, 2007, in USDC Case No. SACV07-1334 DOC (ANx).
"Counterclaim Defendant Innovage LLC's Amended Reply and Affirmative Defenses to Counterclaims of Silverlit Toys Manufactory Ltd. and Spin Master Ltd.", filed on Jan. 9, 2008, in USDC Case No. SACV07-1334 DOC (ANx).
"*ORDER* Denying Defendants' Motion for Preliminary Injunction", filed on Jan. 8, 2008, in USDC Case No. SACV07-1334 DOC (ANx).
"Counterclaimants Silverlit Toys Manufactory Ltd.'s and Spin Master's Objection and Motion to Strike Plaintiff Innovage LLC's Belated Supplemental Declaration of Francisco Rubio-Campos", filed on Jan. 4, 2008, in USDC Case No. SACV07-1334 DOC (ANx).
"Supplemental Declaration of Francisco Rubio-Campos in Support of Plaintiff Innovage LLC's Opposition to Silverlit ad Spin Master's Motion for Preliminary Injunction", filed on Jan. 4, 2008, in USDC Case No. SACV07-1334 DOC (ANx).
"Counterclaim Defendant Innovage LLC's Reply and Affirmative Defenses to Counterclaims of Silverlit Toys Manufactory Ltd. and Spin Master Ltd.", filed on Dec. 26, 2007, in USDC Case No. SACV07-1334 DOC (ANx).
"Counterclaim Defendant Merchsource LLC's Answer and Defenses to Counterclaims of Silverlit Toys Manufactory Ltd. and Spin Master Ltd.", filed on Dec. 26, 2007, in USDC Case No. SACV07-1334 DOC (ANx).
"Answer, Affirmative Defenses and Counterclaims for: (1) Patent Infringement; (2) Trade Dress Infringement; (3) Unfair Competition and False Designation of Origin; and (4) Unfair Competition Under California Business & Professions Code § 17200", with Exhibits E & F, filed on Dec. 3, 2007, in USDC Case No. SACV07-1334 DOC (ANx).
"Complaint for: 1) Declaratory Judgment of Invalidity and Non-Infringement of Certain Design Patents; 2) Declaratory Judgment of Invalidity and Non-Infringement of Trade Dress", filed on Nov. 13, 2007, in USDC Case No. SACV07-1334 DOC (ANx).
Photo of portion of PicooZ product package; Silverlit 2006 Product Catalog (5 pages total).
Partial International Search from PCT/US2006/047982.
Photographic prior art reference, Dragonfly helicopter (2005) (4 pages).
*Piccolino: 1.69 gram RC helicopter*—RCGroups.com, http://www.rcgroups.com/forums/showthread.php?t=509295, Apr. 24, 2006 (6 pages).
International Search from PCT/US2008/051938.
Pryun, Richard R. "In-flight measurement of rotor blade airloads, bending moments, and motions, together with rotor shaft loads and fuselage vibration, on a tandem rotor helicopter", *Boeing*, Nov. 1967 (Abstract, 1 pg).
Brahmananda, et al. "Application of passive dampers to modern helicopters", Smart Mater 1996 http://www.iop.org/EJ/abstract/0964-1726/5/5/001 (Abstract, 1 pg).
http://www.microhelicopters.net, Jul. 7, 2008 (3 pgs).
Castillo, et al. "Real-time stabilization and tracking of a four-rotor mini rotorcraft", IEEE, Jul. 2004 http://www.ieeexplore.org/xpl/freeabs_all.jsp?arnumber=1308180 (1 pg).
"Structural Components, Design of Tilt-Rotor JVX Near Completion", Aviation Week & Space Technology, vol. 122, No. 2, p. 84, Jan. 14, 1985 (10 pgs).
European Search Opinion dated Jun. 10, 2008, in EP 06 845 583.1.
Website reference, en.wikipedia.org/wiki/Kamov_Ka-50, Kamov Ka-50, Jun. 19, 2004 (6 pages).
Photographic reference, en.wikipedia.org/wiki/Image:Kamov Ka-50_MAKS-2005.jpg, Aug. 28, 1995.
Photographic reference, www.fas.org/man/dod-101/sys/ac/row/ka-50-hokunn.jpg, Aug. 28, 1995.
Photographic reference, www.aviastar.org/foto/ka-50_1.jpg, Aug. 28, 1995.
Website reference, web.archive.org/web/20050225044931/http://www.silverlit.com (2 pages).
Website reference, web.archive.org/web/20060616140712/boeing.com/rotorcraft/military/ah64d/index.htm, Nov. 23, 2001 (2 pages).
Website reference, en.wikipedia.org/wiki/AH-64_Apache, Jul. 16, 2004 (11 pages).
Website reference, http://www.globalsecurity.org/military/systems/aircraft/ah-64d.htm, Nov. 7, 2001 (6 pages).
Photographic reference, www.fas.orqg/man/dod-101/sys/ac/ah-64.gif, Aug. 19, 2000.
Photographic reference, en.wikipedia.org/wiki/Image:P320007.jpg, 1981 (3 pages).
Photographic reference, www.fas.org./man/dod-101/sys/ac/ah-64d_001.jpg, Mar. 21, 1997.
Photographic reference, www.fas.org./man/dod-101/sys/ac/ah-64d-image83.jpg, Aug. 19, 2000.
Photographic reference, www.fas.org./man/dod-101/sys/ac/ah-64d-longbow1.jpg, Aug. 19, 2000.
Photographic reference, www.fas.org/man/dod-101/sys/ac/ah-64-dvic294.jpg, Feb. 2, 2003.
Photographic reference, www.voodoo.cz/ah64/pics/ah115.jpg, Jun. 14, 2001.
Photographic reference, www.voodoo.cz/ah64/pics/ah122.jpg, Jan. 10, 2002.
Photographic reference, www.voodoo.cz/ah64/pics/ah106.jpg, Jan. 9, 2002.
Photographic reference, www.voodoo.cz/ah64/pics/ah112.jpg, Aug. 22, 2002.
Photographic reference, www.voodoo.cz/ah64/pics/ah092.jpg, Jan. 8, 2002.
Photographic reference, www.voodoo.cz/ah64/pics/ah153.jpg, Apr. 4, 2002.
Photographic reference, www.voodoo.cz/ah64/pics/ah149.Jpg, Jul. 8, 2000.
Photographic reference, www.voodoo.cz/ah64/pics/ah051.jpg, Jan. 8, 2002.
Photographic reference, www.voodoo.cz/ah64/pics/ah049.jpg, Mar. 15, 2002.
Photographic reference, www.voodoo.cz/ah64/pics/ah027.jpg, May 8, 1999.
Photographic reference, www.voodoo.cz/ah64/pics/ah010.jpg, Jul. 8, 2000.

Photographic reference, www.voodoo.cz/ah64/pics/ah003.jpg, Sep. 1, 2001.
Photographic reference, www.airforceworld.com/heli/gfx/ah64/wah64_1.jpg, 1991.
Photographic reference, www.fas.org/man/dod-101/sys/ac/ah-64a-990421-F-2095R-004.jpg, Aug. 19, 2000.
Photographic reference, www.fas.org/man/dod-101/sys/ac/ah-64-dvic292.jpg, Aug. 19, 2000.
Website reference, www.runryder.com/helicopter/t285494p1/, Jun. 12, 2007 (10 pages).
Website reference, web.archive.org/web/20031218200732/http://www.scarlet.be/pixel/pixeli111.htm, Dec. 18, 2003 (7 pages).
Website reference, web.archive.org/web/20031017234927/http://www.scarlet.be/pixel/pixelfp.htm, Oct. 17, 2003 (2 pages).
Website reference, web.archive.org/web/20031218061901/http://pixelito.reference.be/, Dec. 18, 2003 (4 pages).
Website reference, www.aviastar.org/helicopters_eng/breguet-dorand.php, 1935 (4 pages).
Website reference, www.lionheartcreations.com/Lionheartsflightsimsite_page7.html, May 6, 2004 (4 pages).
Website reference, www.lionheartcreations.com/FalconE.html, Jun. 22, 2004 (2 pages).
Photographic reference, www.rotaryaction.com/images/airwolf4.jpg, 1984.
Website reference, www.rotaryaction.com/pages/airwolf.html, 1984 (3 pages).
Website reference, http://www.youtube.com/watch?v=DsXgmOurwts, "Golden Age Pioneers—Nicolas Florine", Mar. 28, 2008 (4 pages).
Robert Dingemanse, Press Release "Flying Car Company Takes Off" http://www.pal-v.com.
"Esky Dauphin 4-channels Mini Electric Coaxial Helicopter", http://www.esky-heli.com/esky-24g-4ch-dauphin-bluegrey-rtf-kit-for-beginner-flightsim-p-2994.html, May 8, 2008.
Chinook Helicopter, first flight 1961, as referenced in Wikipedia http://en.wikipedia.org/wiki/CH-47 Chinook, Dec. 15, 2008 (11 pages).
Office Action dated Feb. 10, 2009, from U.S. Appl. No. 11/462,177 (pending) (9 pages).
Office Action dated Feb. 10, 2009, from U.S. Appl. No. 11/465,781 (pending) (9 pages).
Office Action dated May 8, 2008, from U.S. Appl. No. 11/754,752, now 7,494,397 (9 pages).
Office Action dated May 7, 2008, from U.S. Appl. No. 11/842,719, now 7,467,984 (9 pages).
Office Action dated May 8, 2008, from U.S. Appl. No. 11/953,826, now 7,425,167 (10 pages).
Office Action dated May 8, 2008, from U.S. Appl. No. 11/953,830, now 7,425,168 (10 pages).
Office Action dated May 8, 2008, from U.S. Appl. No. 11/953,823, now 7,422,505 (11 pages).
Office Action dated Mar. 31, 2009, from U.S. Appl. No. 12/264,890 (pending) (8 pages).
Office Action dated May 29, 2009, from U.S. Appl. No. 12/264,890 (pending) (10 pages).
Office Action dated Jun. 1, 2009, from U.S. Appl. No. 11/627,919 (pending) (9 pages).
Office Action dated Jun. 2, 2009, from U.S. Appl. No. 11/736,506 (pending) (9 pages).
Office Action dated Jun. 16, 2009, from U.S. Appl. No. 12/402,446 (pending) (10 pages).
European Search Report on Application No. EP 09170748, Completed Feb. 9, 2010, Munich.
European Search Report on Application No. EP 09170725, Completed Feb. 24, 2010, Munich.

* cited by examiner

HELICOPTER

RELATED PATENTS AND APPLICATIONS

This application is a continuation-in-part of U.S. patent application Ser. No. 11/627,919, filed Jan. 26, 2007, still pending, which is a continuation-in-part of U.S. patent application Ser. No. 11/465,781, Aug. 18, 2006, still pending, which is a continuation-in-part of U.S. patent application Ser. No. 11/462,177, filed Aug. 3, 2006, still pending, which claims priority to Belgian Patent Application No. 2006/0043 entitled Autostabiele helicopter by Alexander VAN DE ROSTYNE, which was filed on Jan. 19, 2006. This application is also related to U.S. Pat. Nos. 7,494,397; 7,467,984; 7,425,168; 7,425,167; 7,422,505; and U.S. patent application Ser. No. 11/736,506, filed Apr. 17, 2007. The contents of all these patents (Van de Rostyne) and applications (Van de Rostyne) are incorporated by reference herein in their entirety.

BACKGROUND

The present disclosure concerns an improved flying object such as a helicopter.

The disclosure concerns a helicopter generally. In particular, but not exclusively, it is related to a toy helicopter and in particular to a remote-controlled model helicopter or a toy helicopter.

SUMMARY

It is known that a helicopter is a complex machine which is unstable and as a result difficult to control, so that much experience is required to safely operate such helicopters without mishaps.

The present disclosure aims to minimize one or several of the above-mentioned and other disadvantages by providing a simple and cheap solution to auto stabilize the helicopter, such that operating the helicopter becomes simpler and possibly reduces the need for long-standing experience of the pilot.

A helicopter includes a system to effect motion in a horizontal dimension thereby to direct the desired direction, selectively a desired horizontal direction. The rotor blades are driven by a rotor shaft and which is mounted on the rotor shaft, such that the angle between the plane of rotation of the main rotor and the rotor shaft may vary.

A control moves the angle of incidence of at least one blade of the rotor cyclically along a 360 degree rotation path around the vertical rotor shaft, causing a variation in lift force of the blade along the rotation path thereby cause the body to be urged in a relatively horizontal direction from a relative position of horizontal rest. The relative position of horizontal rest is a relatively hovering position above a ground level. By the term, angle of incidence, there is meant the relative angle of attack of the blade in the plane of rotation.

The control includes an actuator for engaging with an assembly depending from the rotor the inter-engagement of the actuator and assembly effecting a change in the angle of incidence of at least the one blade of the rotor.

The control has a control element movable in a first direction such that the control acts to move the angle of incidence in a first direction. The control element is movable in a second direction opposite to the first direction such that the control acts to move the angle of incidence in a second direction opposite to the first direction.

The control element includes an actuator for engaging with a slider element for engagement with an assembly depending from the rotor. The inter-engagement of the actuator and slider element in either of the two directions effects a change in the assembly, and the angle of incidence of at least the one blade of the rotor. There can be other positions with at least one of the actuator being non-interfering with slider, the rotor, or with the control assembly being in a position of rest relative to the actuator, or there being no command from the actuator to interact with the slider.

The main rotor has cams about the rotor shaft, and the auxiliary rotor has engaging follower levers about rotor shaft arranged to engage the cams and adopt different positions of repose between them. The relative positions of the first plane of rotation and the second plane of rotation are changeable as the positions of repose change.

The cams can be elements each spaced from the other circumferentially and there is a pair of engaging followers each respectively to ride on a respective cam surface. The cams can have a first surface to be relatively flat and parallel to the first plane of rotation, and an inclined surface to either side of the flat surface. The inclined surfaces are directed to a second relatively flat surface essentially also parallel to the first plane of rotation. The levers are respectively followers which can mechanically engage directly with the cams. The levers are formed to be in a direction transverse the second longitudinal axis.

The rotor shaft accommodates a first transverse spindle for engagingly locating the main rotor at first level on the shaft in a manner that the rotor blades of the main rotor can oscillate about the spindle and thereby change the angle of incidence of the blades. The rotor shaft at a second position on the shaft is spaced axially from the first position permits for the accommodation of a second spindle for the auxiliary rotor. The second spindle permits the auxiliary rotor to be in a swinging relationship.

The generally first longitudinal axis and the second longitudinal axis are at angle between about zero and about 90 degrees relative to each other. This can be at angle less than about 45 degrees relative to each other. Also it can be at angle less than about 25 degrees relative to each other.

DRAWINGS

The above-mentioned features and objects of the present disclosure will become more apparent with reference to the following description taken in conjunction with the accompanying drawings wherein like reference numerals denote like elements and in which.

Figure 1:
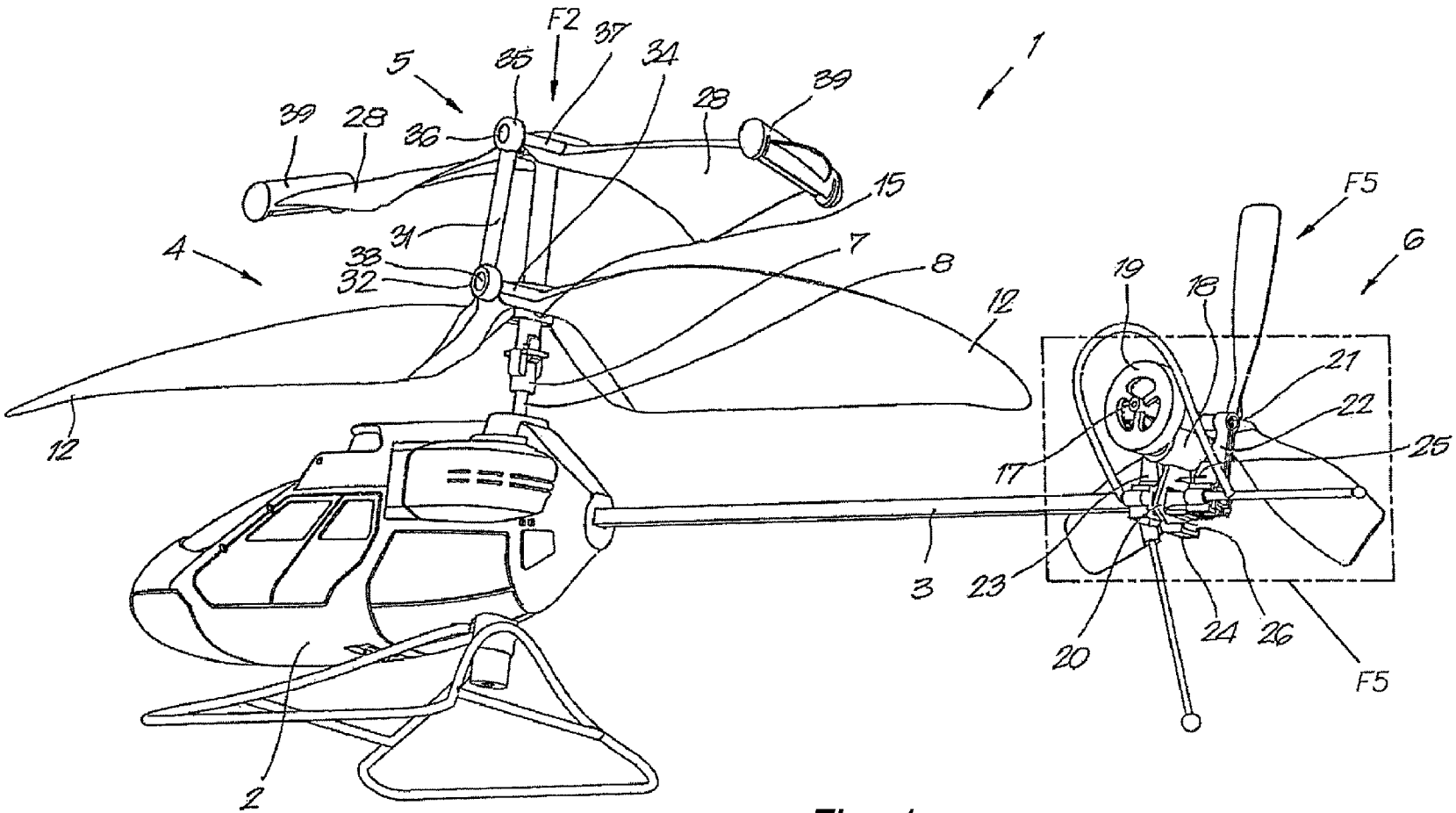
FIG. 1 represents a helicopter according to one embodiment of the present disclosure.
Figure 2:
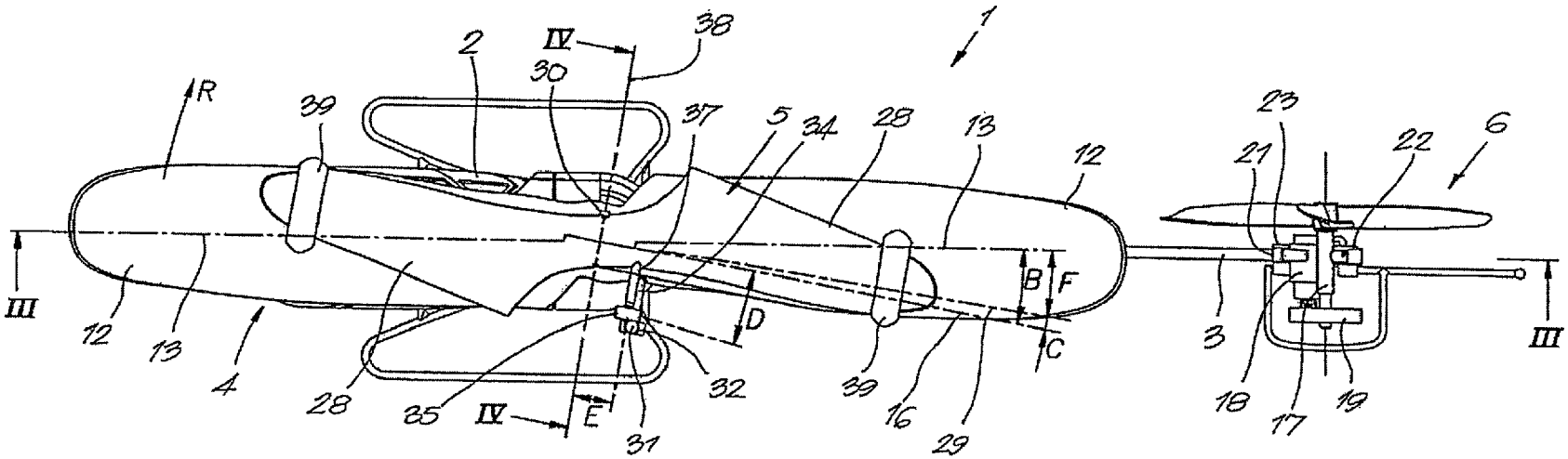
FIG. 2 represents a helicopter according to one embodiment of the present disclosure.
Figure 3A:
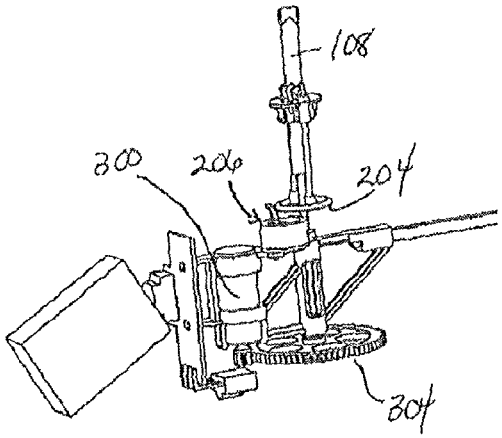
Figure 3B:
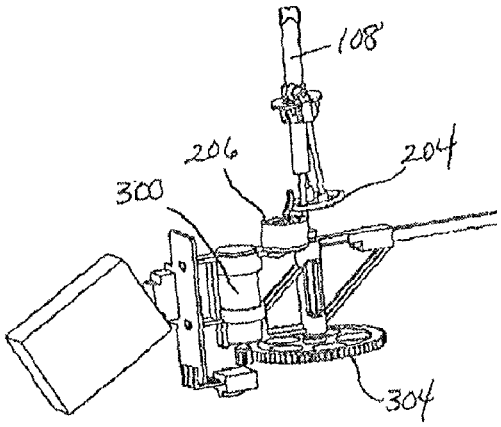
Figure 4:
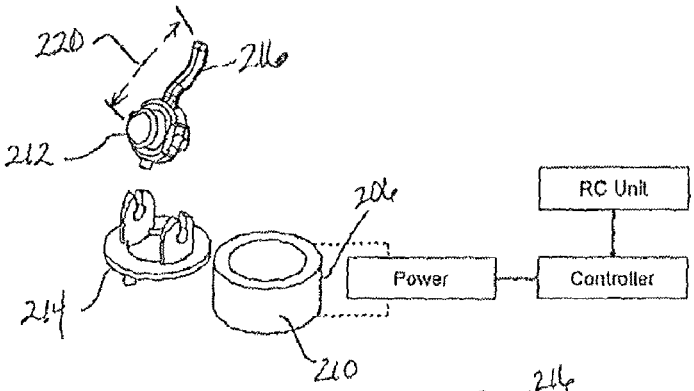
Figure 5:
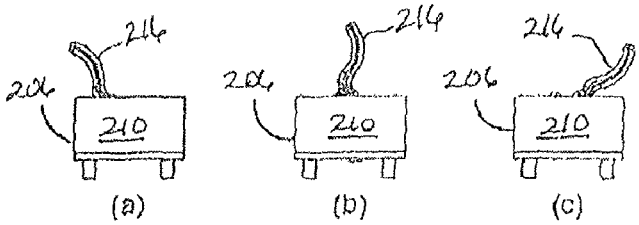
Figure 6:
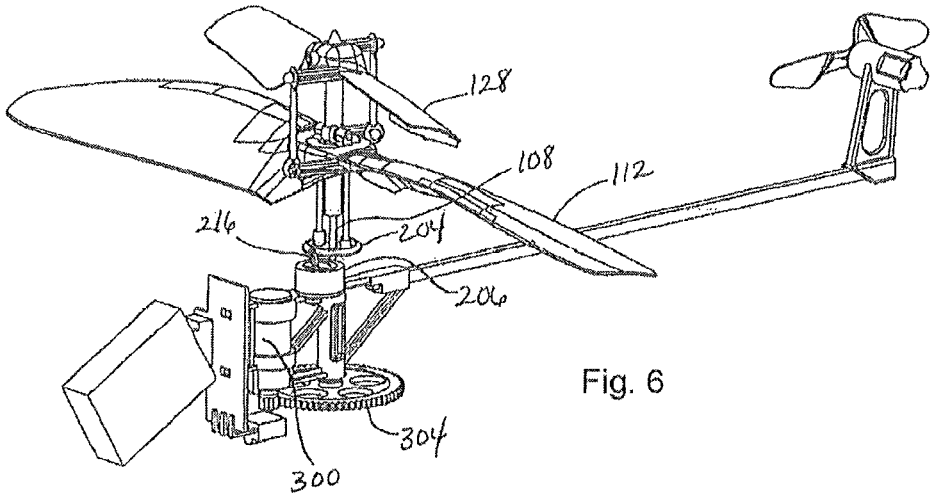
Figure 8A:
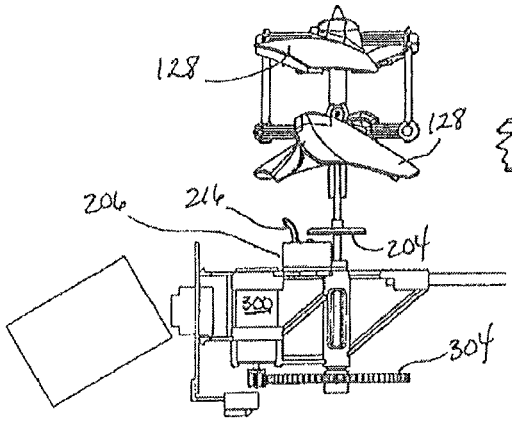
Figure 8B:
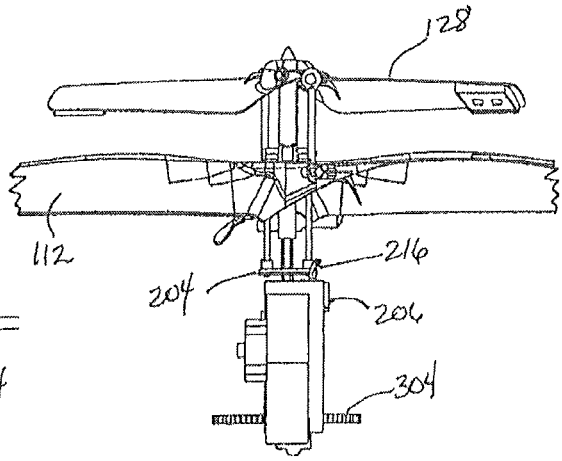
Figure 7:
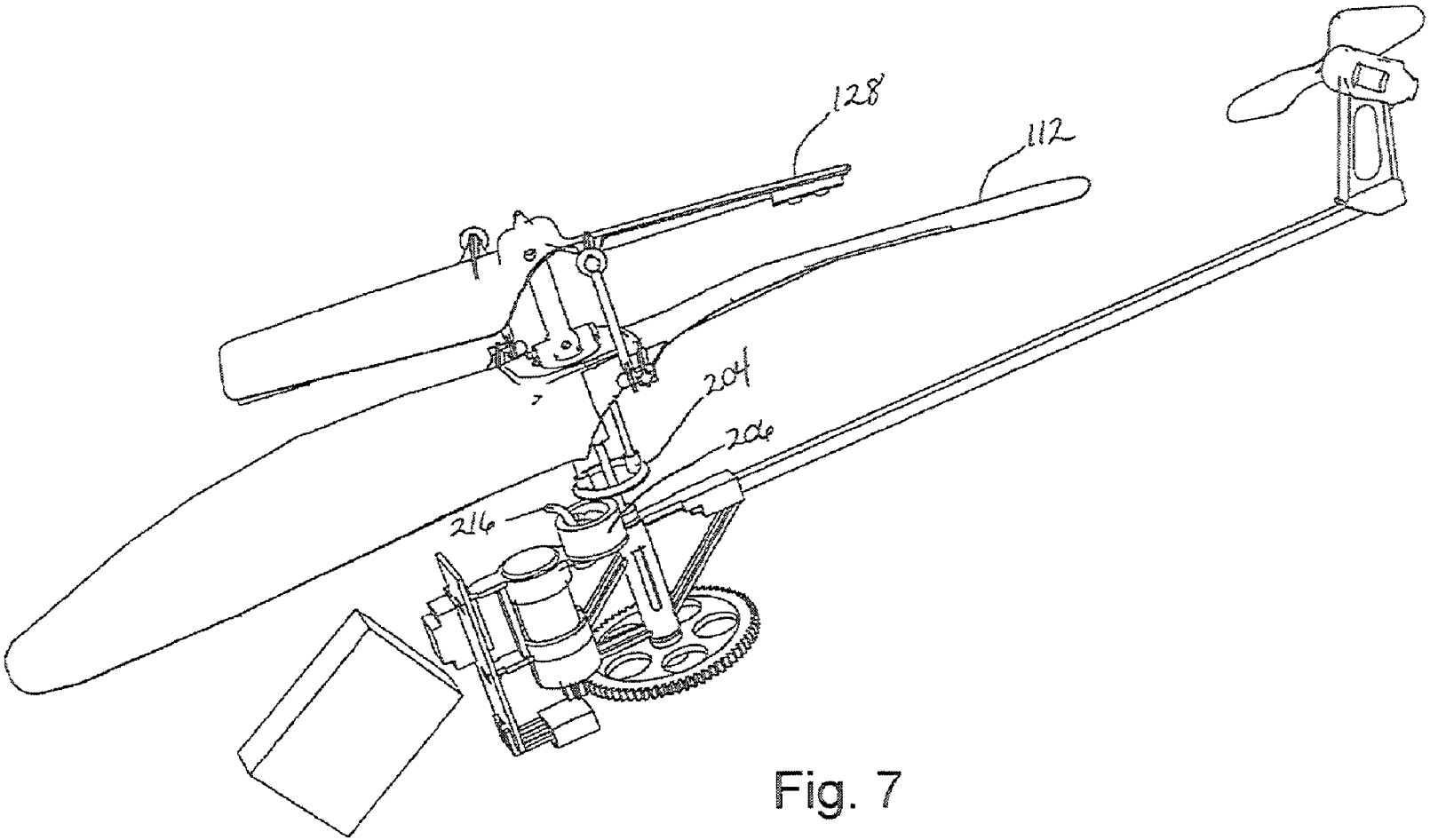
Figure 9A:
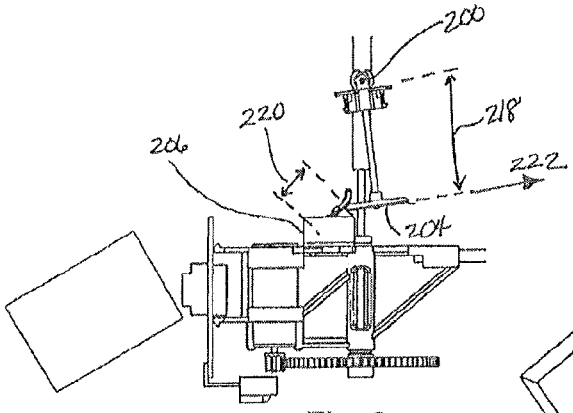
Figure 9B:
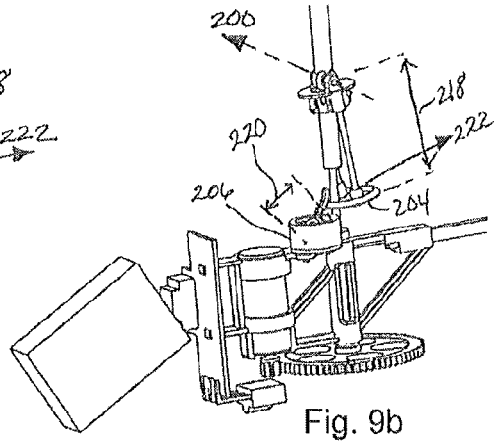
Figure 10A:
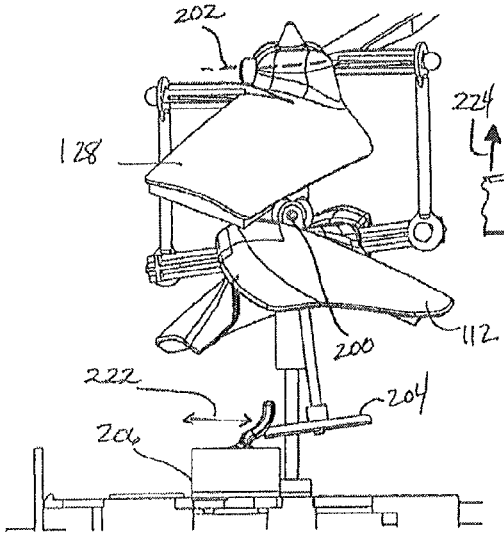
Figure 10B:
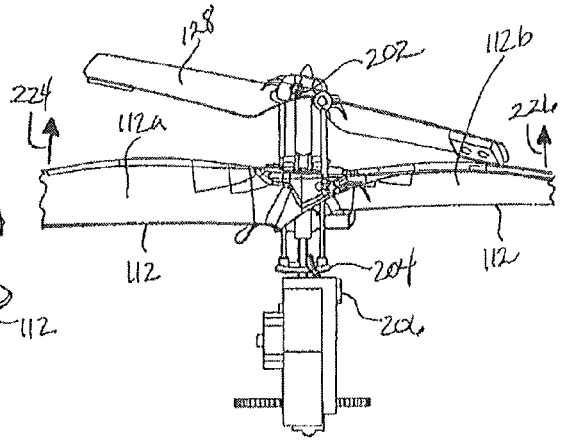
Figure 11:
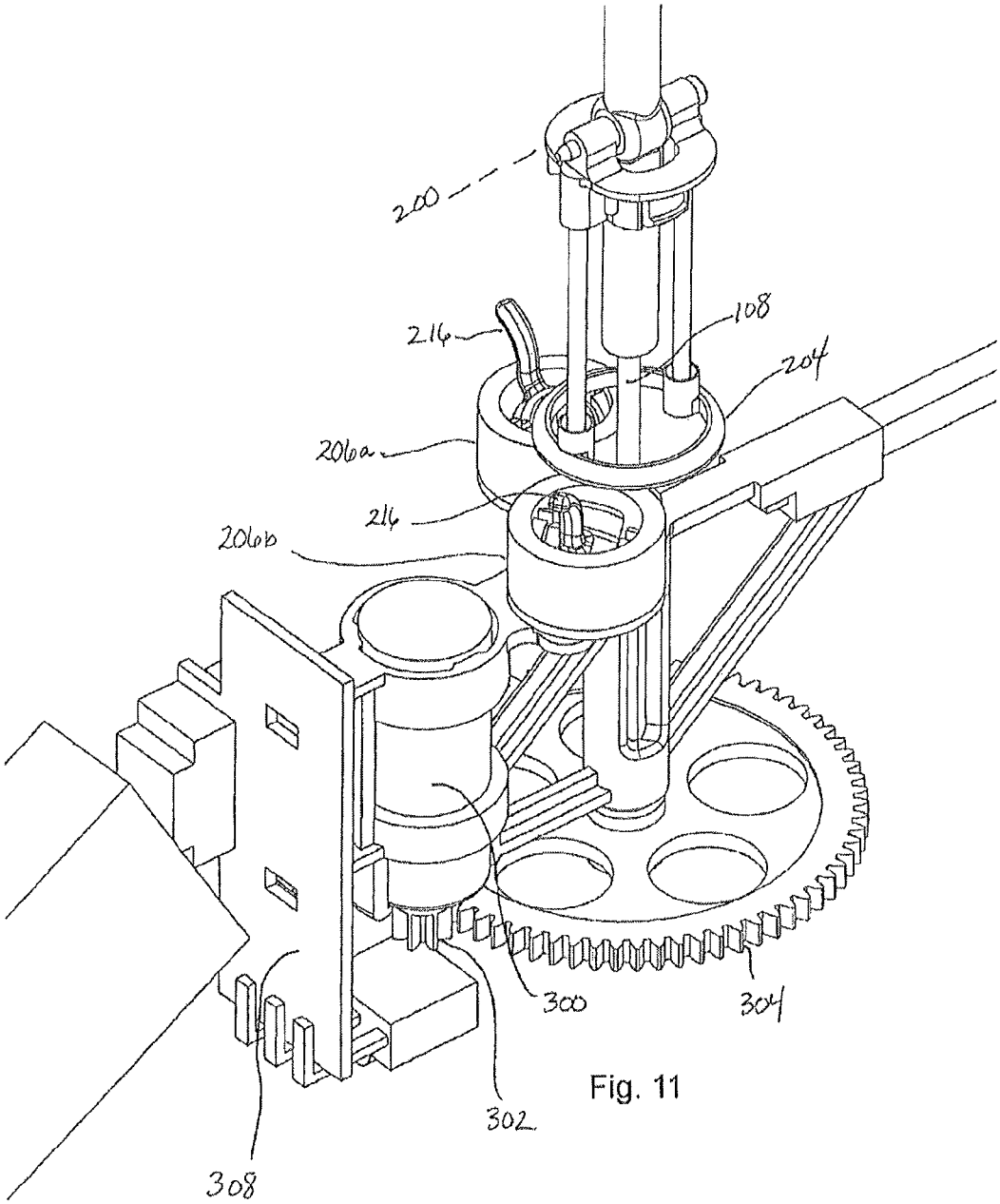

FIG. 3*a* and 3*b* are two respective views showing a control ring is generally centered around the vertical rotor axis. The ring moves around the rotor axis and with the rotor when the rotor is tilted around the feather axis as shown in FIG. 3*b*. The rotor system is omitted for clarity;

FIG. 4 shows an exploded view of the actuator device with a coil, a hinged magnet, a base and a lever;

FIG. 5 shows the lever in different positions (a), (b) and (c);

FIGS. 6, 7 and 8*a* and 8*b* are exemplary and show the control ring and the rotor in different relative positions. FIG. 8*a* is a side view of a portion of the structure and FIG. 8*b* is a front view of the structure;

FIGS. 9*a* and 9*b*, with the rotor omitted for clarity, illustrates the working operation of the control in more detail;

FIGS. 10*a* and 10*b* illustrate the stabilizer movement of the attached rotor depending on its mechanical relationship with the rotor;

FIG. 11 shows a control with two actuators used to exercise force independently and selectively on the control ring.

Figure 12:
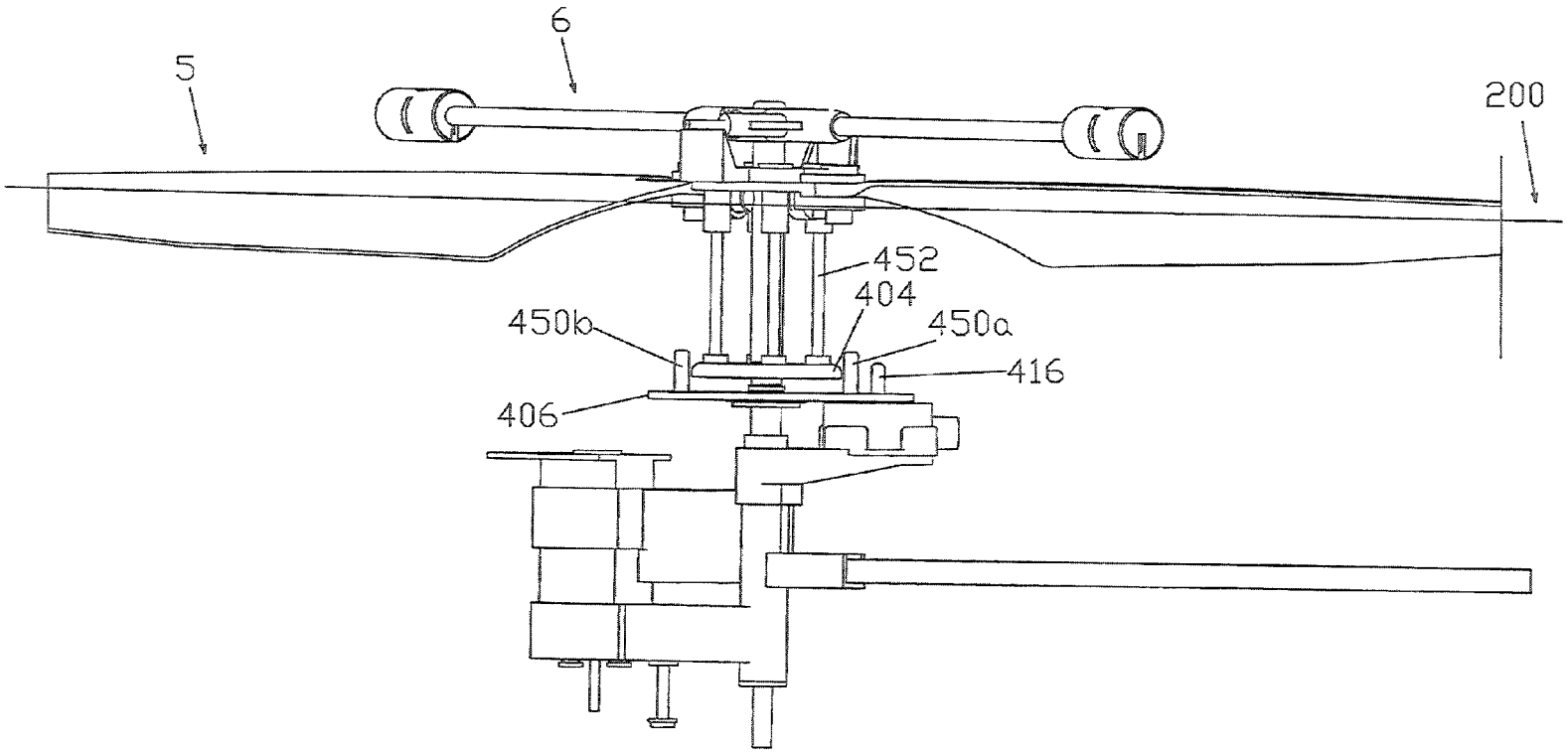

FIG. 12 shows a partial side view of a rotor system with a slider control for a helicopter.

Figure 13:
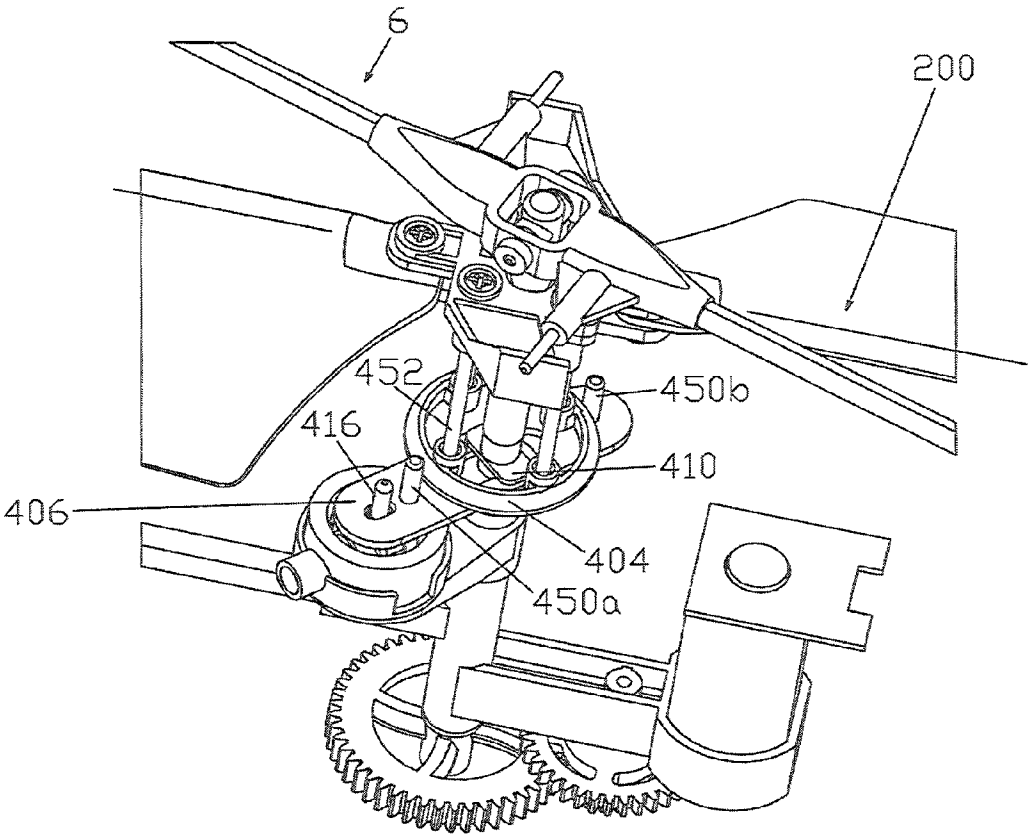

FIG. 13 shows a partial perspective top view of a rotor system with a slider control for a helicopter.

Figure 14:
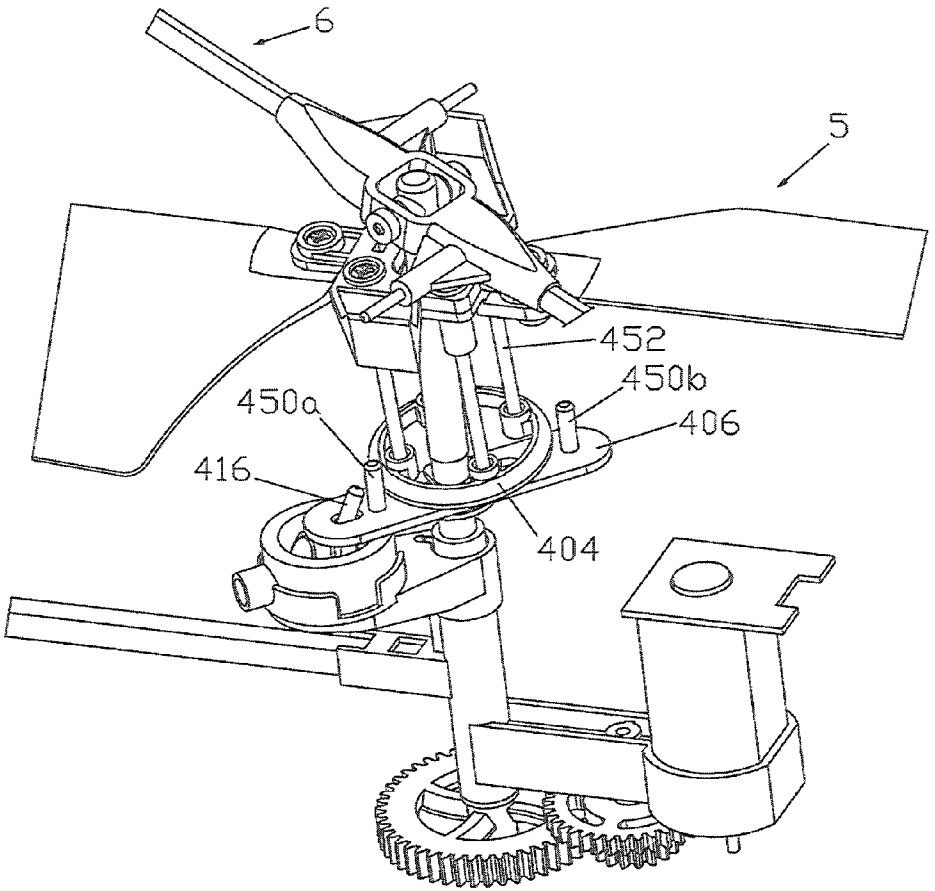

FIG. 14 shows a partial perspective top different view of a rotor system with a slider control for a helicopter.

Figure 15:
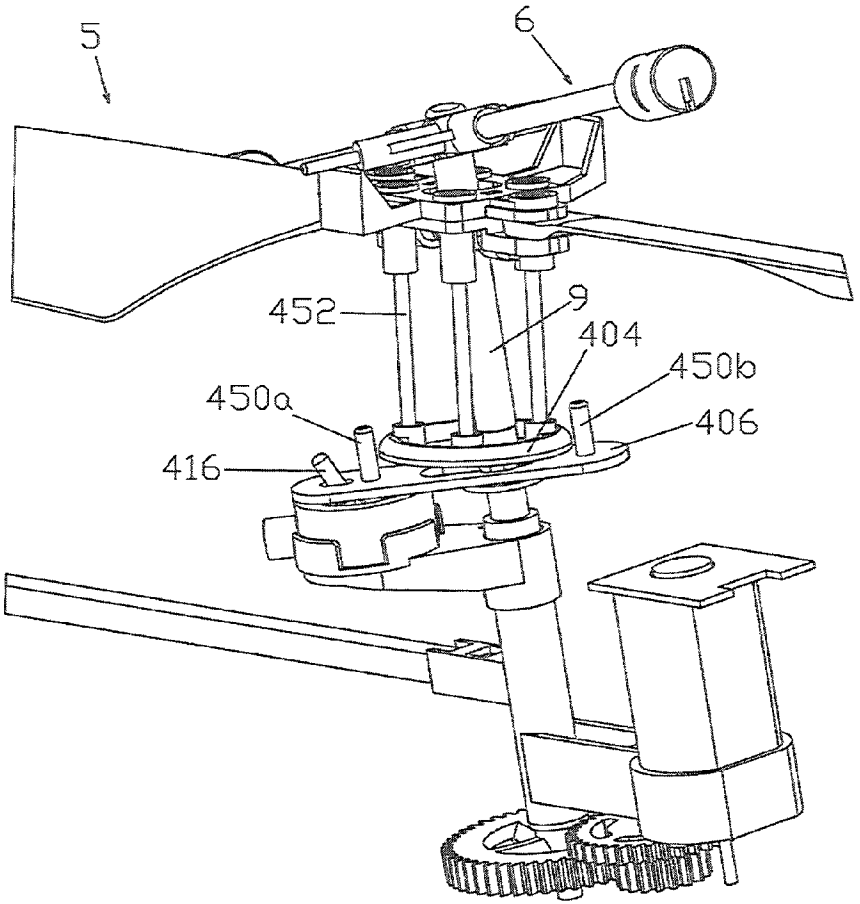

FIG. 15 shows a partial perspective side view of a rotor system with a slider control for a helicopter.

Figure 16:
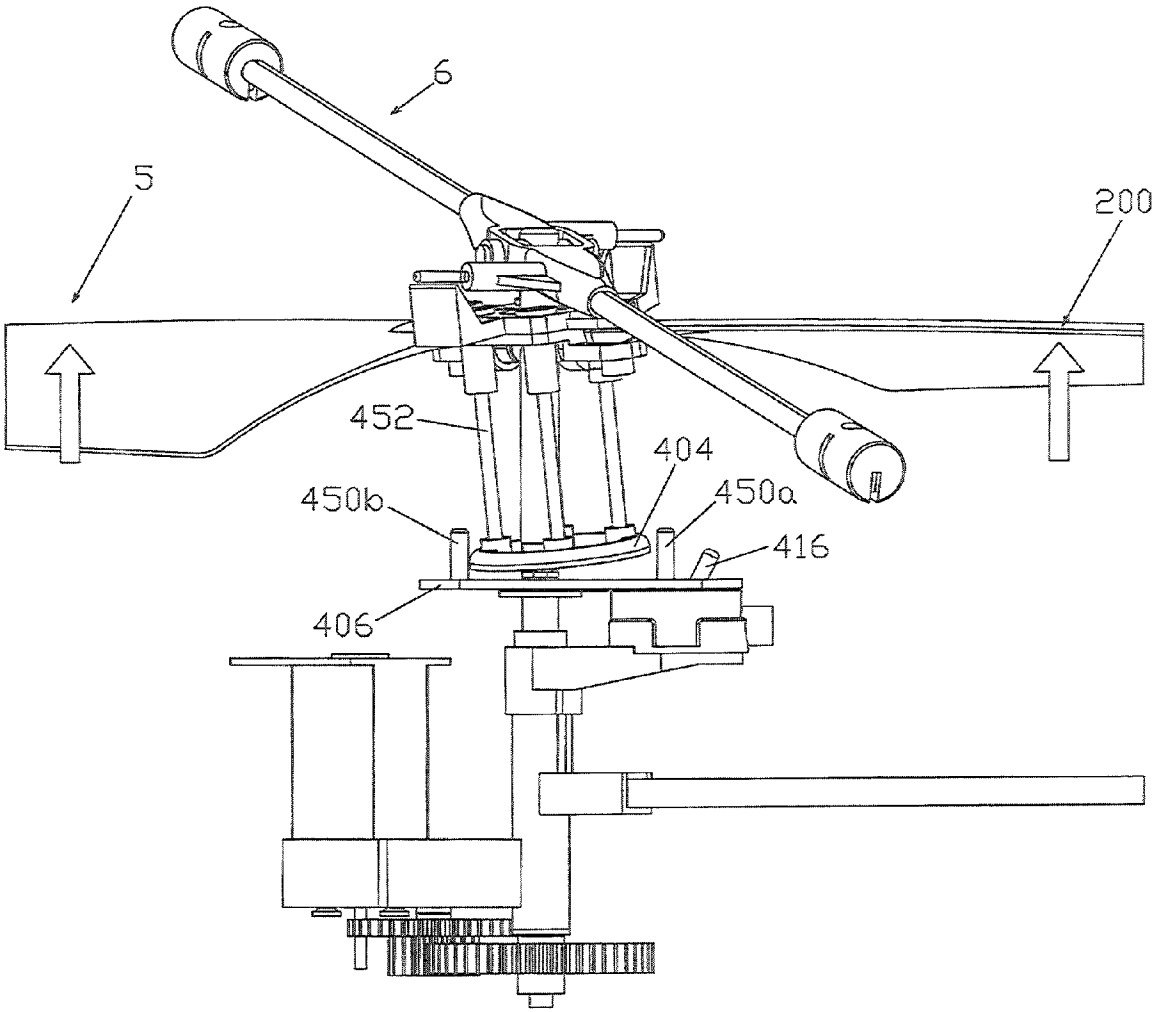

FIG. 16 shows a partial side view of a rotor system with a slider control for a helicopter in a different position of the control and assembly.

Figure 17:
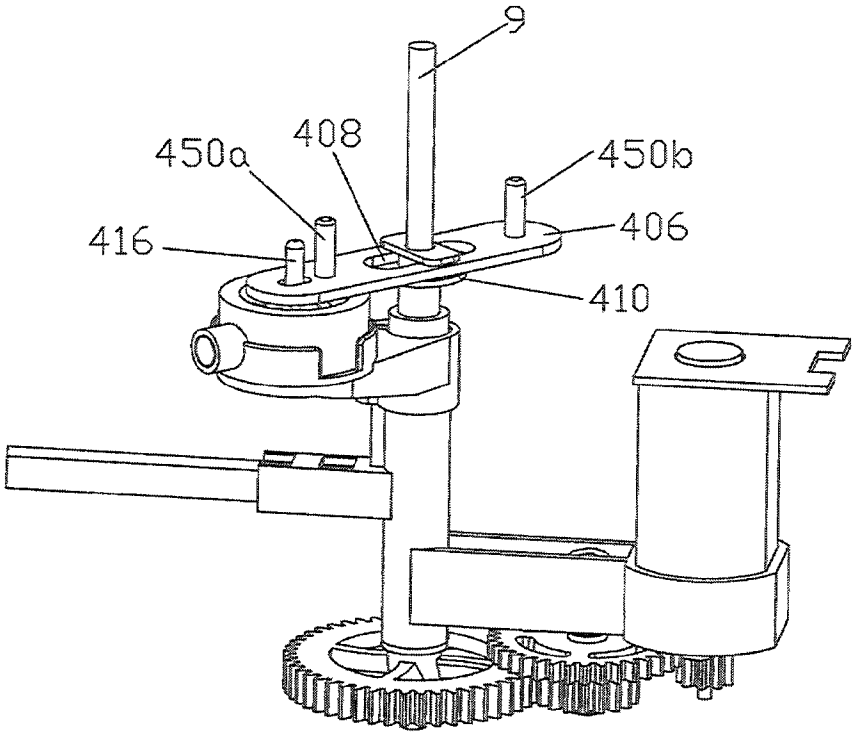

FIG. 17 shows a partial perspective side view of a portion of a slider control for a helicopter.

Figure 18:
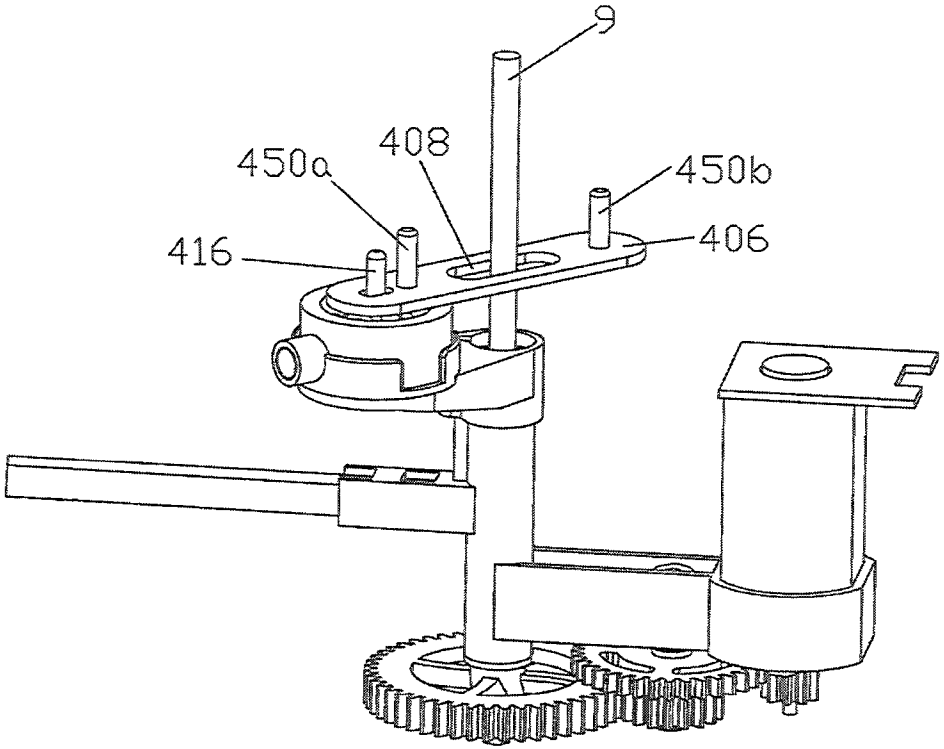

FIG. 18 shows a partial perspective side view of a different portion of a slider control for a helicopter.

Figure 19:
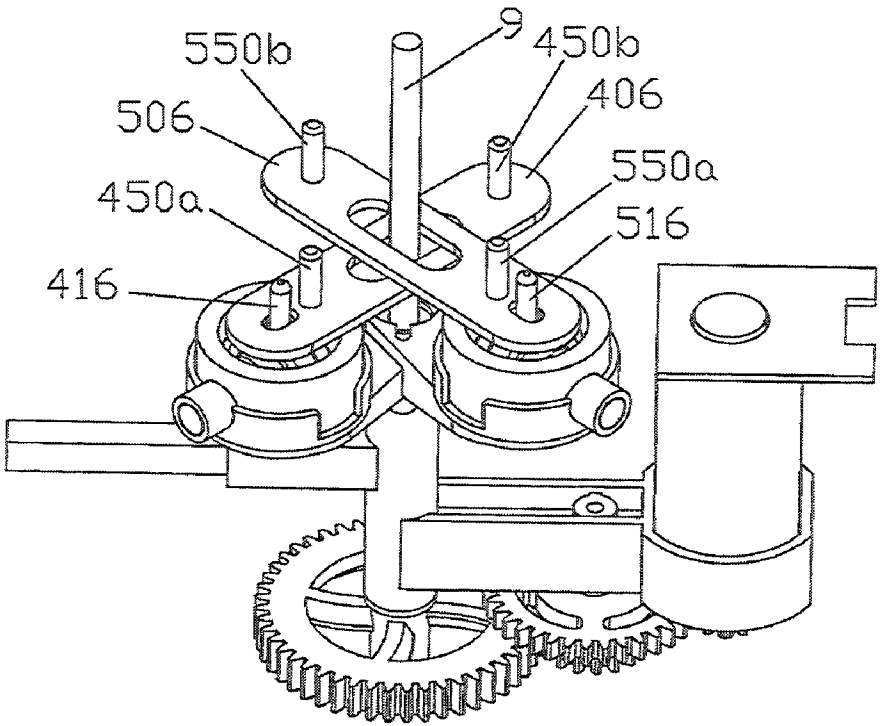

FIG. 19 shows a partial perspective side view of a portion of a two slider control for a helicopter.

Figure 20:
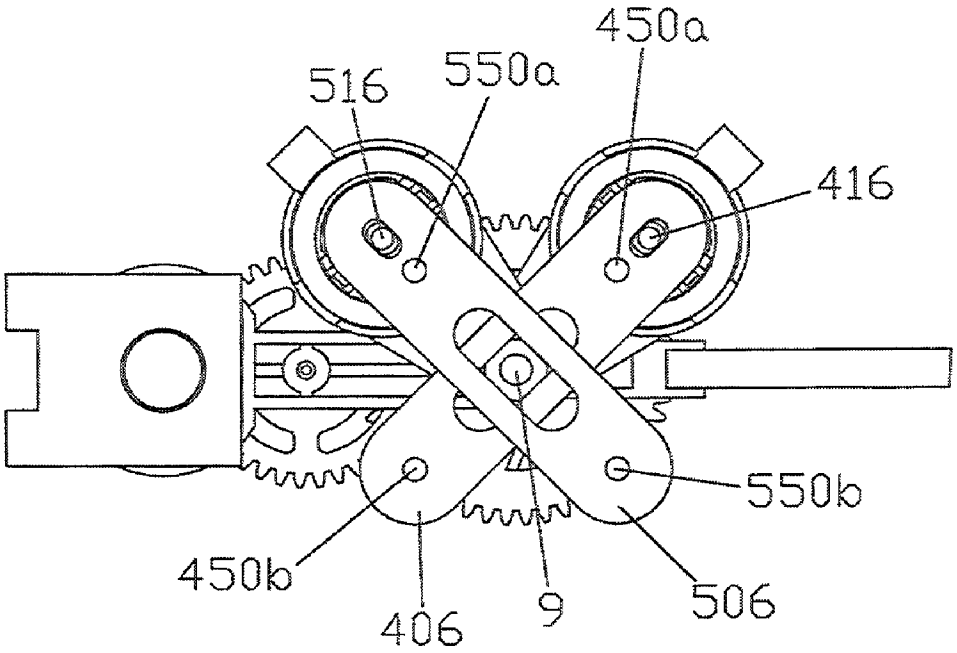

FIG. 20 shows a partial top view of a portion of a two slider control for a helicopter.

Figure 21:
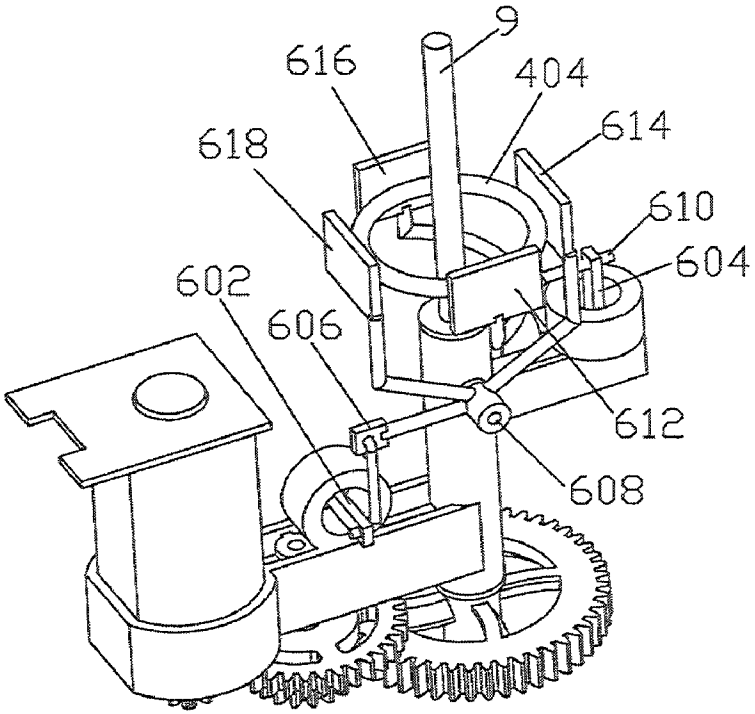

FIG. 21 shows a partial perspective top view of two lever double controls for a helicopter.

Figure 22:
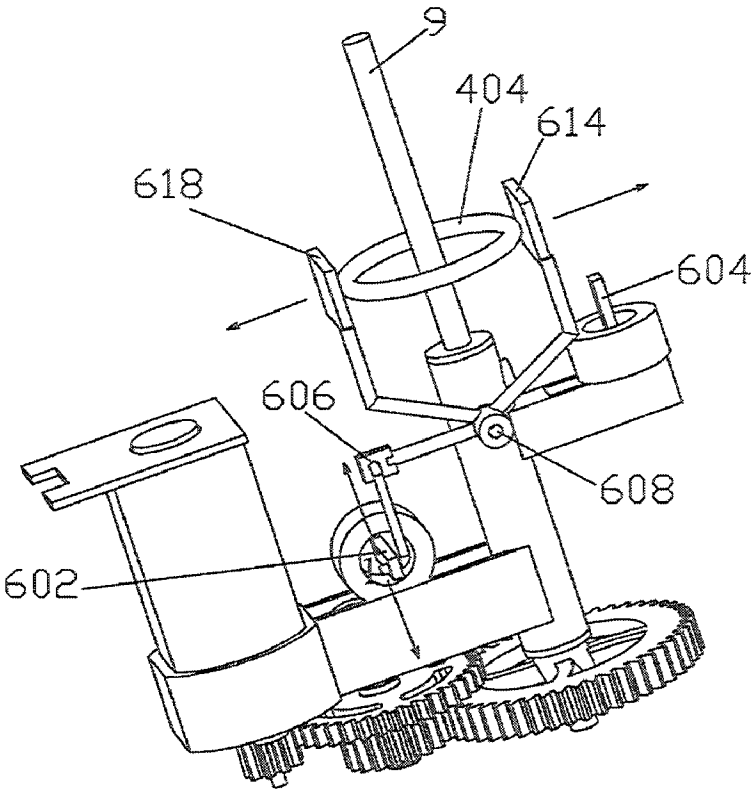

FIG. 22 shows a partial perspective side view of two lever double controls for a helicopter.

Figure 23:
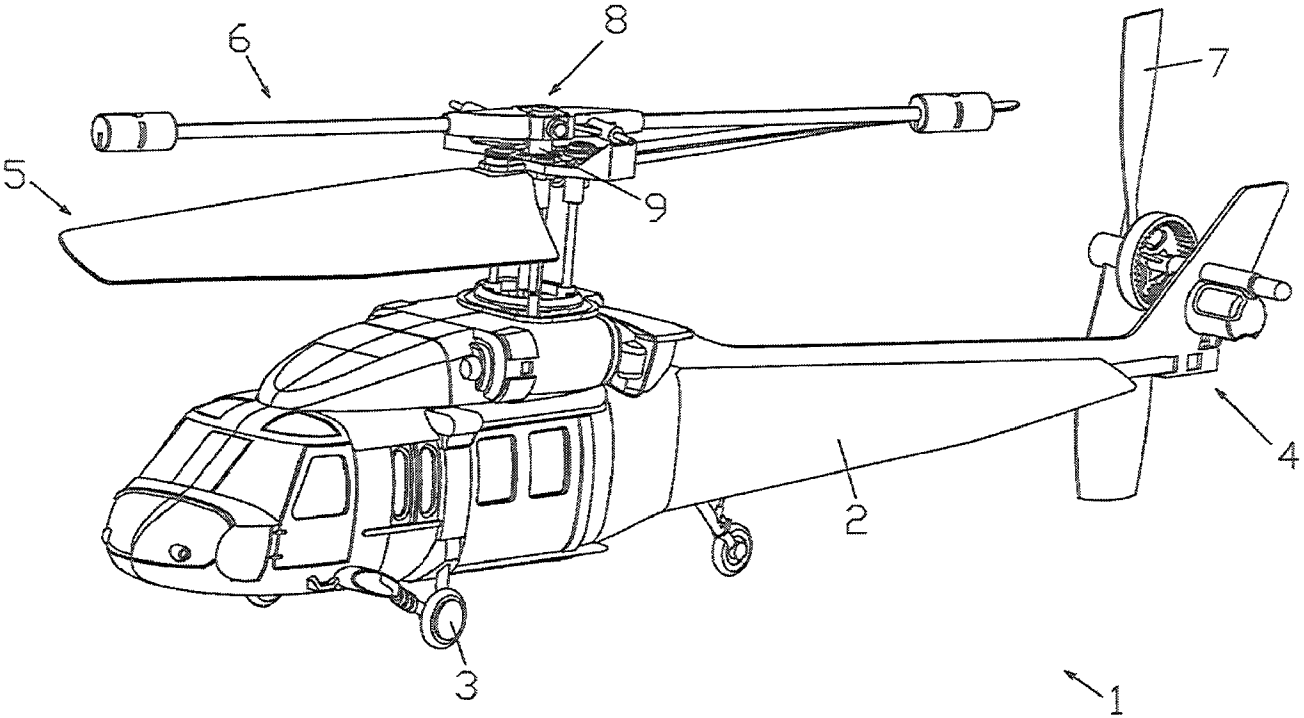

FIG. 23 shows a perspective front view of a helicopter.

Figure 24:
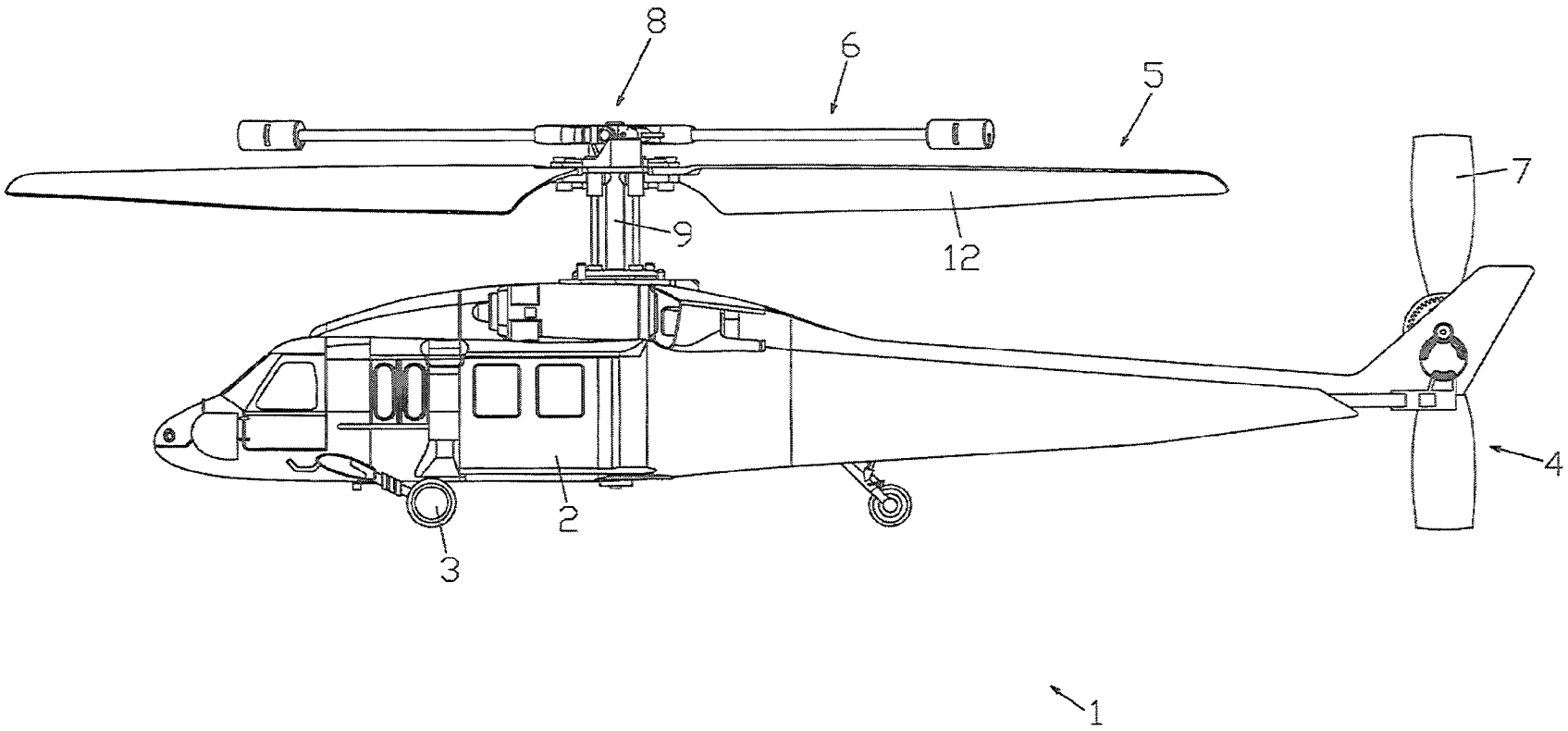

FIG. 24 shows a side view of a helicopter.

Figure 25:
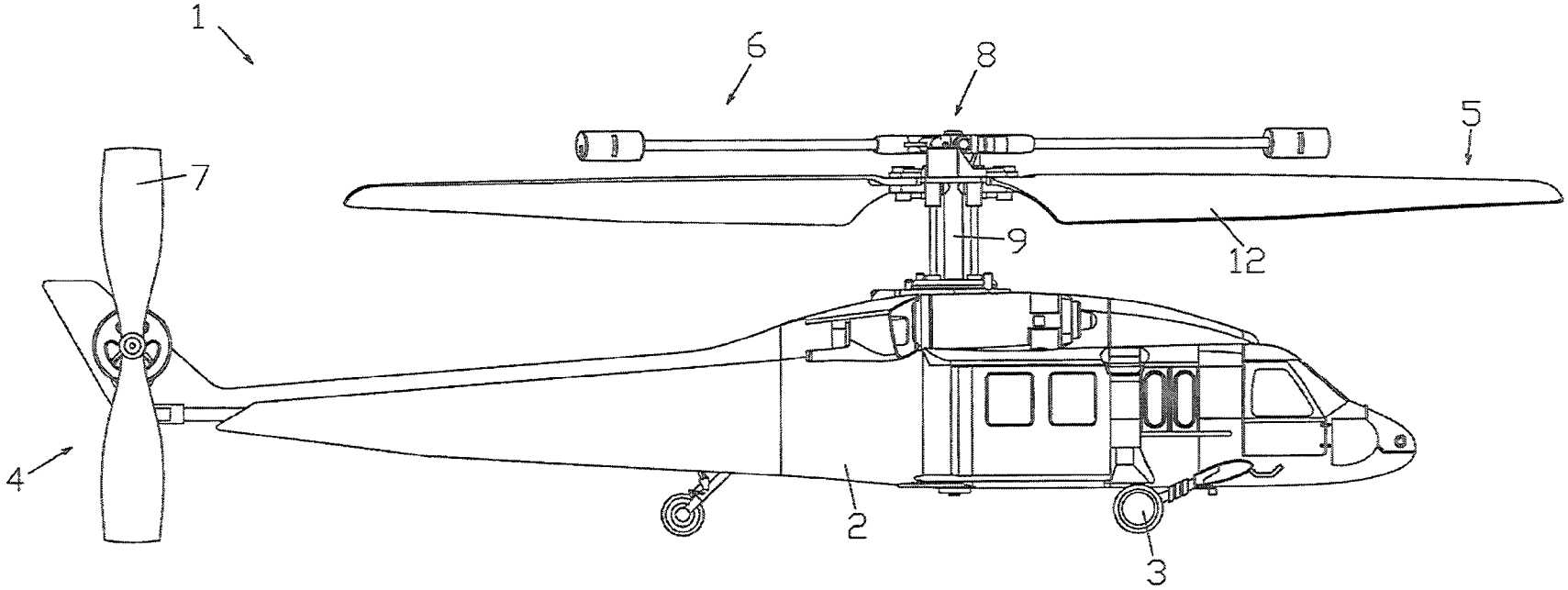

FIG. 25 shows an opposite side view of a helicopter.

Figure 26:
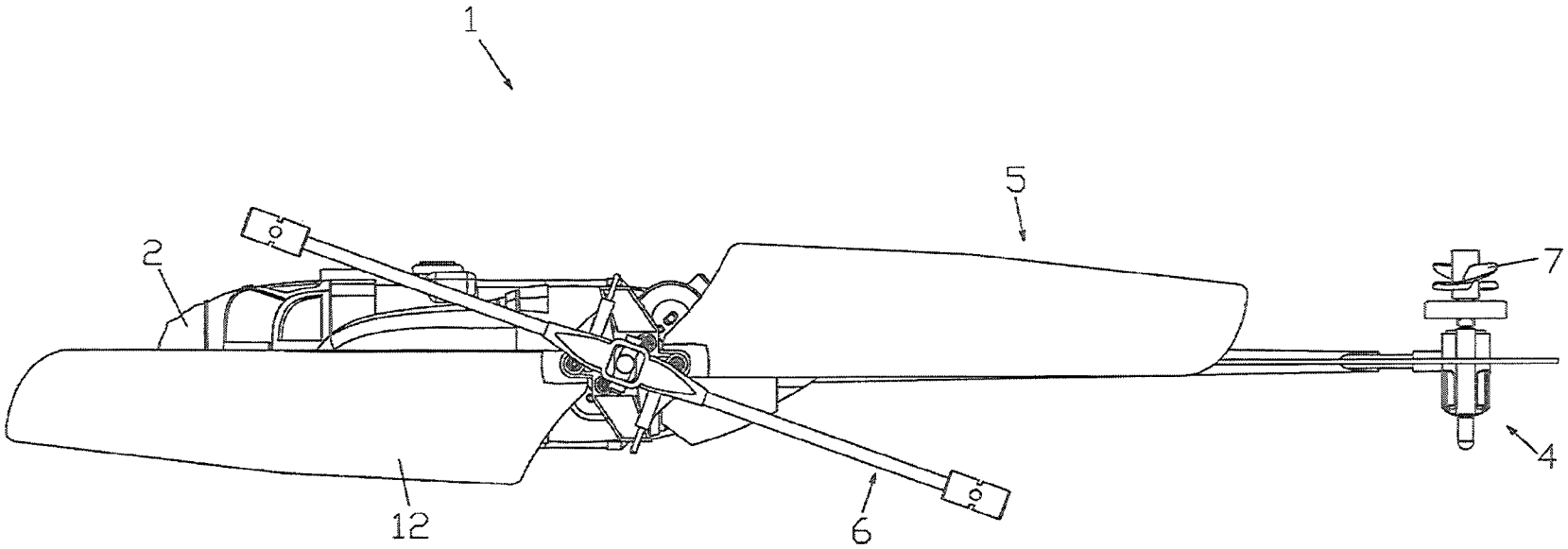

FIG. 26 shows a top view of a helicopter.

Figure 27:
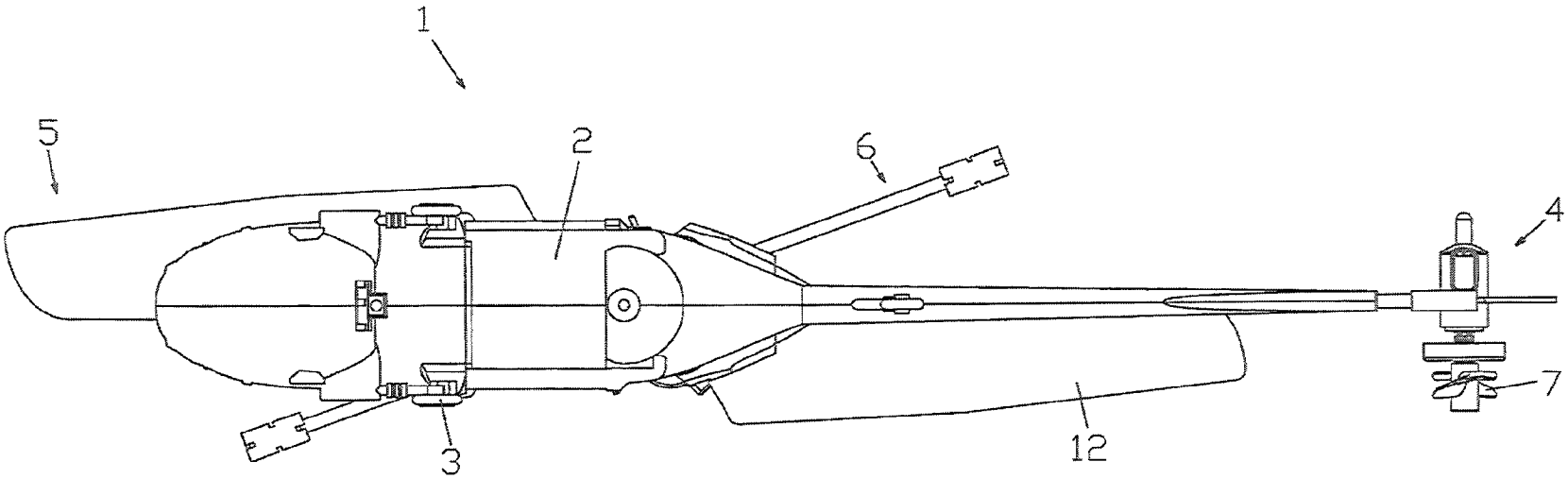

FIG. 27 shows a bottom view of a helicopter.

Figure 28:
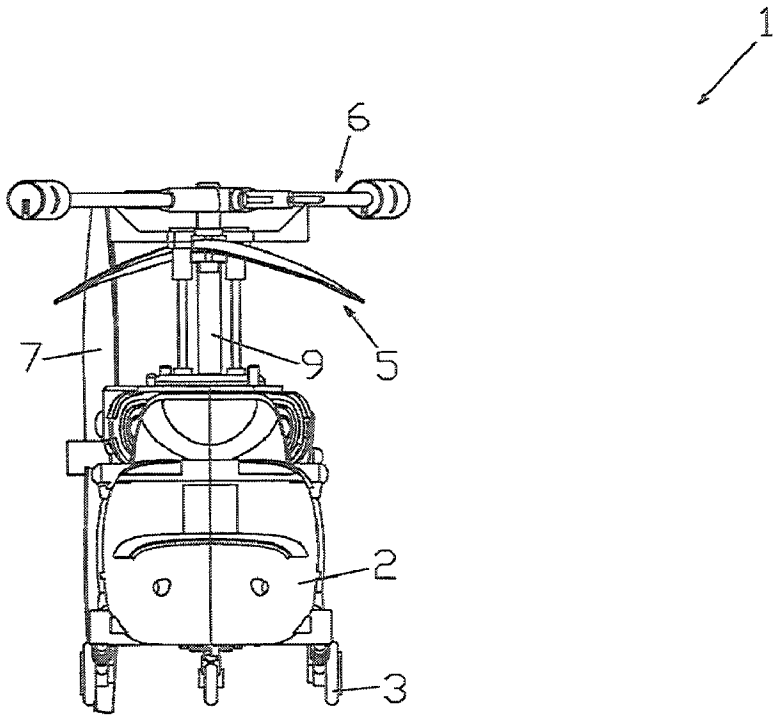

FIG. 28 shows a front view of a helicopter.

Figure 29:
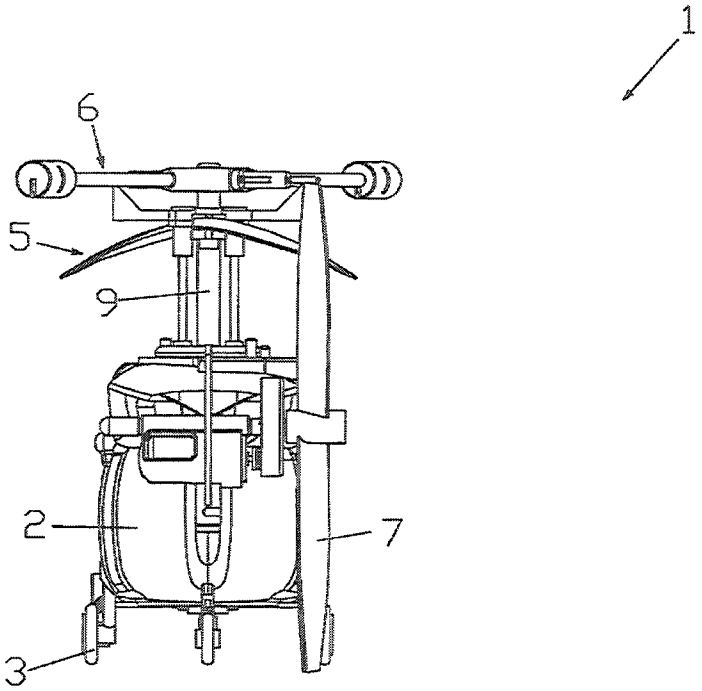

FIG. 29 shows a rear view of a helicopter.

Figure 30:
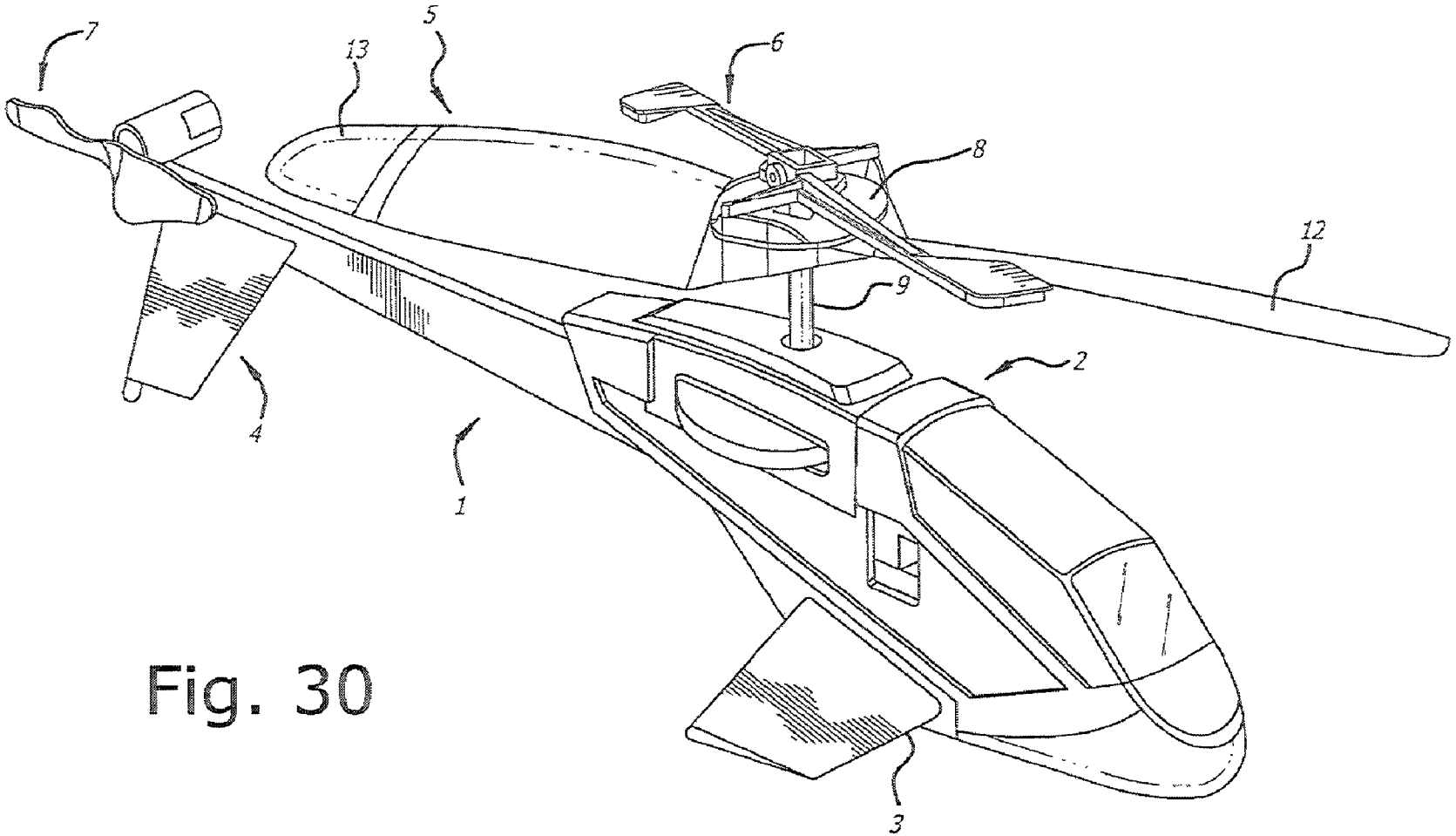
Figure 31:
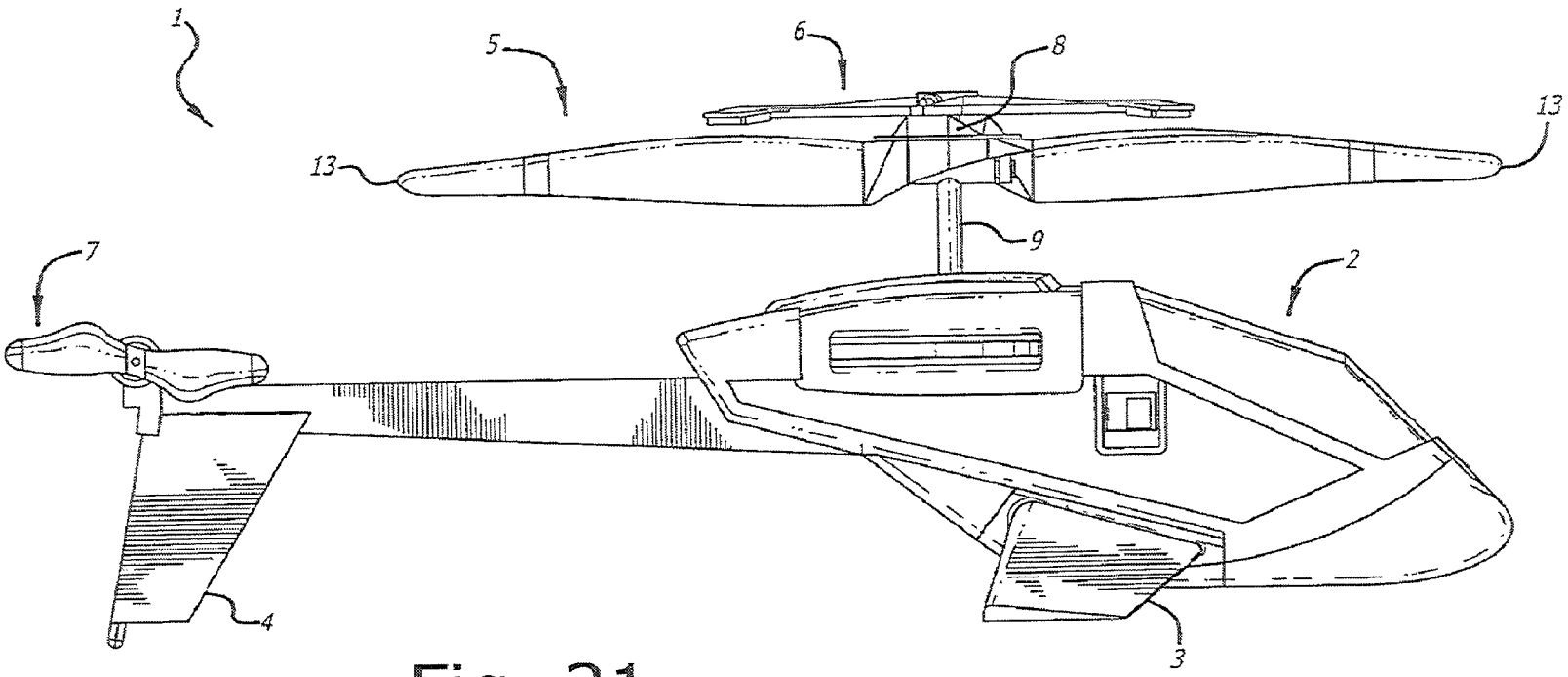
Figure 32:
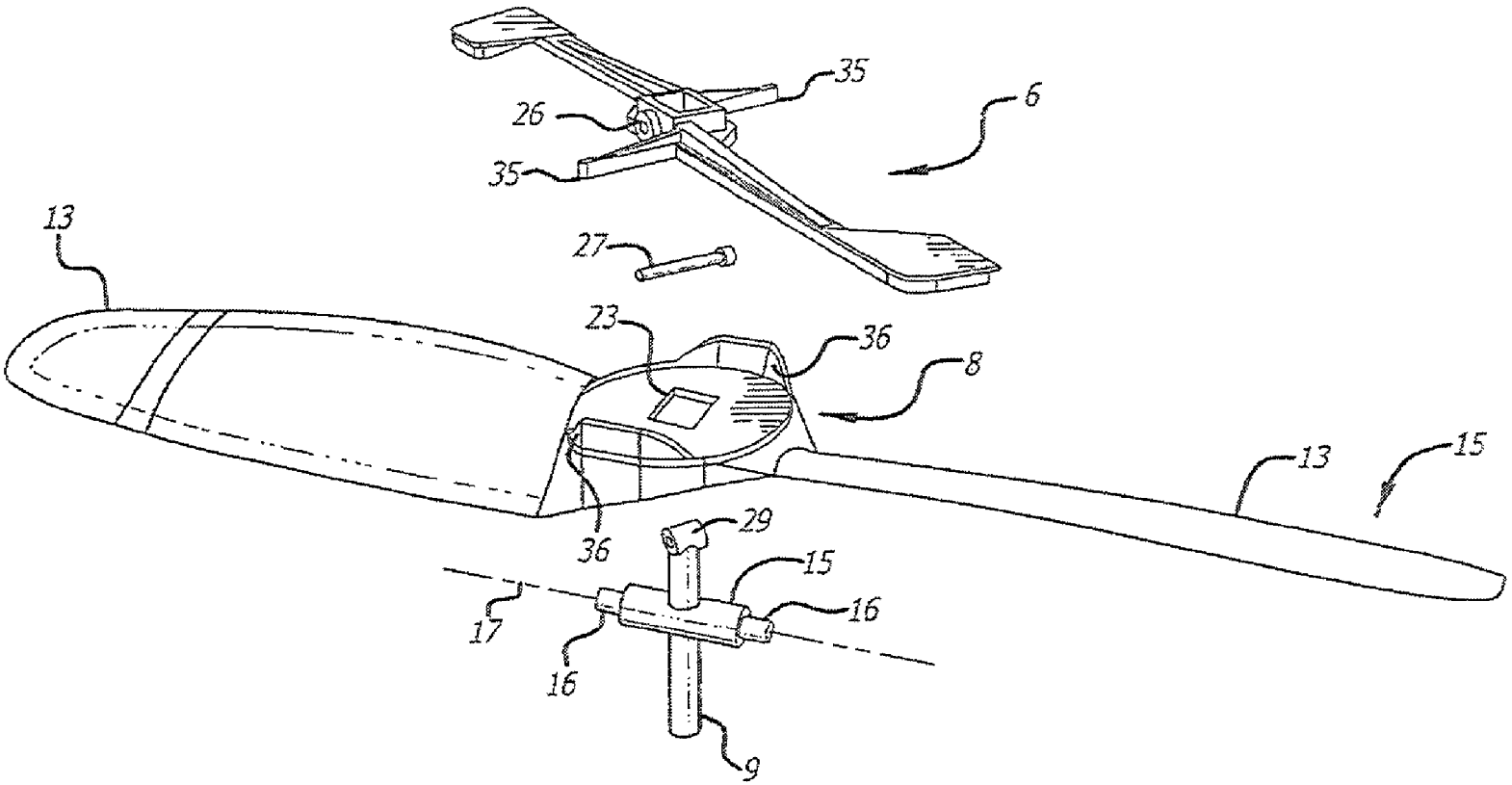
Figure 33:
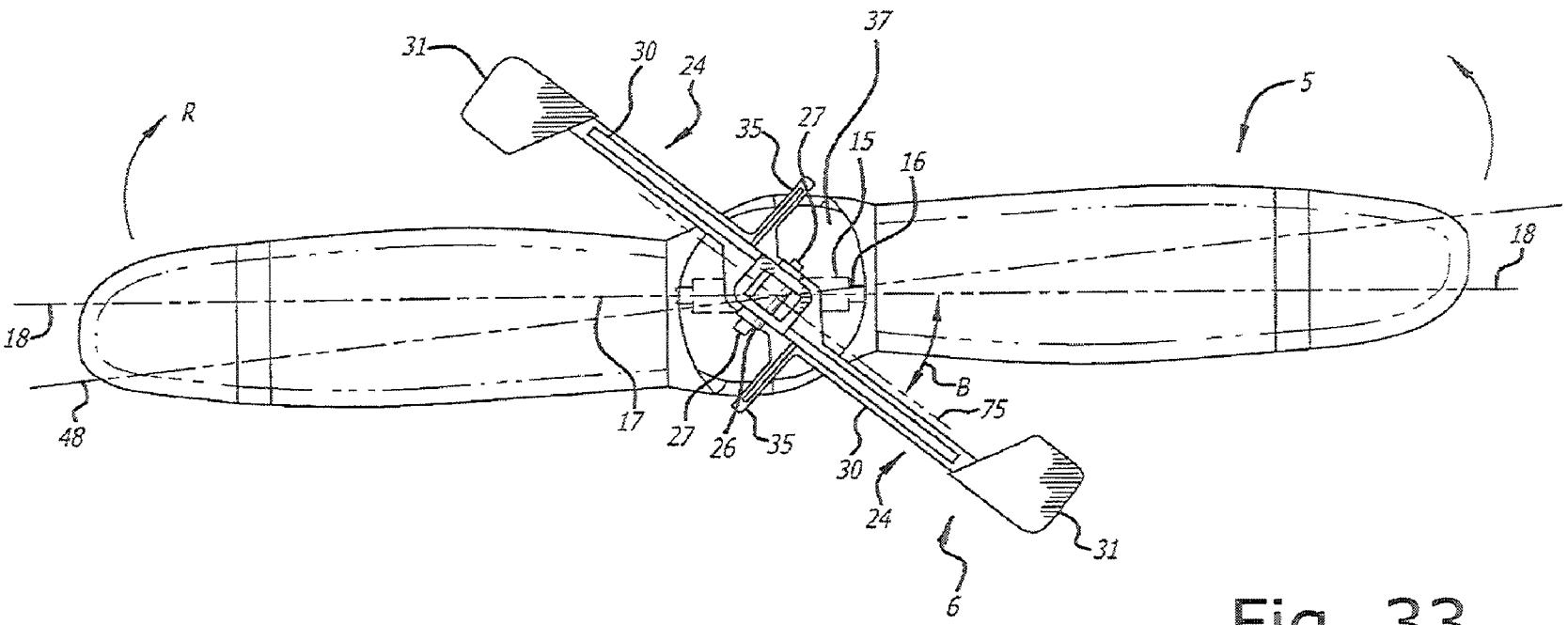
Figure 34:
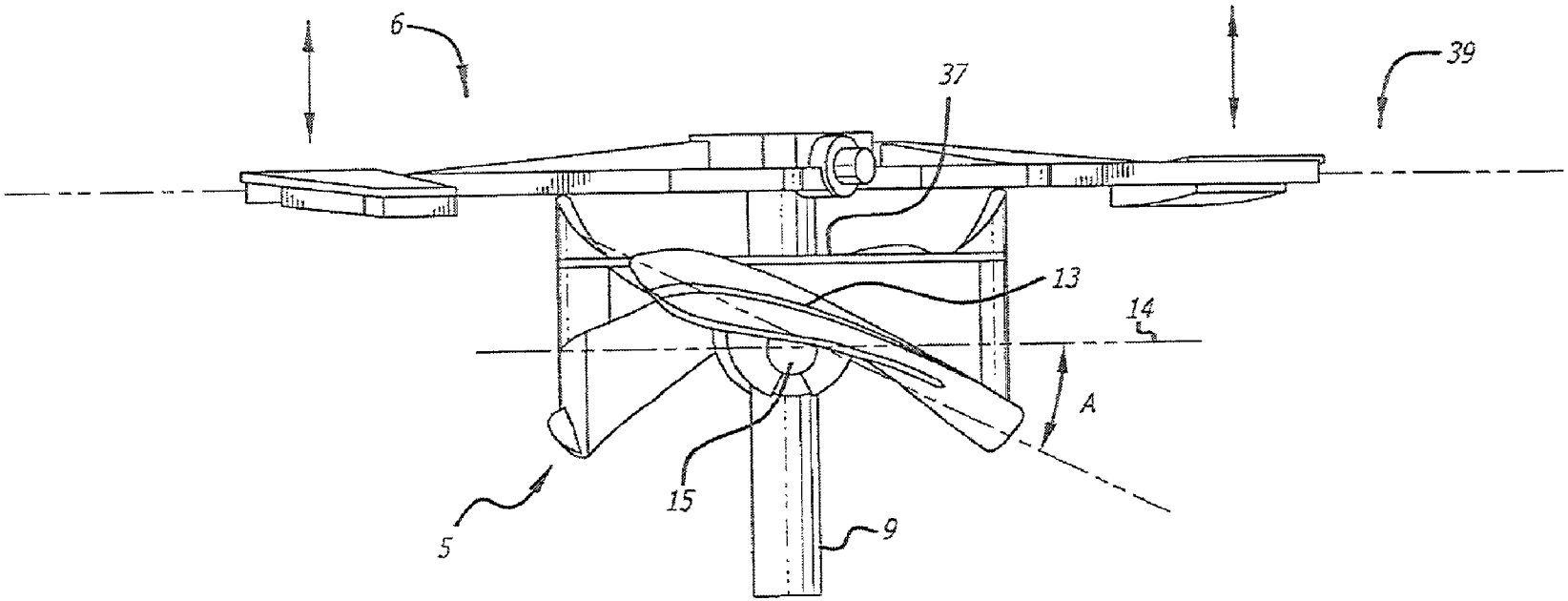
Figure 35:
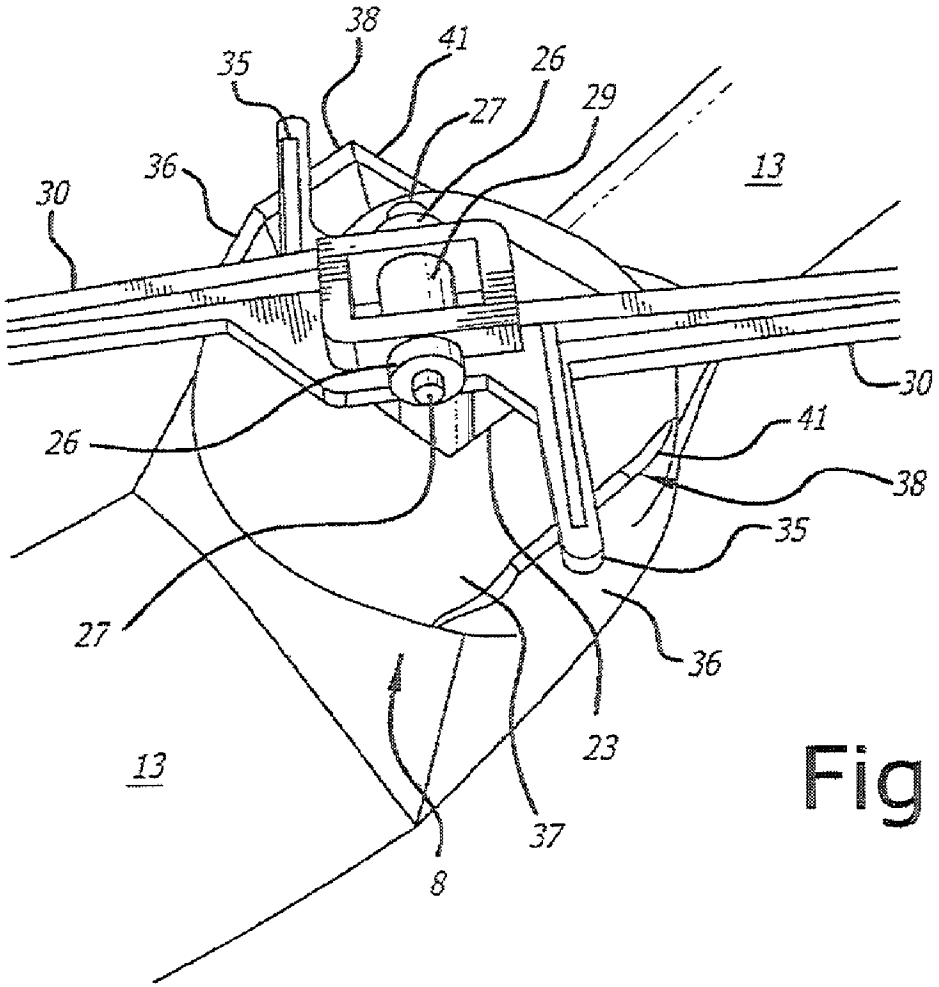
Figure 36:
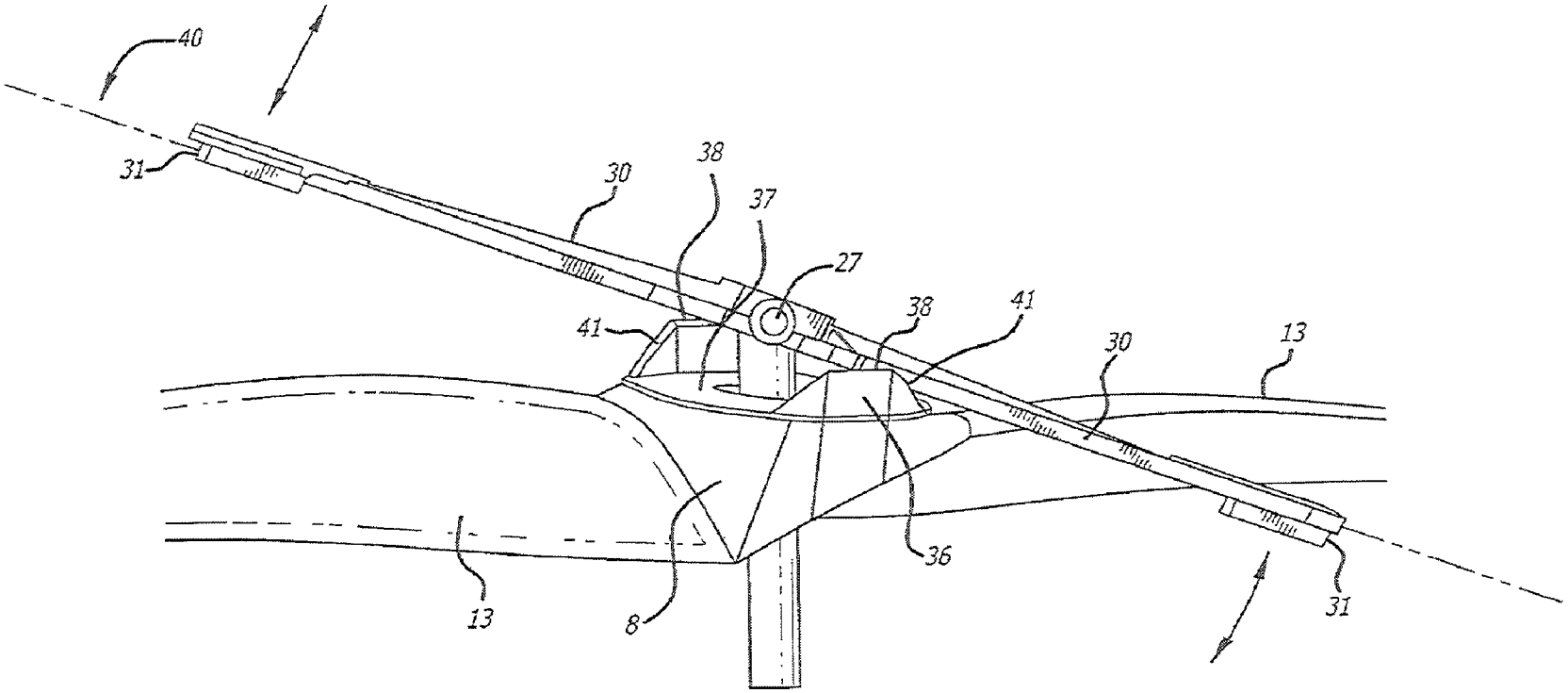
Figure 37:
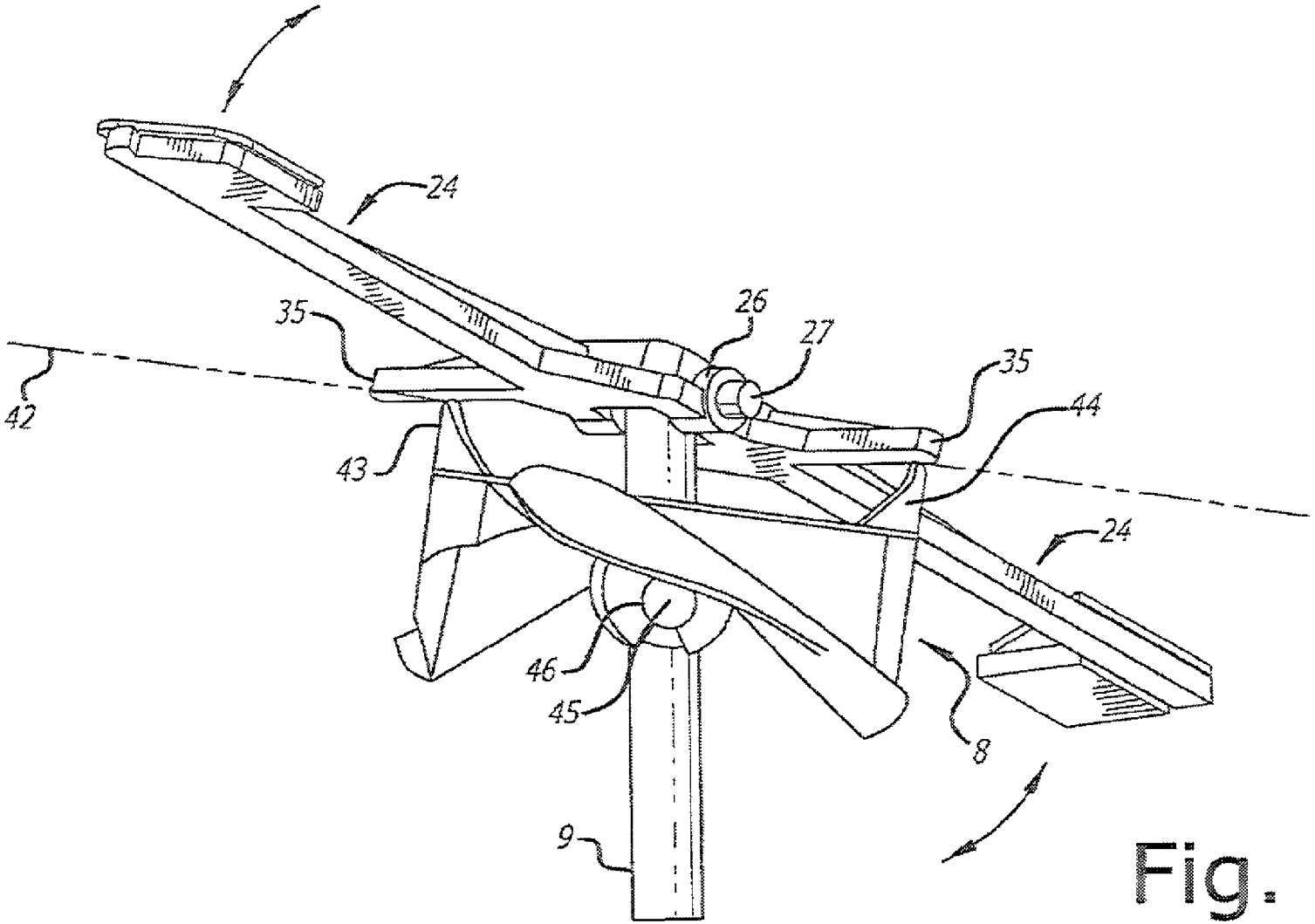
Figure 38:
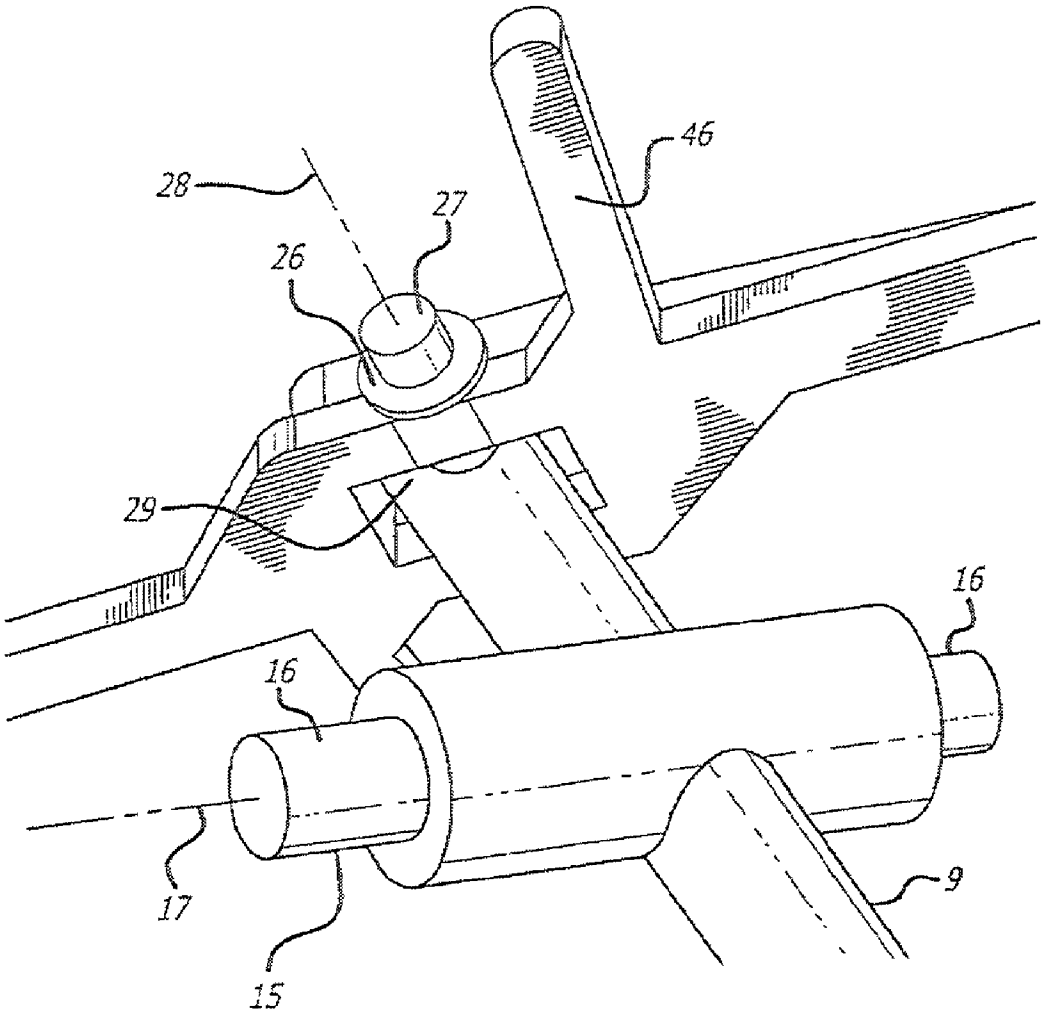
Figure 39:
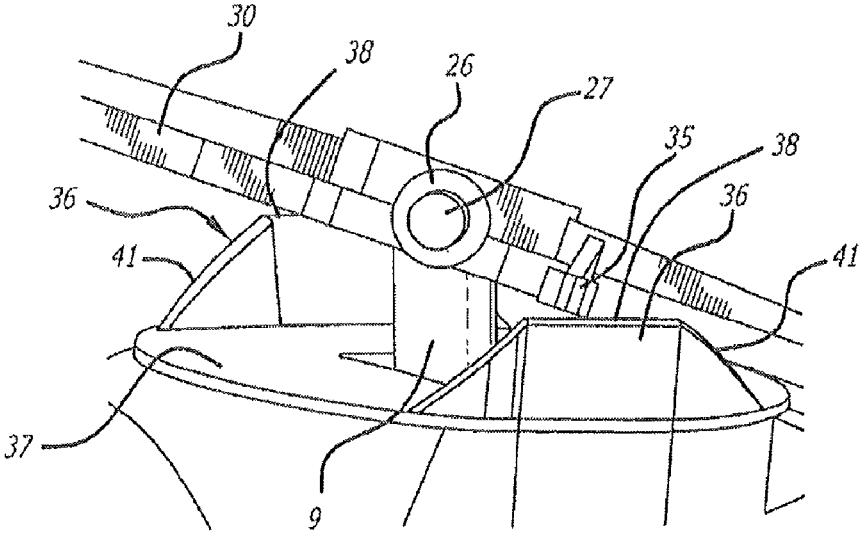
Figure 40:
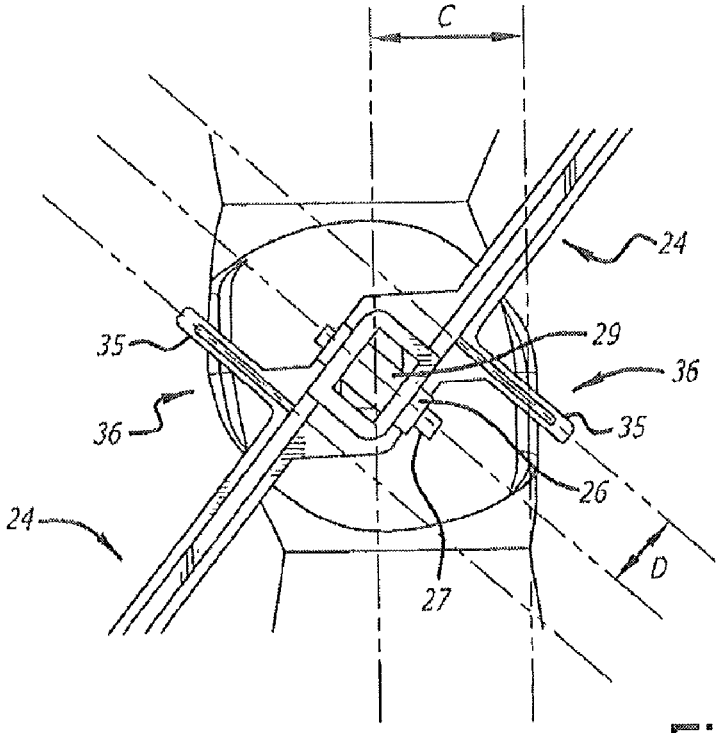
Figure 41:
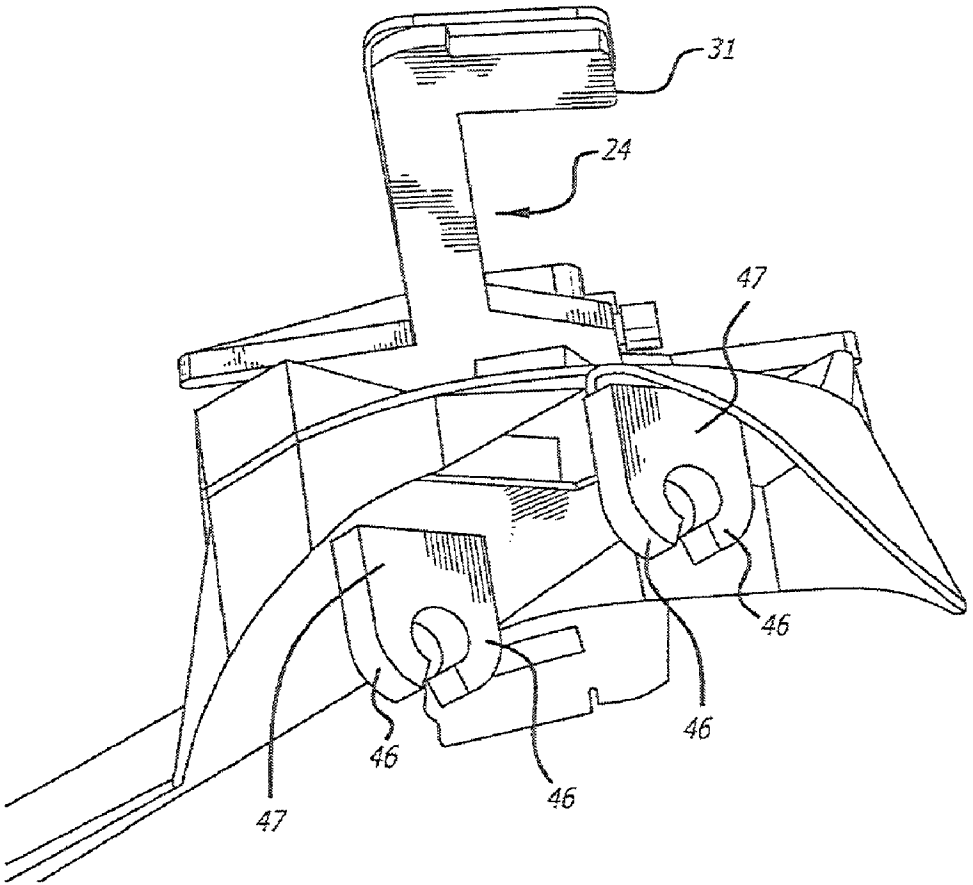
Figure 42:
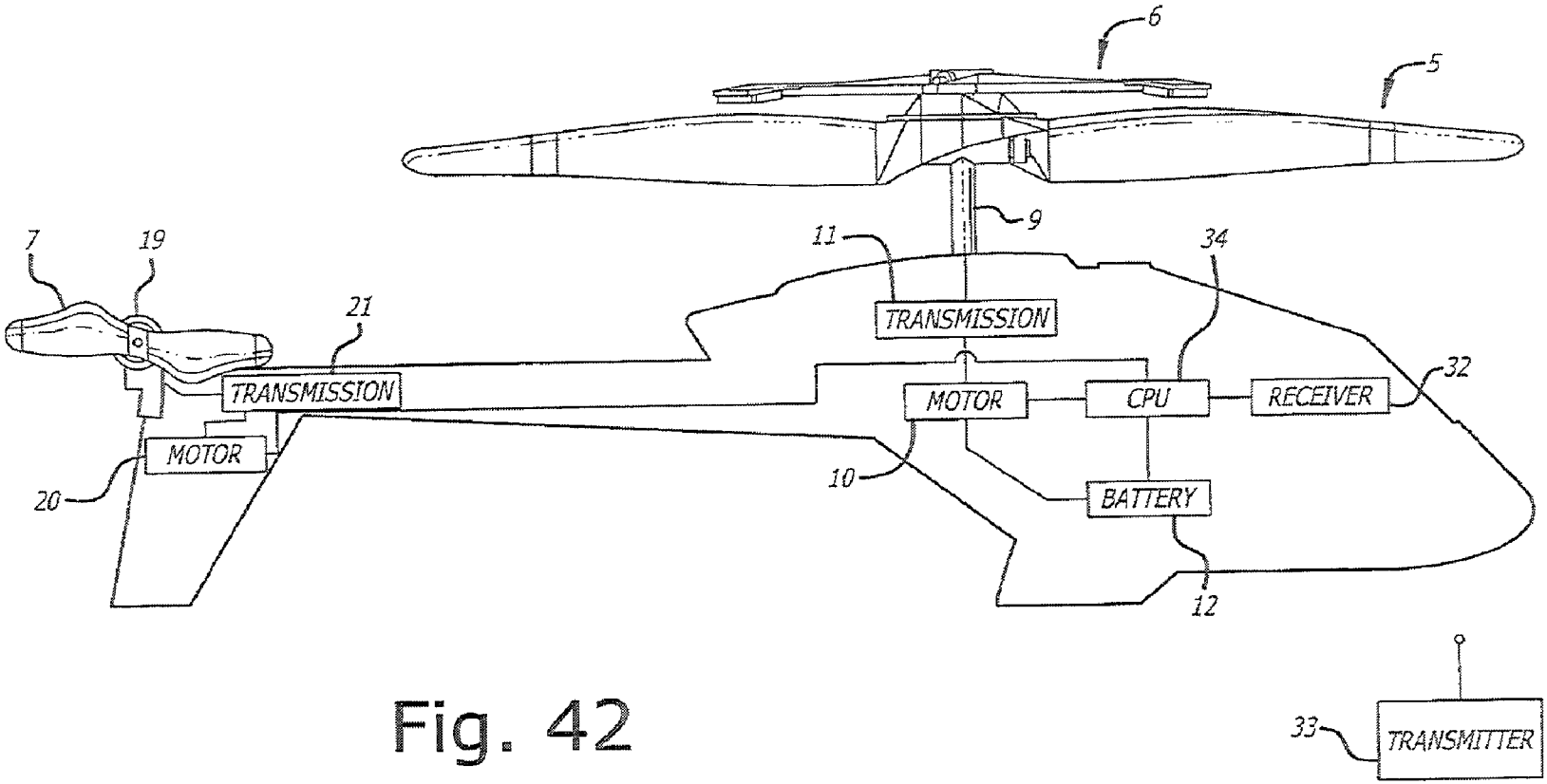

FIG. 30 represents a helicopter according to the disclosure in perspective;

FIG. 31 represents a side view of the helicopter;

FIG. 32 represents an exploded perspective view of different components of the rotor of the helicopter;

FIG. 33 represents a top view of the rotor with the blades of the main rotor and the auxiliary rotor being in a first position;

FIG. 34 represents a side view of the rotor with the blades of the main rotor and the auxiliary rotor being in a first position;

FIG. 35 represents a detailed partial perspective top view of the rotor with the blades of the main rotor and the auxiliary rotor being in a first position;

FIG. 36 represents a side view of the rotor with the blades of the main rotor and the auxiliary rotor being in a second position relative to the first position shown in FIG. 34;

FIG. 37 represents a different side view relative to FIG. 36 of the rotor with the blades of the main rotor and the auxiliary rotor;

FIG. 38 represents a detailed partial view showing the rotor shaft and the two spindles, one for anchoring the main rotor and the other for anchoring the auxiliary rotor relative to the shaft;

FIG. 39 represents a detailed partial perspective side view showing the inter engaging of the auxiliary rotor levers with the cam;

FIG. 40 represents a detailed partial top view of the arrangement illustrated in FIG. 39 showing the inter engaging of the auxiliary rotor levers;

FIG. 41 represents a detailed partial perspective side under view showing the supports for permitting engaging of the housing of the cam and main rotor with the spindle from the rotor shaft;

FIG. 42 represents a side view of the helicopter showing the drive and communication components.

Figure 43A:
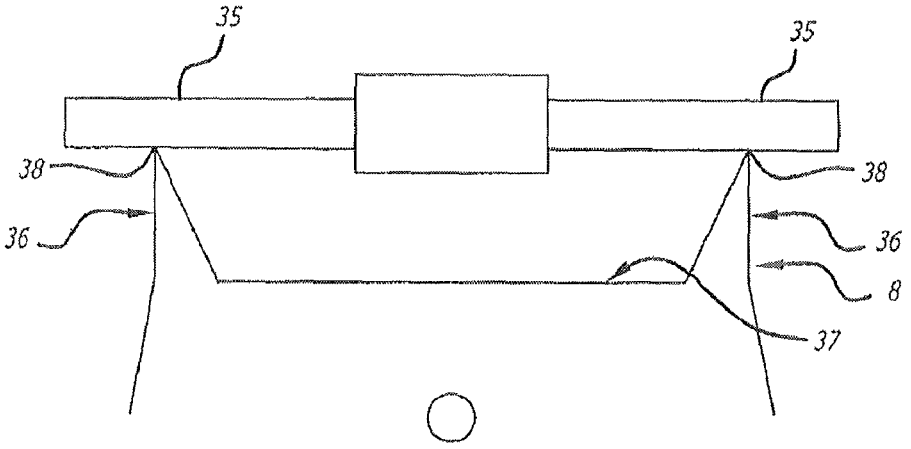

FIG. 43A represents a side diagrammatic view of the auxiliary rotor resting on raised surfaces of the cam on the head.

Figure 43B:
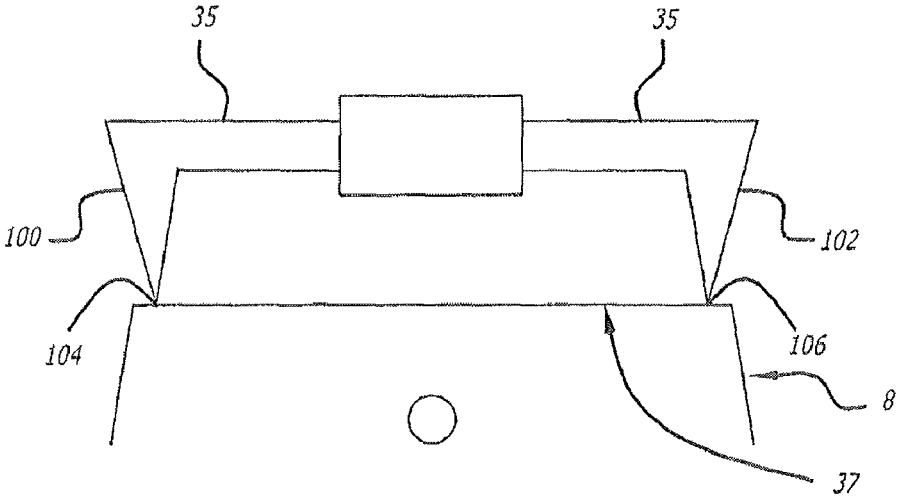

FIG. 43B represents a side diagrammatic view of the auxiliary rotor resting on the flat surface of the head, and where the auxiliary rotor has transverse projecting portions for engaging that head.

Figure 44:
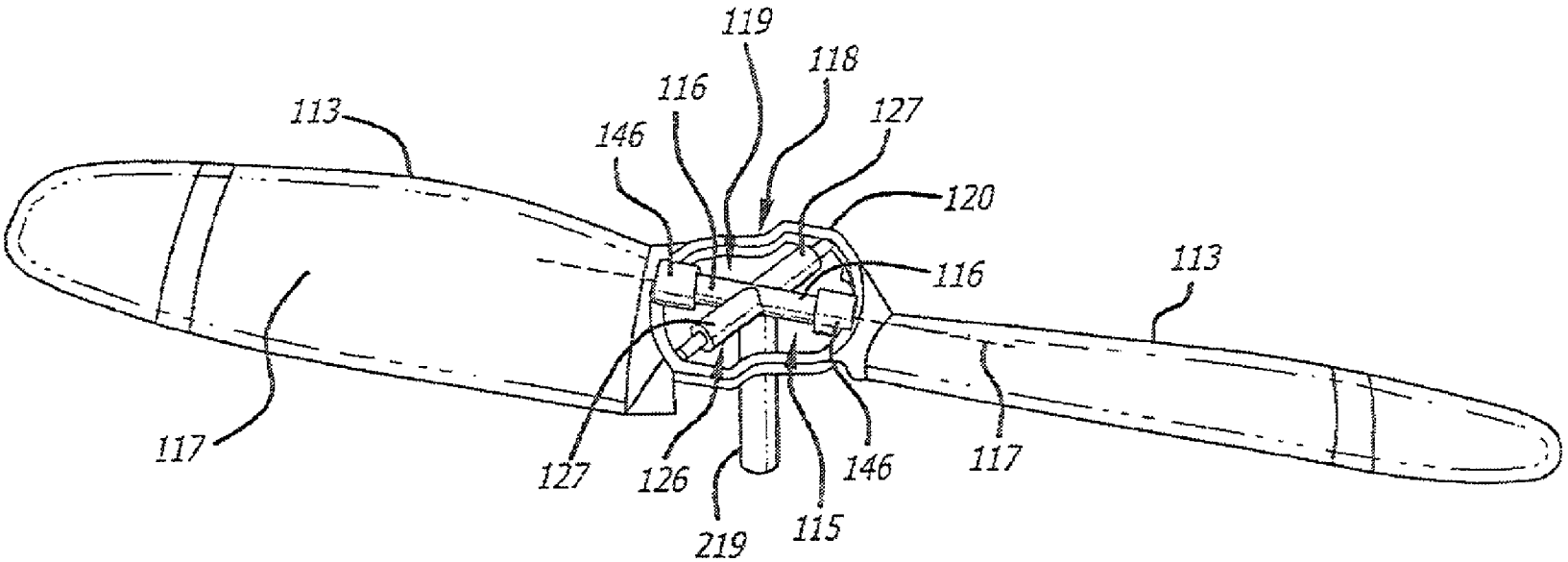

FIG. 44 represents an alternative configuration of the top perspective view of the rotor with the blades of the main rotor with a portion of the spindle for the auxiliary rotor.

Figure 45:
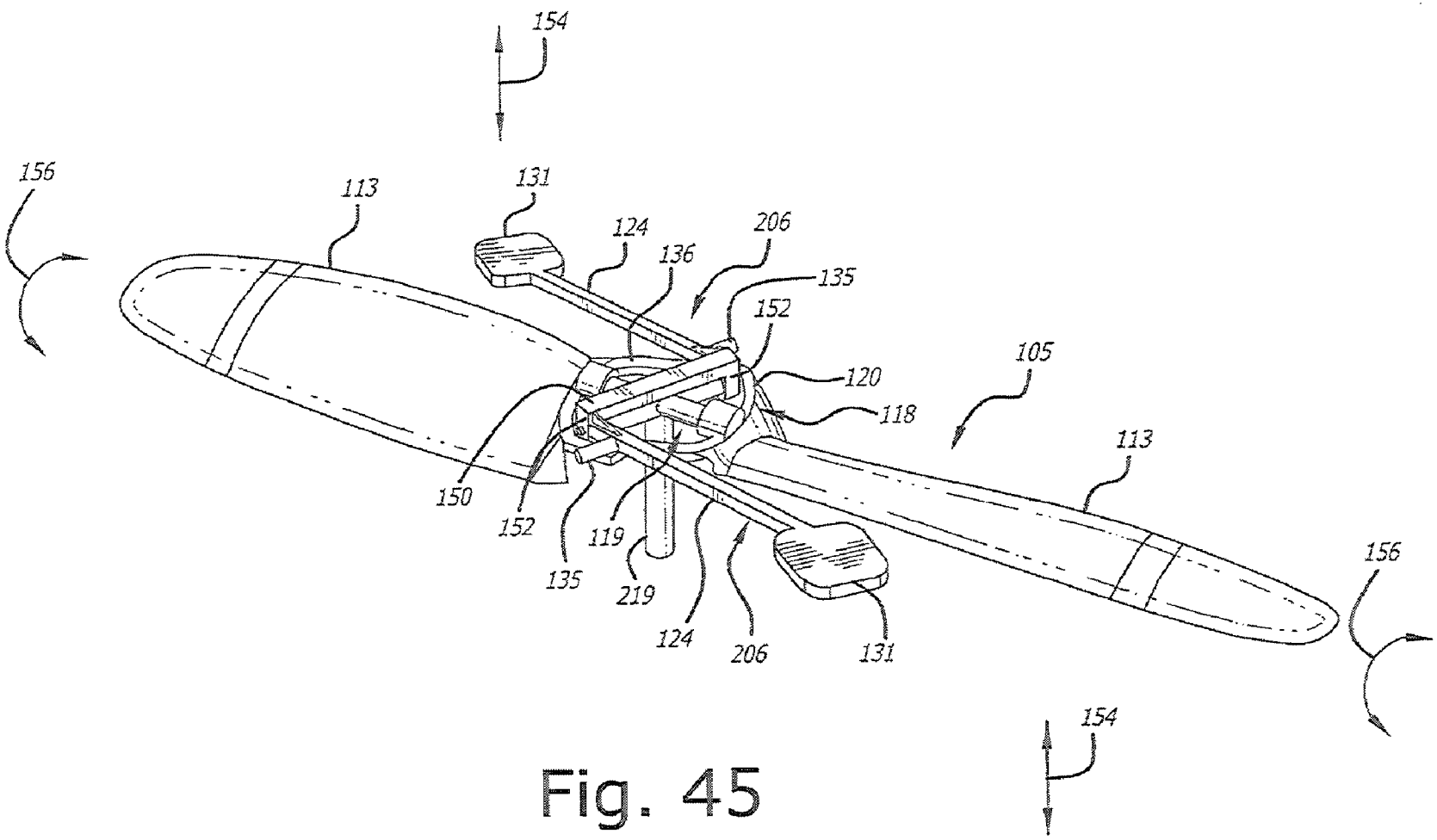

FIG. 45 represents an alternative configuration of the top perspective view of the rotor with the blades of the main rotor and the auxiliary rotor engaged with the spindle for the auxiliary rotor.

Figure 46:
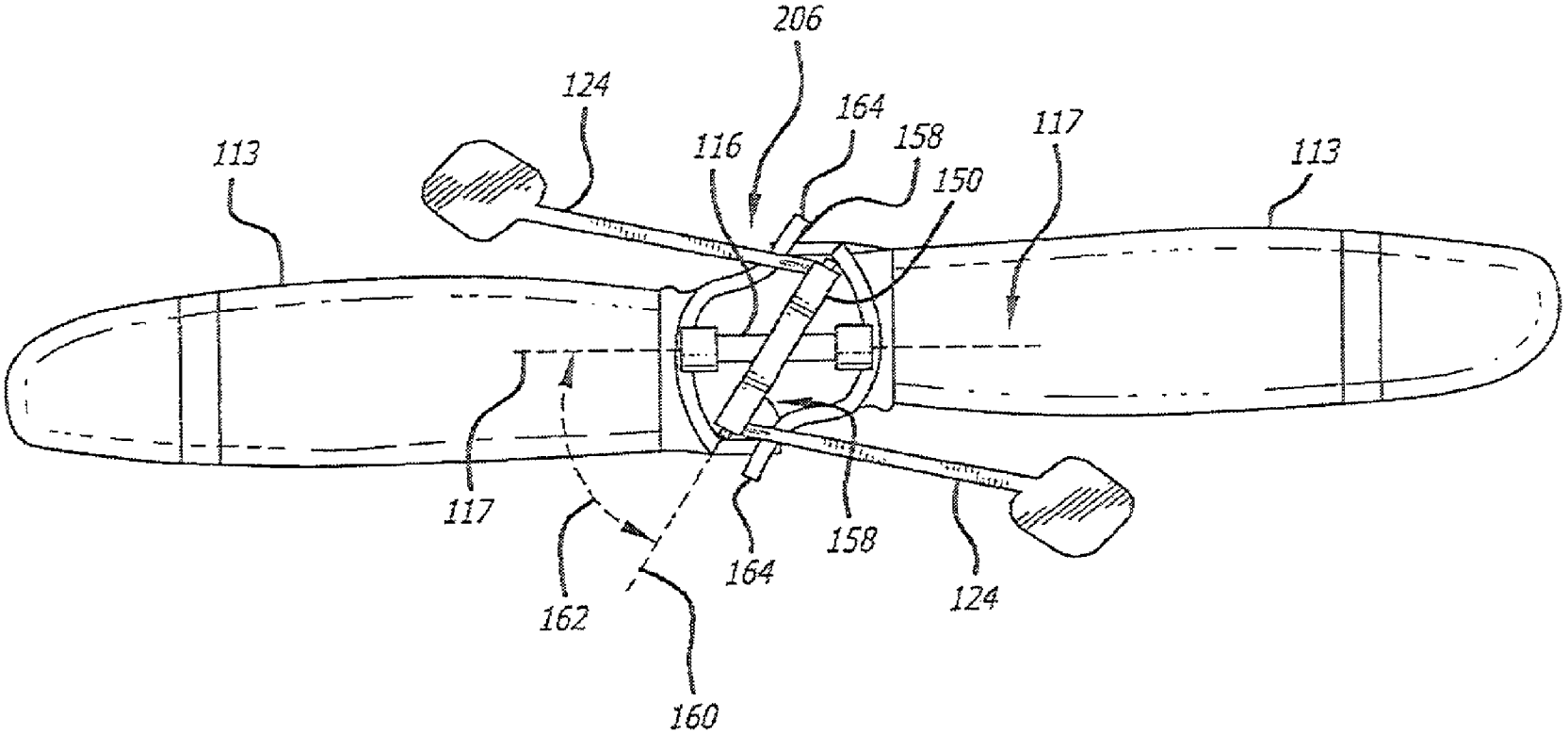

FIG. 46 represents an alternative configuration with a top view of the rotor with the blades of the main rotor and the auxiliary rotor being in a first position.

Figure 47:
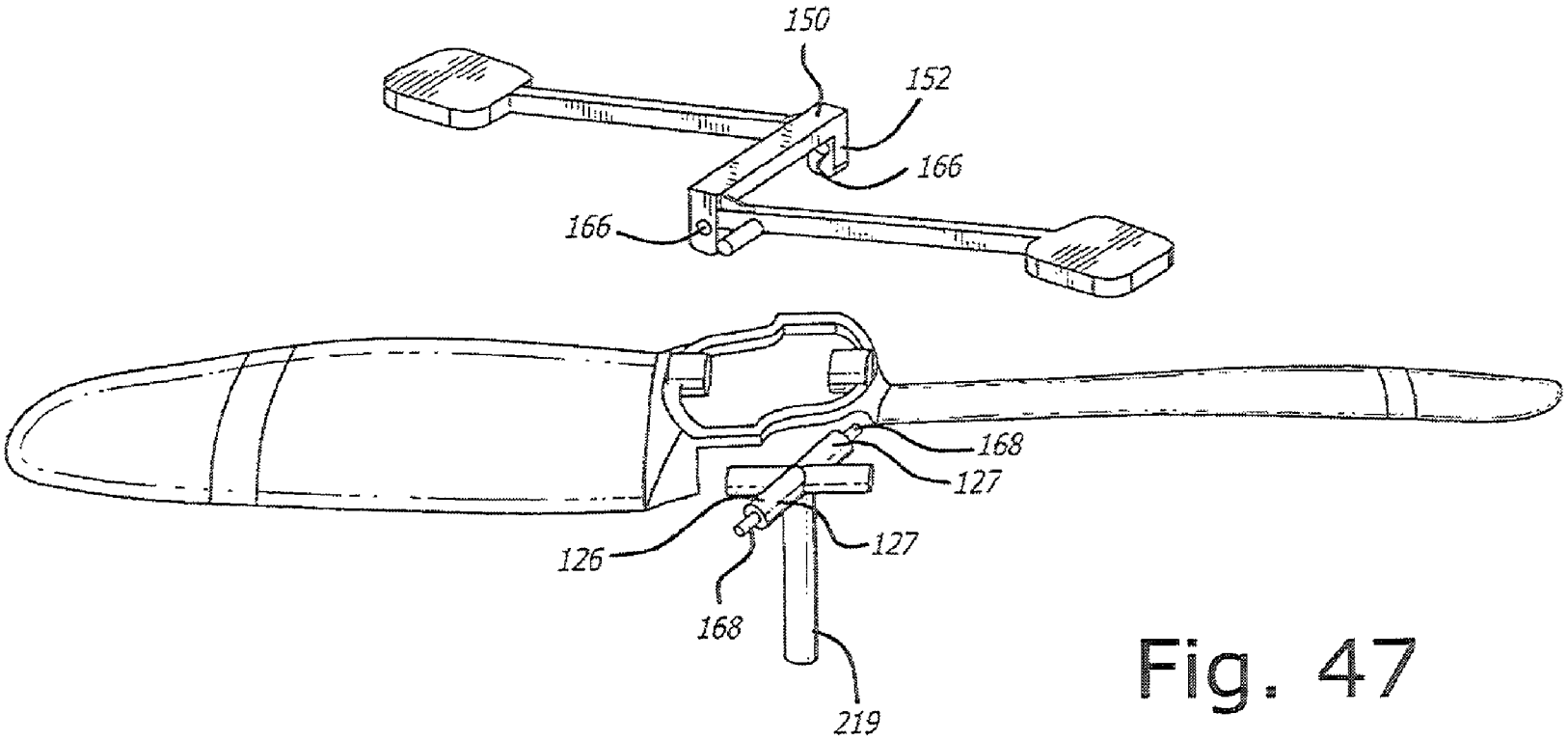

FIG. 47 represents an alternative configuration of an exploded perspective view of different components of the rotor of the helicopter.

Figure 48:
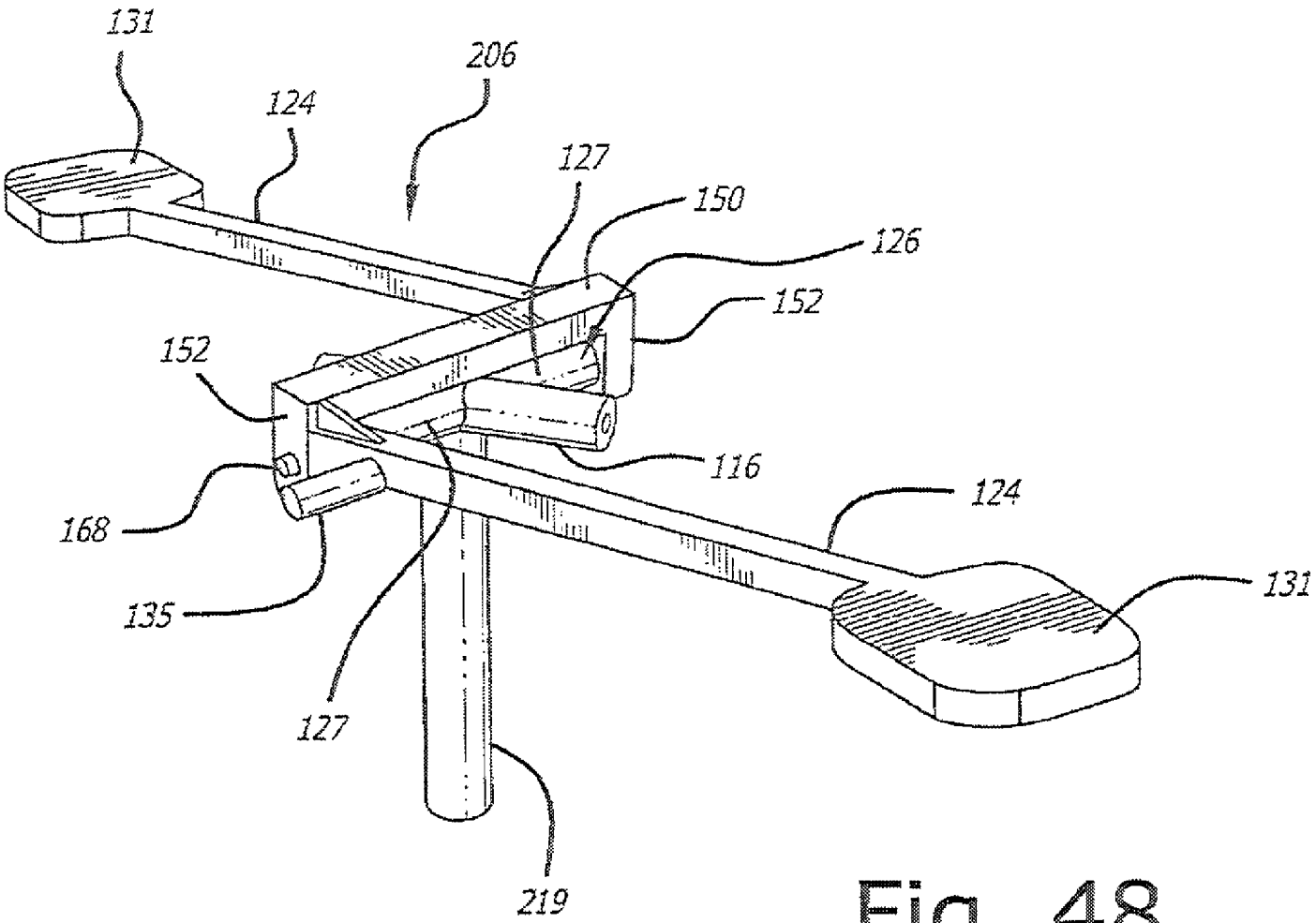

FIG. 48 represents an alternative configuration of a perspective view of an auxiliary rotor of the helicopter.

DETAILED DESCRIPTION

The following embodiments of an improved helicopter according to the disclosure are given as an example only, without being limitative in any way, with reference to the accompanying drawings.

In different formats, the system is a multi-control or a multi-channel system for controlling the helicopter in different essentially horizontal directions.

The system includes a rotor, preferably complemented with a stabilizer rotor. There is a control ring attached to the main rotor, and an actuator device connected with the helicopter body structure. The control ring is generally centered around the vertical rotor shaft, and moves with the rotor when tilted around the feather axis.

In other situations the disclosure is concerned with a rotor without a stabilizer.

The control includes an actuator for engaging with an assembly depending from the rotor. The inter-engagement of the actuator and assembly effects a change in the angle of incidence of at least one blade of the rotor.

The interaction occurs when the assembly is aligned with the actuator. There can be multiple actuators, the multiple actuators being spaced circumferentially around the rotor shaft thereby to interact with the assembly at different circumferential positions relative to the rotor shaft. The interaction occurs when selected actuators are aligned with selected locations of the assembly, for instance where the actuator engages the ring.

The actuator includes an arm movable between a position of repose and a position of inter-engagement with the assembly and wherein the degree of movement of the arm effects the degree of interaction with the assembly and the degree of change of angle of inclination of the at least one blade. The length of the arm relative to the length of the assembly from the location of anchoring the rotor to the shaft can effect the degree of interaction with the assembly and the degree of change of angle of inclination of the at least one blade. Furthermore, the size of the force exercised by the arm on the assembly can effect the degree of interaction with the assembly and the degree of change of angle of inclination of the at least one blade.

The stability of the helicopter system preferably continues to operate together with the applied control when the control is applied. The degree to which the control system is dominant over the stability system data determines the rate of change in position in the horizontal.

The actuator includes an arm movable between a position of repose and a position of inter-engagement with the assembly, the assembly including a ring transversally located about and movable with the rotor shaft, and the actuator is located at a fixed location on the body.

The control is applied thereby to cause the blade to turn on the feather axis of the rotor blade, the control being effectively applied to the blade when an actuator is cyclically aligned relative to the blade thereby to effect the turning, preferably, only about the feather axis. This causes the incidence of at least one blade to vary cyclically.

The control is applied thereby to cause the blade to turn on the feather axis of the blade, the control being effectively applied selectively to the blade through a system to operate the control thereby to effect the angle of incidence of the blade periodically or at selected times, or at selected angles in the 360 degree rotation determined essentially by the position of the actuator on the body. There is selective interactive force or movement thereby to selectively change the blade angle of incidence in requisite response to the control.

The control selectively changes the blade angle of incidence in requisite response to the control, and periodically or at selected times, or at selected angles in the 360 degree rotation determined essentially by the position of the actuator on the body. This permit the blade angle to be responsive to forces unrelated to the control.

The helicopter is preferably provided with an auxiliary stabilizer rotor which is driven by the shaft of the main rotor and which is provided with two elongated members extending essentially in line with their longitudinal axis. The 'longitudinal' axis is seen in the sense of rotation of the main rotor, and is essentially parallel to the longitudinal axis of at least one of the rotor blades of the main rotor or is located within a relatively small acute angle with the latter blade axis. This auxiliary stabilizer rotor is provided in a swinging manner on an oscillatory shaft which is provided essentially transversal to the rotor shaft of the main rotor. This is directed essentially transverse to the longitudinal axis of the elongated members. The main rotor and the auxiliary rotor are operate with each other through a physical engagement, which can be a cam and follower system or a mechanical link, such that the swinging motions of the auxiliary rotor controls the angle of incidence of at least one of the rotor blades of the main rotor. The cam can be a ball like shape at an end of a follower that touches and engages a flat surface. Thus, the cam and follower system can have many different shapes and take many different forms.

The helicopter should meet the following requirements to a greater or lesser degree:

(a) it can return to a stable hovering position, in case of an unwanted disturbance of the flight conditions. Such disturbance may occur in the form of a gust of wind, turbulences, a mechanical load change of the body or the rotors, a change of position of the body as a result of an adjustment to the cyclic variation of the pitch or angle of incidence of the rotor blades of the main rotor or a steering of the tail rotor or the like with a similar effect; and (b) the time required to return to the stable position should be relatively short and the movement of the helicopter should be relatively small.

A helicopter comprises a body, a main rotor with blades which is driven by a rotor shaft and which is hinge mounted on this rotor shaft such that the angle between the plane of rotation of the main rotor and the rotor shaft may vary.

There is a control for moving the angle of incidence of at least one blade of the rotor relative to the angle of incidence of another blade of the rotor cyclically along at least part of a 360 degree rotation path around the rotor shaft, causing a variation in lift force of the blade along at least part of the rotation path and thereby cause the body to be urged in a relatively horizontal direction from a relative position of rest.

The control has a control element movable in a first direction such that the control acts to move the angle of incidence in a first direction. The control element is movable in a second direction opposite to the first direction such that the control acts to move the angle of incidence in a second direction opposite to the first direction.

The control element includes an actuator for engaging with a slider element for engagement with an assembly depending from the rotor. The inter-engagement of the actuator and slider element in either of the two directions effects a change in the assembly, and the angle of incidence of at least the one blade of the rotor. There can be other positions with at least one of the actuator being non-interfering with slider, the rotor, or with the control assembly being in a position of rest relative to the actuator, or there being no command from the actuator to interact with the slider.

There can be multiple actuators and multiple sliders. The multiple actuators and multiple sliders are spaced circumferentially around the rotor shaft thereby to interact with the assembly at different circumferential positions relative to the rotor shaft. The interaction occurs when selected actuators are aligned with selected location of the assembly.

The actuator includes an arm movable between a position of repose and a position of inter-engagement with the slider. The degree of movement of and the force exercised by the arm effects the degree of interaction with the slider and in turn the slider with the assembly and the degree of change of angle of inclination of the at least one blade.

The actuator includes an arm movable between a position of repose and a position of inter-engagement with the slider. The length of the arm relative to the length of the assembly from the location of anchoring the rotor to the shaft effects the degree of interaction with the slider and the degree of change of angle of inclination of the at least one blade.

The actuator includes an arm movable between a position of repose and a position of inter-engagement with the slider. The assembly includes a ring transversally located about and movable with the rotor shaft, and the actuator or multiple actuators are located at a fixed location on the body.

The helicopter comprises a body with a front end and a rear end, and a longitudinal axis between the ends. There is a main rotor with blades which is driven by a rotor shaft and which is hinge mounted on this rotor shaft. The angle between the plane of rotation of the main rotor and the rotor shaft may vary. A tail rotor is driven by a second rotor shaft directed transversally to the longitudinal axis. An auxiliary rotor is driven by the rotor shaft of the main rotor and provided with two rotor elements extending essentially in a line with their longitudinal axis in the sense of rotation of the main rotor is essentially parallel to the longitudinal axis of at least one of the rotor blades of the main rotor or is at a relatively small acute angle relative to the axis.

The auxiliary rotor is mounted in a swinging relationship on an oscillatory shaft which is provided essentially transversally to the rotor shaft of the main rotor and is directed essentially transversally to the longitudinal axis of the rotor elements.

The main rotor and the auxiliary rotor are mechanically reactive with each other, such that the swinging motion of the auxiliary rotor controls the angle of incidence of at least one of the rotor blades of the main rotor.

A control moves the angle of incidence of at least one blade of the rotor cyclically along at least part of a 360 degree rotation path around a rotor shaft, causing a variation in lift force of the blade along the rotational path and thereby cause the body to be urged in a relatively horizontal direction from a relative position of horizontal rest, the relative position of horizontal rest being a relatively hovering position above a ground level.

The control has a control element being movable in a first direction such that the control acts to move the angle of incidence in a first direction, and control element being movable in a second direction opposite to the first direction such that the control acts to move the angle of incidence in a second direction opposite to the first direction.

Where there are multiple controls located at different locations of the rotor shaft for moving the angle of incidence of at least one blade of the rotor cyclically along at least part of a 360 degree rotation path around the rotor shaft, causing a variation in a lift force of the blade along at least part of the rotations path and thereby cause the body to be urged in a relatively horizontal direction from a relative position of rest.

The multiple controls are located to move multiple respective intermediate members, and the intermediate members in turn reacting with an assembly from the main rotor. The multiple controls are respective sliders, and the sliders are mounted relatively on top of each other, and being adapted to slide in a reciprocating manner transversely relative to the rotor shaft. each slider is reactive with a respective actuator, and wherein each slider includes a pair of spaced pins, the pins being for reacting respectively oppositely with an assembly depending from the rotor.

To this end, the disclosure concerns an improved helicopter including a body having a front end and a rear end. At the rear end there is a tail. There is a main rotor with blades which are driven by a rotor shaft and which are related to the rotor shaft for instance by means of a hinge, joint, or some friction fit. The angle between the surface of rotation of the main rotor and the rotor shaft may vary. A tail rotor at the rear end is driven by a second rotor shaft which is directed transversal to the rotor shaft of the main rotor, and/or transverse to the main longitudinal axis running through the helicopter from the front end to the rear end.

In practice, it appears that such an improved helicopter is more stable and stabilizes itself relatively quickly with or without a restricted intervention of the user.

The main rotor with blades is driven by a rotor shaft on which the blades are mounted. The auxiliary rotor is driven by the rotor shaft of the main rotor and is provided with elongated members from the rotor shaft in the sense of rotation of the main rotor.

The auxiliary rotor is mounted in a swinging relationship on an oscillatory shaft and the swinging motion is relatively upwardly and downwardly about the auxiliary shaft. The auxiliary shaft is provided essentially transverse to the rotor shaft of the main rotor. The main rotor and the auxiliary stabilizer rotor are connected to each other by an engagement system such as a cam and follower arrangement or a mechanical link, such that the swinging motion of the auxiliary rotor controls the angle of incidence of at least one of the rotor blades of the main rotor.

The angle of incidence of the rotor in the plane of rotation of the rotor and the rotor shaft may vary; and an auxiliary rotor rotatable with the rotor shaft is for relative oscillating movement about the auxiliary rotor hinge. Different relative positions are such that the auxiliary rotor causes the angle of incidence of the main rotor to be different.

First Embodiment

The helicopter 1 represented in FIGS. 1-2, and 23-31 by way of example is a remote-controlled helicopter which essentially consists of a body 2 with a landing gear 3 and a tail 4; a main rotor 5; an auxiliary rotor 6 driven synchronously with the latter and a tail rotor 7.

The main rotor 5 is provided by means of what is called a rotor head 8 on a first upward directed rotor shaft 9 which is bearing-mounted in the body 2 of the helicopter 1 in a rotating manner and which is driven by means of a motor 9 and a transmission 10, whereby the motor 9 is for example an electric motor which is powered by a battery 11.

The main rotor 5 in this case has two blades 12 which are in line or practically in line, but which may just as well be composed of a larger number of blades 12.

The tilt or angle of incidence A of the rotor blades 12, in other words the angle A which forms the rotor blades 12 with the plane of rotation 14 of the main rotor 5, can be adjusted as, the main rotor 5 is hinge-mounted on this rotor shaft 9 by means of a joint, such that the angle between the plane of rotation of the main rotor 5 and the rotor shaft 9 may freely vary.

In the case of the example of a main rotor 5 with two blades 12, the joint is formed by a spindle 15 of the rotor head 8.

The axis 16 of this spindle 15 is directed transversal to the rotor shaft 9 and essentially extends in the direction of the longitudinal axis 13 of one of the rotor blades 12 and it preferably forms, an acute angle B with this longitudinal axis 13.

The tail rotor 7 is driven via a second rotor shaft 17 by means of a second motor 18 and a transmission 19. Motor 16 can be an electric motor. The helicopter 1 is also provided with an auxiliary rotor 6 which is driven substantially synchronously with the main rotor 5 by the same rotor shaft 9 and the rotor head 8.

The auxiliary rotor 6 in this case has two elongated members 28 which are essentially in line with their longitudinal axis 29, whereby the longitudinal axis 29, seen in the sense of rotation R of the main rotor 5, is essentially parallel to the longitudinal axis 13 of blades 12 of the main rotor 5 or encloses a relatively small acute angle C with the latter, so that both rotors 5 and 6 extend more or less parallel on top of one another with their blades 12 and elongated members 28.

The diameter of the auxiliary rotor 6 is preferably smaller than the diameter of the main rotor 5 as the elongated members 28 have a smaller span than the rotor blades 12, and the elongated members 28 are substantially rigidly connected to each other. This rigid whole forming the auxiliary rotor 6 is provided in a swinging manner on an oscillating shaft 30 which is fixed to the rotor head 8 of the rotor shaft 9. This is directed transversally to the longitudinal axis of the elongated members 28 and transversally to the rotor shaft 9.

The main rotor 5 and the auxiliary rotor 6 are connected to each other by a mechanical link which is such of the auxiliary rotor 6 the angle of incidence A of at least one of the rotor blades 12 of the main rotor 5. In the given example this link is formed of a rod 31.

This rod 31 is hinge-mounted to a blade 12 of the main rotor 5 with one fastening point 32 by means of a joint 33 and a lever arm 34 and with another second fastening point 35 situated at a distance from the latter, it is hinge-mounted to a elongated member 28 of the auxiliary rotor 6 by means of a second joint 36 and a second lever arm 37.

The fastening point 32 on the main rotor 5 is situated at a distance D from the axis 16 of the spindle 15 of the rotor blades 12 of the main rotor 5, whereas the other fastening point 35 on the auxiliary rotor 6 is situated at a distance E from the axis 38 of the oscillatory shaft 30 of the auxiliary rotor 6.

The distance D is preferably larger than the distance E, and about the double of this distance E, and both fastening points 32 and 35 of the rod 31 are situated, seen in the sense of rotation R on the same side of the rotor blades 12 of the main rotor 5 or of the elongated members 28 of the auxiliary rotor 6, in other words they are both situated in front of or at the back of the rotor blades 12 and elongated members 28, seen in the sense of rotation.

Also preferably, the longitudinal axis 29 of the elongated members 28 of the auxiliary rotor 6, seen in the sense of rotation R, encloses an angle F with the longitudinal axis 13 of the rotor blades 12 of the main rotor 5, which enclosed angle F is in the order, of magnitude of about 10°, whereby the longitudinal axis 29 of the elongated members 28 leads the longitudinal axis 13 of the rotor blades 12, seen in the sense of rotation R. Different angles in a range of, for example, 5° to 45° could also be in order.

The auxiliary rotor 6 is provided with two stabilizing weights 39 which are each fixed to an elongated member 28 at a distance from the rotor shaft 9.

Further, the helicopter 1 is provided with a receiver, so that it can be controlled from a distance by means of a remote control which is not represented.

As a function of the type of helicopter, it is possible to search for the most appropriate values and relations of the angles B, F and G by experiment; the relation between the distances D and E; the size of the weights 39 and the relation of the diameters between the main rotor 5 and the auxiliary rotor 6 so as to guarantee a maximum auto stability.

The operation of the improved helicopter 1 according to the disclosure is as follows:

In flight, the rotors 5, 6 and 7 are driven at a certain speed, as a result of which a relative air stream is created in relation to the rotors, as a result of which the main rotor 5 generates an upward force so as to make the helicopter 1 rise or descend or maintain it at a certain height, and the tail rotor 7 develops a laterally directed force which is used to steer the helicopter 1.

It is impossible for the main rotor 5 to adjust itself, and it will turn in the plane 14 in which it has been started, usually the horizontal plane. Under the influence of gyroscopic precession, turbulence and other factors, it will take up an arbitrary undesired position if it is not controlled.

The surface of rotation of the auxiliary rotor 6 may take up another inclination in relation to the surface of rotation 14 of the main rotor 5, whereby both rotors 5 and 6 may take up another inclination in relation to the rotor shaft 9.

This difference in inclination may originate in any internal or external force or disturbance whatsoever.

In a situation whereby the helicopter 1 is hovering stable, on a spot in the air without any disturbing internal or external forces, the auxiliary rotor 6 keeps turning in a plane which is essentially perpendicular to the rotor shaft 9.

If, however, the body 2 is pushed out of balance due to any disturbance whatsoever, and the rotor shaft 9 turns away from its position of equilibrium, the auxiliary rotor 6 does not immediately follow this movement, since the auxiliary rotor 6 can freely move round the oscillatory shaft 30.

The main rotor 5 and the auxiliary rotor 6 are placed in relation to each other in such a manner that a swinging motion of the auxiliary rotor 6 is translated almost immediately in the pitch or angle of incidence A of the rotor blades 12 being adjusted.

For a two-bladed main rotor 5, this means that the rotor blades 12 and the elongated members 28 of both rotors 5 and 6 must be essentially parallel or, seen in the sense of rotation R, enclose an acute angle with one another of for example 10° to 45° in the case of a large main rotor 5 and a smaller auxiliary rotor 6.

This angle can be calculated or determined by experiment for any helicopter 1 or per type of helicopter.

If the axis of rotation 8 takes up another inclination than the one which corresponds to the above-mentioned position of equilibrium in a situation whereby the helicopter 1 is hovering, the following happens.

A first effect is that the auxiliary rotor 6 will first try to preserve its absolute inclination, as a result of which the relative inclination of the surface of rotation of the auxiliary rotor 6 in relation to the rotor shaft 9 changes.

As a result, the rod 31 will adjust the angle of incidence A of the rotor blades 12, so that the upward force of the rotor blades 12 will increase on one side of the main rotor 5 and will decrease on the diametrically opposed side of this main rotor 5.

Since the relative position of the main rotor 5 and the auxiliary rotor 6 are selected such that a relatively immediate effect is obtained. This change in the upward force makes sure that the rotor shaft 9 and the body 21 are forced back into their original position of equilibrium.

A second effect is that, since the distance between the far ends of the elongated members 28 and the plane of rotation 14 of the main rotor 5 is no longer equal and since also the elongated members 28 cause an upward force, a larger pressure is created between the main rotor 5 and the auxiliary rotor 6 on one side of the main rotor 5 than on the diametrically opposed side.

A third effect plays a role when the helicopter begins to tilt over to the front, to the back or laterally due to a disturbance. Just as in the case of a pendulum, the helicopter will be inclined to go back to its original situation. This pendulum effect does not generate any destabilizing gyroscopic forces as with the known helicopters that are equipped with a stabilizer bar directed transversally to the rotor blades 12 of the main rotor 5. It acts to reinforce the first and the second effect.

The effects have different origins but have analogous natures. They reinforce each other so as to automatically correct the position of equilibrium of the helicopter 1 without any intervention of a pilot.

The tail rotor 7 is located in a swinging manner and provides for an additional stabilization and makes it possible for the tail rotor 7 to assume the function of the gyroscope which is often used in existing helicopters, such as model helicopters.

In case of a disturbance, the body 2 may start to turn round the rotor shaft 9. As a result, the tail rotor 7 turns at an angle in one or other sense round the swinging shaft 21. This is due to the gyroscopic precession which acts on the rotating tail rotor 7 as a result of the rotation of the tail rotor 7 round the rotor shaft 9. The angular displacement is a function of the amplitude of the disturbance and thus of the rotation of the body 2 round the rotor shaft 9. This is measured by the sensor 27.

The signal of the sensor 27 is used by a control box of a computer to counteract the failure and to adjust the thrust of the tail rotor 7 so as to annul the angular displacement of the tail rotor 7 which is due to the disturbance.

This can be done by adjusting the speed of the tail rotor 7 and/or by adjusting the angles of incidence of the rotor blades of the tail rotor 7, depending on the type of helicopter 1.

If necessary, this aspect of the disclosure may be applied separately, just as the aspect of the auxiliary rotor 6 can be applied separately, which represents a helicopter 1 according to the, disclosure having a main rotor 5 combined with an auxiliary rotor 6, but whose tail rotor 7 is of the conventional type, i.e. whose shaft cannot turn in a swing but is bearing-mounted in relation to the tail 3.

In practice, the combination of both aspects makes it possible to produce a helicopter which is very stable in any direction and any flight situation and which is easy to control, even by persons having little or no experience.

It is clear that the main rotor 5 and the auxiliary rotor 6 must not necessarily be made as a rigid whole. The rotor blades 12 and the elongated members 28 can also be provided on the rotor head 8 such that they are mounted and can rotate relatively separately. In that case, for example, two rods 31 may be applied to connect each time one blade 12 to one elongated member 28.

It is also clear that, if necessary, the joints and hinge joints may also be realized in other ways than the ones represented, for example by means of torsion-flexible elements.

In the case of a main rotor 5 having more than two blades 12, one should preferably be sure that at least one blade 12 is essentially parallel to one of the elongated members 28 of the auxiliary rotor. The joint of the main rotor 5 is preferably made as a ball joint or as a spindle 15 which is directed essentially transversely to the axis of the oscillatory shaft 30 of the auxiliary rotor 6 and which essentially extends in the longitudinal direction of the one blade 12 concerned which is essentially parallel to the elongated members 28.

In another format, the helicopter 1 comprises a body 2 with a tail; a main rotor 5 with blades 12 which is driven by a rotor shaft 9 on which the blades 12 are mounted. A tail rotor 7 is driven by a second rotor shaft directed transversally to the rotor shaft 9 of the main rotor 5. An auxiliary rotor 6 is driven by the rotor shaft 9 of the main rotor 5 and is provided with elongated members from the rotor shaft 9 in the sense of rotation of the main rotor 5.

The auxiliary rotor 6 is mounted in a swinging relationship on an oscillatory shaft 30 and the swinging motion being relatively upwardly and downwardly about the oscillatory shaft 30. The oscillatory shaft 30 is provided essentially transverse to the rotor shaft 9 of the main rotor 5. The main rotor 5 and the auxiliary rotor 6 are connected to each other by a mechanical link, such that the swinging motion of the auxiliary rotor 6 controls the angle of incidence of at least one of the rotor blades 12 of the main rotor 5. There can be different degrees of width, varying from narrow to broader for each of the rotors, and weights can be strategically placed along the length of the auxiliary rotor 6 to achieve the right motion and effect on the main rotor 5 bearing in mind the appropriate angular relationship between the axis of the auxiliary rotor 6 and the axis of the main rotor 5 to achieve the effect and control of the angle of incidence of the main rotor 5. In some cases, the auxiliary rotor 6 can be mounted below the main rotor 5, namely between the top of the body 2 and the main rotor 5 and still achieve the right effect on the main rotor 5 angle of incidence.

The angle of incidence of the main rotor 5 in the plane of rotation of the main rotor 5 and the rotor shaft 8 may vary. An auxiliary rotor 6 rotatable with the rotor shaft 9 is for relative oscillating movement about the rotor shaft 9. Different relative positions are such that the auxiliary rotor 6 causes the angle of incidence the main rotor 5 to be different. A linkage between the main rotor 5 and auxiliary rotor 6 causes changes in the position of the auxiliary rotor 6 to translate to changes in the angle of incidence.

The rotor blades 12 of the main rotor 5 and the elongated members of the auxiliary rotor 6 respectively are connected to each other with a mechanical linkage that permits the relative movement between the blades of the rotor and the elongated members of the auxiliary rotor. A joint of the main rotor to the rotor blades is formed of a spindle which is fixed to the rotor shaft of the main rotor.

The mechanical link includes a rod hinge mounted to a elongated member of the auxiliary rotor with one fastening point and is hinge-mounted with another fastening point to the blade of the main rotor.

The body can includes wings directed transversely of a longitudinal axis of the helicopter body. The wings are 100 and 102 directed transversely and downwardly whereby the tips 104 and 106 of the wings permit for stabilizing the helicopter body when on the ground.

There is a downwardly directed stabilizer at the tail of the helicopter. There is a radio control unit for operation with the helicopter. This unit can have appropriate computerized controls for signaling the operation of the motors operating the rotors and their relative positions.

Second Embodiment

Referring to FIGS. 3*a*-11 there is a helicopter rotor that is spinning around to sustain the helicopter in flight. In this configuration there is a stabilizer auxiliary rotor 128 with a main rotor 112. There is no other control system for changing the angle of incidence of the rotor 112 to affect other control of movement in an essentially horizontal sense.

The rotor 112 and stabilizer rotor 128 are interconnected. The rotor 112 and also the stabilizer rotor 128 are independent to move around hinging lines as found in helicopter rotors. This can, for example, be a feather or a teether hinge or axis 200 and 202 respectively. The helicopter as represented is able to move up or down by changing rotor rpm, or change heading by altering tail rotor rpm. The helicopter as illustrated cannot as effectively be controlled to accelerate forward or backwards, nor sideways left or right, namely in the relatively horizontal dimensions.

In order to more effectively control a helicopter in flight, preferably essentially permanent commands are needed in those horizontal dimensions to direct the helicopter in or towards the desired direction. There is provided a control system to influence the lift force of the rotor 112 in a cyclical way, i.e., in such a way that each rotor blade half 112*a* and 112*b* varies lift along one rotation around the vertical rotor shaft 108. When the rotor halves 112*a* and 112*b* produce different lift 224 for blade 112*a* versus the other lift 226 for blade 112*b*, a torque C originates and moves the rotor 112 in the direction D of that torque. The effect of this torque is not necessarily in line with the span of the rotor and may occur later due to gyroscopic forces. The angle of incidence on the one blade 112*a* related to the plane of rotation is steeper or larger than the angle of incidence of the blade 112*b* or portion related to the plane of rotation which is relatively shallower. This effects a movement in Direction D. This can be influenced by gyroscopic forces. Each blade 112*a* and 112*b* connected to the rotor assembly sees this change cyclically along a 360-degree rotation of the rotor shaft.

The control system of the disclosure includes the following features:

a rotor 112, preferably but not essentially complemented with a stabilizer rotor 128, a control ring 204, attached to the rotor 112, and an actuator device 206, connected with the helicopter body structure represented by a base element 208. Instead of a base there can be other structures to which the ring is attached.

The control ring 204 is generally centered around the vertical rotor axis 108. The ring 204 moves with the rotor 112 when tilted around the feather axis 200. This is illustrated in some detail in FIGS. 3*a* and 3*b*, such that the tilt is shown in FIG. 3*b*.

The actuator device 206 represented includes a coil 210, a hinged magnet 212, a base 214 and a lever 216 as shown in the exploded view in FIG. 4. Depending on the voltage and current sent through the coil 210 from the power supply as controlled by the controller which is in turn controlled by a radio control unit, the lever 216 exercises a force on the control ring 204 causing changes in incidence of the feathered rotor blade 112.

The actuator device 206 could have many forms, and use different technologies. It could be an electric motor for example with a lever attached to the axis of the motor or other electromagnetic or magnetic systems can be used. Other systems can be used. There could be a piezoelectric device, ionic polymer actuators, other non-magnetic devices and other interactive and/or inter-responsive systems for causing a lever to move, or if there is no lever there could be a different configuration for having the rotor move about an axis such as the feather axis in a periodic manner.

Operation: No Command State

In the situation where the actuator 206 is not activated, there is no contact between the lever 216 and the ring 204, no matter the rotation position of the rotor 112. The rotor system behaves as if no control mechanism were present. In the case of a self-stabilizing rotor system, the helicopter will float more or less in a hovering position, depending mainly on the position of the center of gravity, as explained in the prior patent applications referred to above and also disclosed in this disclosure. FIGS. 6, 7 and 8*a* and 8*b* are illustrative.

Operation: Command State

When the actuator 206 is activated, then the lever 216 moves or rotates, and engages the control ring 204 and exercises a force on the ring 204. The size of that force depends on the size of the control signals sent by the actuator 206. The force causes a torque on the control ring assembly 204. The size of the torque transmitted to the assembly depends on the ratio between 218 and 220. The longer the relative length of 218 to 220, the more torque is transmitted. FIGS. 9*a* and 9*b* are illustrative.

This torque inclines the attached rotor 112 along the feather axis 200, which is perpendicular to the actuator force direction 222. In FIG. 9*a* this is a representative position along a 360° path of the rotor 112. One rotor half or one blade 112*a* takes a higher angle of incidence, while the opposing rotor half or blade 112*b* takes a lower angle of incidence. The lift force 224 generated by rotor half or blade 112*a* are bigger than the lift force 226 generated by rotor half or blade 112*b*.

The stabilizer or auxiliary rotor 128 follows the movement of the attached rotor 112 depending on its mechanical relationship with that rotor 112. In case of the helicopter of FIGS. 3*a* to 11, the stabilizer 128 hinges around the teether axis 202. FIGS. 10*a* and 10*b* are illustrative.

When the rotor 112 progresses in its rotation by 90 degrees, the feather axis 200 of the rotor 112 and control ring assembly 204 is now in line with the force of the actuator 206 and its lever 216. The rotor 112 cannot incline as a result of the exercised force, and the rotor 112 does not 'see' this force or torque. This is a mechanical explanation of how the control is relatively cyclical. The ring 204 is not tilted in this portion of the cycle and has zero effect.

This means that the impact from the actuator force goes from maximum to zero in a 90-degree progression of the rotor. It goes to maximum again for the next progression of 90 degrees, and again to zero for the next 90 degrees, etc. This can be essentially a sinusoidal type change of force acting on the blade or blades of the rotor.

This causes the effect of the force to vary cyclically. This is a term generally used in helicopters to indicate that the impact of the control input varies not only with the size and type of control input, but as well with the position of the blade progressing along a 360 circle around the rotor shaft. With the position of the actuator 206 with respect to the rotor axis 108 and the body fixed, the effect of the actuator force makes the helicopter go in essentially or substantially the same or similar direction. This is determined by the angle of the actuator position relative to the body and the rotor shaft 108 and the gyroscopic effects. the size of the force mostly impacts the speed and/or acceleration of the movement of the body. This is a control system to control the movement of the helicopter body.

Operation: Variations And Parameters

When the actuator position is in line with the axis of the helicopter body from nose to tail, it does not mean the helicopter moves forward with a control input. Gyroscopic forces tend to delay the effects of moving the position of spinning masses by up to 90 degrees. The exact delay depends on parameters like the masses of the spinning objects, such as for instance the rotor, and/or stabilizer, and the aerodynamic forces, the angle between the rotor feather axis and the rotor centerline, the type of rotor hinges ('rigid' or 'soft') etc. The preferred positioning of the actuator for the desired effect is effectively determined, as a function of the desired direction of movement.

FIG. 11 shows how two actuators 206*a* and 206*b* are used to exercise force independently on the control ring. As such, and in case these actuators 206*a* and 206*b* are disposed 90 degrees one versus the other and commanded by two independent signals, two-dimensional horizontal movement can be initiated. When four actuators are installed, one every 90 degrees relative to each other, a fuller directional control in the horizontal plane is possible.

When, for instance, three actuators are used, each 120 degrees from the other and commanded by 3 independent signals, and provided some interrelation of the 3 signals, a fuller directional control in the horizontal plane is possible.

Operation Specifics

The helicopters of the prior related patent applications create auto-stability. One of the elements of the system is a completely free to move rotor/stabilizer assembly. Any external obstruction to this causes the stabilizing effect to disappear. In a 'classic' cyclical control system, the control mechanism takes full control over the rotor system. The degree to which the control system overrides the stability system may not be 100%. Tuning and calibration however can keep stability. This is a lower effect, when given a movement command on the actuator.

With the actuator based control system, there are disclosed different features and capabilities.

When the actuator 206 is at rest, there is no contact with the rotor or mechanical disturbance to the free movement of the rotor 112 and stabilizer rotor 128. FIGS. 6, 7, 8*a* and 8*b* are illustrative.

When a signal is passed to the actuator 206, the force temporarily interferes with the rotor system, 'destabilizing' it in such a way that the helicopter moves in the desired direction. FIGS. 10*a* and 10*b* are illustrative.

There is a control system for regulating the degree of requisite horizontal movement and a control system for regulating the stability of the helicopter in a relative non-horizontal moving sense. The degree to which the horizontal movement control system is dominant over the non-horizontal movement stability system of the helicopter determines the rate of change in position in the horizontal sense. The horizontal control system includes the interaction of the ring 204, actuator 206 and its control operation. The control system for stability is achieved in part by the interactive rotor 112 and stabilizing rotor 128.

The motor 300 and interactive gear system 302 and 304 drives the rotor shaft 108 at the requisite speed. Control electronics 306 can be mounted on the substitute 308 as necessary.

Third Embodiment

Referring to FIGS. 12-29, a control system for moving a helicopter 1 in a horizontal plane is described. The control system includes a control element that is movable in a first direction such that the control acts to move the angle of incidence in a first direction. The control element is also movable in a second direction opposite to the first direction such that the control acts to move the angle of incidence in a second direction opposite to the first direction.

The control system includes an actuator 416 for engaging with a slider element 406 for engagement with an assembly 452 depending from the rotor 5. The inter-engagement of the actuator 416 and slider element 406 in either of the two directions effect a change in the assembly 452, and the angle of incidence of at least the one blade of the rotor 5. The actuator can also be non-interfering with slider 406 and, resultantly, the rotor such that the control assembly is in a position of rest relative to the actuator. In such an instance, there would be no command from the actuator 416 to interact with the slider 406, the helicopter retains relative stability.

Attached at each end of the slider 406 are actuator pins 450*a* and 450*b*. The actuator pins 450*a* and 450*b* push on opposites sides of a ring 404 attached to the assembly 452 allowing the ring to be pushed or pulled by a single actuator 416.

When the actuator moves the slider in one direction, the pin 250*a* pushes the ring and makes the rotor tilt along the rotor hinge axis 200. The cyclical tilt change cause a different lift force in one blade 12 versus the other and the main rotor 5 moves in the horizontal plane.

When the actuator 416 moves the slider 406 in the opposite direction, the pin 450*b* pushes the ring 404 and causes the main rotor 5 to tilt along the rotor hinge axis 200. This cyclical tilt causes a different lift force in one blade versus the other and the rotor moves in the horizontal plane in the opposite direction from previous slide.

The slider 406 has a slot 408 that allows for the rotor shaft 9 to pass, for guiding the slider while moved by the actuator. There is a guide 410 attached along the vertical rotor axis to keep the slider 406 in a fixed vertical position.

Referring to FIGS. 19-20, two controls could be superimposed at a certain rotation to add a second direction of movement. This allows full control in the horizontal plane—up/down and left/right yaw, it adds for/back and side left/side right control. In this instance, there two actuators 416 and 516 that control movement of two sliders 506 and 406. The sliders 406 and 506 can be positioned at any angle relative to each other, but are illustrated as positioned at 90 degrees.

Referring to FIGS. 21-22, there is another implementation of the control system described above. In this instance, there are actuators 602 and 604 that control the movement of surfaces or paddles 612, 614, 616 and 618. The surfaces 612 and 616 are opposite each other and movement of actuator 604 in one direction will cause the surface 616 to move and tilt the ring 404 and movement of the actuator 604 in the other direction will cause the surface 612 to engage the ring 404. Likewise, the surfaces 614 and 618 are opposite each other and movement of actuator 602 in one direction will cause the surface 614 to move and tilt the ring 404 and movement of the actuator 602 in the other direction will cause the surface 618 to engage the ring 404. When the actuator lever 602 moves up or down, it tilts the surfaces 614 and 618 around the hinge 608 and moves the ring 404. Thus the surfaces 612, 614, 616 and 618 or the actuator pins 450*a*, 450*b*, 550*a* and 550*b* push/pull the ring 404 to change the angle of incidence of the main rotor 5.

Fourth Embodiment

A helicopter comprises a body; a main rotor with blades, the blades having a generally first longitudinal axis, and the blades are driven by a rotor shaft around a first plane of rotation. The blades are hinge mounted on the rotor shaft, such that the angle of incidence of at least one blade of the main rotor may vary.

An auxiliary rotor is driven by the rotor shaft of the main rotor and is provided with radial elements having a generally second longitudinal axis extending essentially in a defined relationship with the generally first longitudinal axis. There is a second plane of rotation. The auxiliary rotor is mounted relative to the main rotor to be in a variable angular swinging relationship such that the second plane of rotation is variable relative to the first plane of rotation. The variation in the second plane of rotation acts to vary the angle of incidence of at least one blade.

The main rotor has a first area removed from and partly about the rotor shaft, and the auxiliary rotor has a second area removed from and partly about rotor shaft. The first area and the second area are in engagement to adopt different positions of repose between them. The relative positions of the first plane of rotation and the second plane of rotation are changeable as the positions of repose change. The motion of the auxiliary rotor controls the angle of incidence of at least one rotor blade of the main rotor. This is affected along at least part of a 360 degree rotation path around a rotor shaft.

The first area includes an engaging face and the second area includes an engaging follower to ride on the engaging face. The engaging face and the follower are in essentially direct physical contact thereby to regulate the relative movement between the main rotor and the auxiliary rotor. The engaging face is formed of two elements each spaced from the other circumferentially, and the second area includes a pair of engaging followers each respectively to ride on a respective engaging face.

In one form, the main rotor has a hub with a pair of engaging faces removed from the rotor shaft, and the auxiliary rotor having a pair of followers directed away from about rotor shaft. The engaging faces and the followers are in engagement, such that the relative positions of the first plane of rotation and the second plane of rotation are changeable relative to different positions of engagement of the engaging faces and followers.

The generally first longitudinal axis and the second longitudinal axis are at angle between about zero and about 90 degrees relative to each other. This can be at angle less than about 45 degrees relative to each other. Also it can be at angle less than about 25 degrees relative to each other.

In another form, the main rotor has a first area partly about the rotor shaft, and the auxiliary rotor has a second area partly about rotor shaft. The first area and the second area are in engagement to adopt different positions of repose between them. The relative positions of the first plane of rotation and the second plane of rotation are changeable as the positions of repose change.

The first area includes a vertically directed cam, and the second area includes an engaging follower to ride on the cam surface. The cam surface has different vertical positions relative to the first plane of rotation. The first area includes a vertically directed cam, the cam being formed of two elements each spaced from the other circumferentially. The second area includes a pair of engaging followers each respectively to ride on a respective cam surface. The cam surfaces are at different vertical positions relative to the first plane of rotation.

Each cam has a first surface to be relatively flat and parallel to the first plane of rotation, and an inclined surface to either side of the flat surface. The inclined surface is directed to a second relatively flat surface essentially also parallel to the first plane of rotation.

The flat surface of the cam inter-engages with the follower which also has a flat surface. This inter-engagement of the cam and the follower extends over a range of movement when the auxiliary rotor adopts different relative swinging positions to the main rotor. The engagement of the cam and follower can be over a substantially entire extent of the flat horizontal portion of the cam surface.

The cam area can be formed as integral portion of the first rotor. The follower can be formed as integral portion of the second rotor, and when assembled the follower mechanically engages directly with the cam surface.

The cam can include a pair of integrally formed vertically directed cams. The cams are radially opposite each other relative to the center of the main rotor. The cams are located essentially at a transverse position to the first longitudinal axis.

The follower includes a pair of levers, each lever being for engaging a respective cam. The levers are formed as an integral portion of the second rotor. The levers are respectively followers mechanically engaging directly with the cams, and are formed to be in a direction transverse the second longitudinal axis.

In one form the cam is a relatively vertically directed cam, and the follower is a like a lever to ride on the cam.

The rotor shaft accommodates a first transverse spindle for engagingly locating the main rotor at first level on the shaft in a manner that the rotor blades of the main rotor can oscillate about the spindle and thereby change the angle of incidence of the blades. The rotor shaft at a second position on the shaft spaced axially from the first position permits for the accommodation of a second spindle for the auxiliary rotor. The second spindle permits the auxiliary rotor to be in a swinging relationship. As assembled there can be a change in the angle of incidence of the blades.

The main rotor has a clip integrally formed on the main rotor and the clip depending from the plane of rotation of the main rotor and being for engaging the spindle. There can be a pair of clips, and the clips are for engaging the spindle towards ends of the spindle. The clips can include a pair of arms, and the arms can have an open end smaller than a width of the spindle. The open ends define a mouth, which is movable, so that the spindle is insertable into the clip. There is a spring like action to house the spindle from freely separating from clips.

The pair of clips for engaging the spindle can be located towards the ends of the spindle, namely the clips are located at a spaced distance from each other, the spacing being about the same distance apart as spacing part of a pair of cam surfaces are spaced apart from each other, the cam surfaces being for interacting with the auxiliary rotor.

The clips are located at a spaced distance from each other, the spacing being about the same distance apart as spacing part of a pair of cam surfaces are spaced apart from each other.

The cam surfaces are for interacting with the auxiliary rotor, and the cams are located on a first side of a surface of the plane defined by the blades, and the clips are on an opposite side to the first side of a surface of the plane defined by the blades.

The helicopter 1 represented in FIGS. 30-48 by way of example is a remote-controlled helicopter which essentially consists of a body 2 with a landing system of winglets 3 and a tail 4; a main rotor 5; an auxiliary rotor 6 driven synchronously with the latter. There is also a tail rotor 7.

The main rotor 5 is provided with a rotor head 8 arranged about a first upward directed rotor shaft 9 which is bearing-mounted in the body 2 of the helicopter 1 in a rotating manner and which is driven by a motor 10 and a transmission 11. The motor 10 is for example an electric motor which is powered by a battery 12.

The main rotor 5 in this case has two blades 13 which are in line or practically in line, but which may just as well be composed of a larger number of blades 13.

The tilt or angle of incidence A of the rotor blades 13, in other words the angle A which forms the rotor blades 13 as represented in FIG. 34 with the plane of rotation 14 of the main rotor 5, can be adjusted. The main rotor 5 is hinge-mounted relative to the rotor shaft 9 by a joint, such that the angle between the plane of rotation 14 of the main rotor 5 and the rotor shaft 9 may vary.

In one example of a main rotor 5 with two blades 13, the joint is formed by a spindle 15 mounted on the rotor shaft 9. The spindle 15 has two transverse arms 16.

The axis 17 of this spindle 15 is directed transversal to the rotor shaft 9 and essentially extends in the direction of the longitudinal axis 18 of one of the rotor blades 13.

The tail rotor 7 is driven via a second rotor shaft 19 by a second motor 20 and a transmission 21. Motor 20 can be an electric motor.

The helicopter 1 is also provided with an auxiliary rotor 6 which is driven substantially synchronously with the main rotor 5 by the same rotor shaft 9 which passes through an aperture 23 in the rotor head 8.

The auxiliary rotor 6 can have two elongated arms, rotors, vanes, or elements 24 which are essentially in line or parallel with the longitudinal axis 75 which passes though the center of the point at the top of the rotor shaft 9 where it meets with a second transverse spindle 26. The spindle 26 has two transverse arms 27 and there is an axis 27 passing through that spindle 26. the axis 28 is transverse to the axis 75.

As represented in FIG. 33, there is an acute angle B between the longitudinal axes 18 and 75.

The longitudinal axis 75, seen in the sense of rotation R of the main rotor 5, can be essentially parallel to the longitudinal axis 18 of the blades 13 of the main rotor 5 or enclose an angle B. The rotors 5 and 6 extend on top of one another with their respective blades 13 and arms, rotors, vanes, or elements 24.

The diameter of the auxiliary rotor 6 can be smaller than the diameter of the main rotor 5. The arms, rotors, vanes, rods or elements 24 have a smaller span than the rotor blades 13. The arms, rotors, vanes, or elements 24 are substantially rigidly connected to each other. This rigid whole forming the auxiliary rotor 6 is provided in a swinging manner on an oscillating shaft or spindle 26 which is fixed to the rotor shaft 9. This spindle 26 is directed also transversally to the longitudinal axis 75 of the arms, rotors, vanes, or elements 24 and transversally to the rotor shaft 9.

The arms 24 of the auxiliary rotor 6 comprise elongated sections 30 which are respectively off-set to either side of the center or axis 75 of the auxiliary rotor 6.

The auxiliary rotor 6 can be provided with two stabilizing weights or paddles 31 which are each fixed to the arms, rotors, vanes, rods or elements 30 at a distance from the rotor shaft 9. This can be at the ends of the elongated members 30 or at a position between the ends and the rotor shaft 9.

Further, the helicopter 1 is provided with a receiver 32, so that it can be controlled from a distance by means of a remote control transmitter 33. The receiver 32 transmits signals to a CPU 34 so that the respective motors 10 and 20 can be controlled.

The main rotor 5 and the auxiliary rotor 6 are not necessarily a rigid whole. The blades 13 of the main rotor 5 are connected together as a single whole integrated structure. In some cases there can be a structure where there may be some relative movement possible between each of the blades 13 to each other in the plane of rotation 14 of the rotor 5. The rotor blades 13 and the arms, rotors, vanes, or elements 24 can also be provided on the rotor head 8 such that they are mounted and can rotate relatively separately.

The blades 13 define a blade diameter, and the auxiliary rotor 6 defines an auxiliary rotor diameter. The auxiliary rotor diameter is less than the blade diameter; and the auxiliary rotor 6 can include elongated rod elements and also elements having a relatively flattened face, such as elements 31. The square area covered by the elements 31 can be different in different situations and also the shape, size, length, thickness and weight can vary as needed.

In one form the auxiliary rotor 6 has a pair of followers 35 directed transversely away from the elongated portions 30. The followers 35 also rotate about rotor shaft 9. There are a pair of cams 36 upwardly directed from the face 37 of the head 8. The followers 35 are in engagement with the top edge or face 38 of each cam 36. The shape or form of the face 38 can be different in different situations.

There are different relative positions of the followers 35 relative to the cams 36. As such there are different planes of rotation for the auxiliary rotor 6. There is a first plane of rotation 39 when the followers 35 ride on the top face 38 of the cams 36. There is a second plane of rotation 40 when the followers 35 ride on the angulated areas 41 between the bottom adjacent the face 37 and the top flat surface 38 of the cams 36 or at the bottom of the cams 36 in line with the face 37. These are changeable relatively as there are different positions of engagement of the cams 36 and followers 35.

The main rotor 5 has essentially a head or hub 8 with the cams 36 removed from the rotor shaft 9. The auxiliary rotor 6 has the followers 35. The cams 36 and the followers 35 are in engagement, such that the relative positions of the first plane of rotation 39 and the second plane of rotation 40 are changeable relative to different positions of engagement of the cams 36 and followers 35. In some cases the cam 36 can be formed on the auxiliary rotor 6 and the followers 35 on the hub 8. A suitable interaction of cam and followers is set up irrespective of where or on what components the cam 36 and followers 35 are actually constructed.

In one form, the main rotor 5 is formed of plastic. Also in one form the auxiliary rotor 6 is formed of plastic and is a stabilizer with its follower levers 35 which are in one piece. There is no need for mechanical interconnection with the main rotor 5, and there are no attachment points. The main rotor 5 and auxiliary rotor 6 rest in inter-engagement with each other. The inter-engagement can be effected near to the main rotor shaft 9, and can be in the area of the hub 8 about the shaft 9, namely between the shaft 9 and portion proper of the blades 13 of the main rotor 5.

This construction creates a relatively lower profile or lower height, and creates a more realistic appearance in the sense that visually from afar this appears to be more of a single rotor helicopter.

The auxiliary rotor 6 can be simple elongated members without flat blade like or vane portions 31. Multiple different configurations and cross-sections are possible.

It is likely that relatively less counter torque, is generated by the system compared to other two rotor structures and hence there are less power needs.

Relatively, there are low number of parts or components for the operational effect of the two rotor system. Also the configuration permits for a relatively more automatic alignment and fit of the components, an hence a relatively easier assembly.

The auxiliary rotor 6 rests with the two integrated stabilizer levers 35 on top of the two vertical cams 36 on top of the main rotor 5.

The distance between the center of the rotor shaft 9 and/or the main rotor hinge line to engagement positions on the cam 36 is a first 'lever', C.

The distance between the center of the rotor shaft 9 and/or the auxiliary rotor hinge line to line of the follower or lever 35 which engages the cam 36 is a second 'lever', D.

The affect of the auxiliary rotor on the main rotor is determined by the distance of the cam to the center of the rotor shaft relative to the distance of the follower from the auxiliary rotor. The interaction between the main rotor 5 and the auxiliary rotor 6 is determined by the levers C and D and their respective ratios.

When the auxiliary rotor 6 inclines, the stabilizer levers 35 move up and down thereby exercising a torque on the rotor cams 36 inclining the rotor 6 around its hinge axis.

The line 42 through the contact points 43 and 44 between the stabilizer levers 35 and the cams 36 does not go through the hinge point 45 of the cams 36. This hinge point 45 is the also the rotor 5 hinge line. The line 42 oscillates or swings up and down versus the hinge point 45 while the main rotor 5 is pivoting and changing its angle of inclination A.

A clearance between the levers 35 and the cams 36 may arise when the stabilizer rotor 6 inclines. The levers 35 have a flat surface 46 where they touch the top surface 38 of the cams 36 to facilitate engagement.

In some case there can be a round lever 35, and then there can be some gap which arises when the auxiliary stabilizer 6 tilts. Different profiles of the inter-engaging lever 35 and cam 36 are possible.

The main rotor 5 can snap on the hinge or spindle ends 16 mounted on the main rotor shaft 9. This can eliminate the need for assembly steps and fixing parts. The snap option can hinder unintentional disengagement or unlocking in a crash. There are clips 46 which can be wide apart, and this permits for higher precision of the rotor hinge 15 and ends 16. Further the clips 46 can be strong, namely relative thick, and still able to have a 'spring & clip' capability. In some cases there can be a fence 47 on the top sides of the clips 46, and this increases the spring effect, so the clips 46 can be made thicker.

The construction can further be formed to minimize inadvertent disengagement. The stabilizer hinge pin 27, and the stabilizer levers 35, which touch the cams 36, are formed so that to the central part can not inadvertently unlock from the clips 46.

There can be close to zero clearance between the stabilizer levers 35 and the cams 36; and close to zero clearance in the rotor hinge 15. Further the ratio between lever C and D influences stability. The angle between the auxiliary rotor 6 and the main rotor 5 can influence the stability effect. The hinge line 45 of the main rotor 5 can be turned slightly relative to the rotor tip-to-tip line 48 of the main rotor 5 for tuning stability.

The auxiliary rotor 6 can be a rod, and the number and the lengths of mechanical linkages is limited. The auxiliary rotor 6 can be a one piece plastic, and with the main rotor 5. The different components 5, 6, 9, and 15 can snap together and are relatively locked by a single pin 49 that also serves as a hinge pin 49 for the auxiliary rotor 6.

While the apparatus and method have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures.

A control for moving the angle of incidence of at least one blade of the rotor cyclically along a 360 degree rotation path around the vertical rotor shaft, causing a variation in lift force of the blade along the rotation path thereby cause the body to be urged in a relatively horizontal direction from a relative position of horizontal rest. The relative position of horizontal rest is a relatively hovering position above a ground level. By the term, angle of incidence, there is meant the relative angle of attack of the blade in the plane of rotation.

The control includes an actuator for engaging with an assembly depending from the rotor the inter-engagement of the actuator and assembly effecting a change in the angle of incidence of at least the one blade of the rotor.

In different formats, the system is a multi-control or a multi-channel system for controlling the helicopter in different essentially horizontal directions.

The system includes a rotor, preferably complemented with a stabilizer rotor. There is a control ring attached to the main rotor, and an actuator device connected with the helicopter body structure. The control ring is generally centered around the vertical rotor shaft, and moves with the rotor when tilted around the feather axis.

The control includes an actuator for engaging with an assembly depending from the rotor. The inter-engagement of the actuator and assembly effects a change in the angle of incidence of at least one blade of the rotor.

The interaction occurs when the assembly is aligned with the actuator. There can be multiple actuators, the multiple actuators being spaced circumferentially around the rotor shaft thereby to interact with the assembly at different circumferential positions relative to the rotor shaft. The interaction occurs when selected actuators are aligned with selected locations of the assembly, for instance where the actuator engages the ring.

The actuator includes an arm movable between a position of repose and a position of inter-engagement with the assembly and wherein the degree of movement of the arm effects the degree of interaction with the assembly and the degree of change of angle of inclination of the at least one blade. The length of the arm relative to the length of the assembly from the location of anchoring the rotor to the shaft can effect the degree of interaction with the assembly and the degree of change of angle of inclination of the at least one blade. Furthermore, the size of the force exercised by the arm on the assembly can effect the degree of interaction with the assembly and the degree of change of angle of inclination of the at least one blade.

In other forms instead of the mechanical interaction to effect the control a suitable magnetic or electro magnetic servo can be used for instance with a helicopter using the main rotor and also a stabilizer auxiliary rotor.

It is also clear that, if necessary, the joints and hinge joints may also be realized in other ways than the ones represented, for example by means of torsion-flexible elements.

The operation of the improved helicopter 1 according to the disclosure is as follows:

In flight, the rotors 5, 6 and 7 are driven at a certain speed, as a result of which a relative air stream is created in relation to the rotors, as a result of which the main rotor 5 generates an upward force so as to make the helicopter 1 rise or descend or maintain it at a certain height, and the tail rotor 7 develops a laterally directed force which is used to steer the helicopter 1.

It is impossible for the main rotor 5 to adjust itself, and it will turn in the plane 14 in which it has been started, usually the horizontal plane. Under the influence of gyroscopic precession, turbulence and other factors, it will take up an arbitrary undesired position if it is not controlled.

The surface of rotation of the auxiliary rotor 5 may take up another inclination in relation to the surface of rotation 14 of the main rotor 5, whereby both rotors 5 and 6 may take up another inclination in relation to the rotor, shaft 8.

This difference in inclination may originate in any internal or external force or disturbance whatsoever.

In a situation whereby the helicopter 1 is hovering stable, on a spot in the air without any disturbing internal or external forces, the auxiliary rotor 5 keeps turning in a plane which is essentially perpendicular to the rotor shaft 8.

If, however, the body 2 is pushed out of balance due to any disturbance whatsoever, and the rotor shaft 9 turns away from its position of equilibrium, the auxiliary rotor 6 does not immediately follow this movement, since the auxiliary rotor 6 can freely move round the oscillatory shaft or spindle 26.

The main rotor 5 and the auxiliary rotor 6 are placed in relation to each other in such a manner that a swinging motion of the auxiliary rotor 6 is translated almost immediately in the pitch or angle of incidence A of the rotor blades 13 being adjusted.

For a two-bladed main rotor 5, this means that the rotor blades 13 and the arms, rotors, vanes, rods or elements 24 of both rotor 6 can be essentially parallel or, seen in the sense of rotation R, enclose an acute angle B with one another of, for example 10° in the case of a larger main rotor 5 and a smaller auxiliary rotor 6. In different constructions, the angle B can be between essentially zero and about 90 degrees.

Since the relative position of the main rotor 5 and the auxiliary rotor 6 are selected such that a relatively immediate effect is obtained. This change in the upward force makes sure that the rotor shaft 8 and the body 2 are forced back into their original position of equilibrium.

A second effect is that, since the distance between the far ends of the arms, rotors, vanes, rods or elements 24 and the plane of rotation 14 of the main rotor 5 is no longer equal and since also the arms, rotors, vanes, or elements 24 cause an upward force, a larger pressure is created between the main rotor 5 and the auxiliary rotor 6 on one side of the main rotor 5 than on the diametrically opposed side.

A third effect plays a role when the helicopter begins to tilt over to the front, to the back or laterally due to a disturbance. Just as in the case of a pendulum, the helicopter will be inclined to go back to its original situation. This pendulum effect does not generate any destabilizing gyroscopic forces as with the known helicopters that are equipped with a stabilizer bar directed transversally to the rotor blades of the main rotor. It acts to reinforce the first and the second effect.

The signal of the sensor is used by a control box of a computer to counteract the failure and to adjust the thrust of the tail rotor 7 so as to annul the angular displacement of the tail rotor 7 which is due to the disturbance.

This can be done by adjusting the speed of the tail rotor 7 and/or by adjusting the angles of incidence of the rotor blades of the tail rotor 7, depending on the type of helicopter 1.

If necessary, the tail rotor 7 is of the conventional type, i.e. whose shaft cannot turn in a swing but is bearing-mounted in relation to the tail 4.

In FIG. 43*a* the head or hub 8 is shown diagrammatically with the two cans 36 having the engaging faces 38 spaced above the face 37 of the head 8. The followers 35 are shown resting on the top face 38 of each of the cans 36.

In FIG. 43*b* the head or hub 8 is a face 37 which is relatively flat. There are no upstanding cans 36 with surfaces 38 from the head 8. The follow is 35 associated with the auxiliary rotor have two spaced downwardly directed elements 100 and 102 respectively. Each of those elements has a face 104 and 106 respectively which engage flat face 37 of the head or hub 8. The shape of the elements 100 and 102 would be of a nature or cross section opposite to what the cans 36 would be in FIG. 43*a*.

The requirement is there be a point of contact between the head or hub 8 and an element relating to the auxiliary rotor 6 third, this element is indicated to be a follower. In some cases there may be no upstanding elements 36 or 100 or 102 respectively. All that is required is that there be an essentially direct point of contact between the hub or head 8 or an element from the hub or head which is in direct rigid contact with the hub or head 8 and an element of the auxiliary rotor which is indirect or substantially rigid contact with the auxiliary rotor 6.

In this sense, movement of the hub translates to the auxiliary rotor directly and movement of the auxiliary rotor transfers directly to the hub and the main rotor associated with that hub. This transfer of movement of one component to the other is affected by the direct physical contact of ridge of components associated with the hub and the auxiliary rotor respectively is caused by the relatively direct inter-engagement of rigid parts associated with each of the main rotor and auxiliary rotor respectively.

In FIG. 44 there is a main rotor with blades 114 which are diametrically opposite each other. There is a central hub or head 102 which is formed with a cut-out 119 so that the central hub 118 essentially has a circumferential element 120 which is directed around the space 119. The shape of the circumferential element 120 can be circular or any shape for essentially surrounding the space 119. There can be situations where this surrounding element 120 has spaces in its perimeter such that it is not a completely surrounding element. The head or hub 118 does however provide a base for anchoring the spindle 115 mounted on the rotor shaft 219. The spindle 115 has respectively two transverse arms 116 each of which are connected with clip tied apertures 146. The spindle 115 is along an axis 117.

Transversely directed from the rotor shaft 219 and also transfers the relative to the spindle 115. There is a second transverse spindle 126 with arms 127 which is for a configuration associated with the auxiliary rotor 206 which has extending arms or elements 124 which are directed relatively diametrically opposite to each other. At the ends of the respective elongated elements 124, there are two respective petal like elements 131. Each of the arms 124 in the area of the hub or head 118 is connected with the a connector bar 150 so that the auxiliary rotor is a rigid element extending from the pedal 131 at the end of one arm 124 through the connector bar 150 to the other elevated elongated element 124 and in turn to the pedal 131. The connector bar 150 includes downwardly connecting limbs 152 for connection with the spindle 126 and the transverse arms 127 of that spindle 126.

Projecting from the elongated arms 124 is a follower element 135 which rides on the top service or face 136 of the surrounding ring 120.

The auxiliary rotor 206 can move upwardly and downwardly as indicated by arrows 154. The angle of inclination of the blades 138 of the main rotor can change as indicated by arrows 156 according to arrows 156 according to different positions of the auxiliary rotor 206 as indicated by the arrows 154.

As shown in FIG. 46, the relationship of the linking connector bar 150 moves in a different angle or relationship relative to the elevated arms 124 of the auxiliary rotor 206. There is an acute angle 158 formed between linking bar 150 and the arms 124. In this configuration the relationship between the longitudinal axis 117 through the blade 113 which form the main rotor 105 is different relative to the axis 160 which runs through the longitude connector member 150 that angle 162 is also a relatively acute angle. In this configuration, the spindle associated with the auxiliary rotor in the spindle 126 is not right angularly related to the spindle 116 of the auxiliary rotor. The right angle relationship is shown in FIG. 44.

In the embodiment of FIG. 46, there are no followers elements added to the auxiliary rotor 206. There are extension arms 164 from the surrounding ring formed on the hub or head 118 and those extension arms provide effectively the inter-engaging face on which the elongated members 124 of the auxiliary shaft can interact directly. This direct interaction permits for movement of the auxiliary rotor to be directly translated to movement of the main rotor and vice versa.

As shown in FIG. 47, the connecting cord 150 with the downwardly directed limbs 152 has apertures 166 spaced in the numbers 152. This is for pivotal engagement with the pin ends 168 at the end of each of the arms 127 of the spindle 126 which is located on top of rotor shaft 219.

As shown in various more detail showing the interrelationship of the auxiliary rotor on the rotor shaft 219 and the two spindles 116 and 126 connected to the rotor shaft 219.

In practice, the combination of both aspects makes it possible to produce a helicopter which is stable in any direction and any flight situation and which is easy to control, even by persons having little or no experience.

The present disclosure is not limited to the embodiments described as an example and represented in the accompanying figures. Many different variations in size and scope and features are possible.

The disclosure has been described and illustrated with a self-stabilizing rotor system. Other non-self stabilizing flying devices could also use the control system of the disclosure.

In different forms there can be a helicopter having more than two blades of the main rotor and for the auxiliary rotor. The engagement of the components of the rotor in different positions of repose between them can be formed with different constructions whereby the components inter engage under gravity action by resting on each other. In some cases there can be a spring or pressure action applicable to the inter-engagement. The concept is to have a minimum number of interlocking components and eliminate unnecessary separate components each of which require different manufacturing and construction tolerances.

There maybe one or several cams and respective followers. The shape of the cams and followers can be any shape. The auxiliary rotor can be below the main rotor, and as such the interrelationship is that the main rotor rests on the structure of the auxiliary rotor. The height of the cam can vary as appropriate. The engagement structure of the main rotor with the rotor shaft and auxiliary rotor can vary. The nature, shape and structure of the follower levers can be different. The essentially direct physical contact or interaction between a rigid element associated with one or more of the elongated elements or blades of the main rotor and one or more elements of the one or more elongated elements, blades or vanes of the auxiliary rotor permits for effective and efficient translation of interactive movement between the two rotors. This system reduces the number of parts which would otherwise be needed for this translation and permits for a relatively easy assembly of components. The term "cam" is intended to donate an engaging face. Although this is shown as an elevated elements with inclined sides from a plane, there could be situations where there are no inclined sides. The sides may be straight or upright walls. In some cases there can be pins and extensions from a surface of a hub or head and can be extensions in the same plane as the hub which is the foundation nor central member of the main rotor. In other cases there can be a reversal of components between the main rotor hub and auxiliary rotor. In some cases the auxiliary rotor can be located below the main rotor.

For instance, instead of electrical motors being provided others forms of motorized power are possible. A different number of blades may be provided to the rotors.

A helicopter can be made in all sorts of shapes and dimensions while still remaining within the scope of the disclosure. In this sense although the helicopter in some senses has been described as toy or model helicopter, the features described and illustrated can have use in part or whole in a full-scale helicopter. In some cases the helicopter may be a structure without a tail rotor. Different helicopter-type systems can use the control of the disclosure. In other cases the rotor control can be used with different flying objects.

The present disclosure is not limited to the embodiments described as an example and represented in the accompanying figures. Many different variations in size and scope and features are possible.

The disclosure has been described and illustrated with a self-stabilizing rotor system. Other non-self stabilizing flying devices could also use the control system of the disclosure.

For instance, instead of electrical motors being provided others forms of motorized power are possible. A different number of blades may be provided to the rotors.

A helicopter according to the disclosure can be made in all sorts of shapes and dimensions while still remaining within the scope of the disclosure. In this sense although the helicopter in some senses has been described as toy or model helicopter, the features described and illustrated can have use in part or whole in a full-scale helicopter. In some cases the helicopter may be a structure without a tail rotor. Different helicopter-type systems can use the control of the disclosure. In other cases the rotor control can be used with different flying objects.

In other forms instead of the mechanical interaction to effect the control a suitable magnetic or electro magnetic servo can be used for instance with a helicopter using the main rotor and also a stabilizer auxiliary rotor.

Although the disclosure has detailed a system for essentially substantial or approximate horizontal movement in one or two directions, the disclosure includes systems for permitting control of the movement in other substantially horizontal directions. As such, the helicopter control can affect control of horizontal movement forward and/or backwards and/or sideways to the left and/or sideways to the right or different combinations of those movements.

For this purpose there may be more than the one control system for inter-reacting with the rotor assembly. There could be several control systems operating on the rotor in parallel and/or series manner to effect the desired horizontal movement.

The horizontal movements effected by the control systems are in addition to the up and/or down movements which are possible with the helicopter system with the control being non-operation or on-function on the rotor assembly.

Instead of an assembly depending from the rotor there could be other structures for the actuator to interact with the rotor system. Further, instead of a ring for interaction with the actuator there could be other physical structures for interaction with the actuator. In different cases there can be more than two blades for the rotor, and one or two or more of the blades of the rotor can be controlled to different or the same degree.

While the apparatus and method have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

We claim:

1. A helicopter comprising a body; a main rotor with blades which is driven by a rotor shaft and which is hinge mounted on the rotor shaft, the main rotor being in a plane of rotation at an angle relative to the rotor shaft, a control for moving an angle of incidence of at least one blade of the rotor relative to the angle of incidence of another blade of the rotor cyclically along at least part of a 360 degree rotation path around the rotor shaft, causing a variation in lift force of the blade along at least part of the rotation path and thereby cause the body to be urged in a relatively horizontal direction from a relative position of rest, the control having a control element being movable in a first direction such that the control acts to move the angle of incidence in a first direction, and the control element being movable in a second direction opposite to the first direction such that the control acts to move the angle of incidence in a second direction opposite to the first direction, and including a slider between an actuator and an assembly, and wherein the slider includes a pin, the pin being fixedly mounted on the slider and extending in a direction transverse to a direction of a sliding movement of the slider, the pin being for engaging a ring associated with the assembly, and the sliding movement being transverse to the rotor shaft.

2. A helicopter of claim 1 wherein the control element includes the actuator for engaging with the slider for engagement with the assembly depending from the rotor, the inter-engagement of the actuator and slider element in either of the two directions effecting a change in the assembly and the angle of incidence of at least the one blade of the rotor, and the helicopter retains relative stability when at least one of the actuator is non-interfering with the slider or the rotor, or when the control assembly is in a position of rest relative to the actuator, or when there is no command from the actuator to interact with the slider.

3. A helicopter of claim 2 including multiple actuators and multiple sliders, the multiple actuators and multiple sliders being spaced circumferentially around the rotor shaft thereby to interact with the assembly at different circumferential positions relative to the rotor shaft, the interaction occurring when selected actuators are aligned with selected location of the assembly.

4. A helicopter of claim 2 wherein the actuator includes an arm movable between a position of repose and a position of inter-engagement with the slider and wherein a degree of movement of and a force exercised by the arm effects a degree of interaction with the slider and in turn the slider with the assembly and a degree of change of an angle of inclination of the at least one blade.

5. A helicopter of claim 2 wherein the actuator includes an arm movable between a position of repose and a position of inter-engagement with the slider and wherein a length of the arm relative to a length of the assembly from a location of anchoring of the rotor to the shaft effects a degree of interaction with the slider and a degree of change of an angle of inclination of the at least one blade.

6. A helicopter of claim 2 wherein the actuator includes an arm movable between a position of repose and a position of inter-engagement with the slider, the ring a transversally located about and movable with the rotor shaft, and the actuator or multiple actuators are located at a fixed location on the body.

7. A helicopter of claim 1 wherein the blade includes a feathering axis, and the control is applied thereby to cause the blade to turn on the feather axis of the blade, the control being effectively applied to the blade when the actuator is aligned relative to the blade thereby to effect the turning about the feather axis.

8. A helicopter of claim 1 wherein the blade includes a feathering axis, and the control is applied thereby to cause the blade to turn on the feather axis of the rotor, the control being effectively applied selectively to the blade through a system to operate the control thereby to effect the turning about the feather axis.

9. A helicopter of claim 1 wherein the blade includes a feathering axis, and the control is applied thereby to cause the blade to turn on the feather axis of the rotor blade, the control being effectively applied selectively to the blade through a system to operate the control thereby to effect the angle of incidence of the blade periodically or at selected times and with selective interactive force or movement thereby to selectively change the blade angle of incidence in requisite response to the control.

10. A helicopter of claim 1 wherein the blade includes a feathering axis, and the control is applied thereby to cause the blade to turn on the feather axis of the blade, the control being effectively applied selectively to the blade through a system to operate the control thereby to effect the angle of incidence of the blade periodically or at selected times or locations along a 360 degree path around the rotor shaft and with selective interactive force or movement thereby to selectively change the blade angle of incidence in requisite response to the control, and periodically or at selected times to permit the blade angle to be responsive to forces unrelated to the control, such that a stability system continues to operate together with a horizontal applied control when the horizontal control is applied.

11. A helicopter of claim 1 wherein the slider is a plate, and the plate does not engage the actuator or assembly.

12. A helicopter comprising a body having a longitudinal axis between a front end and a rear end, a rotor with rotor blades which is driven by a rotor shaft and which is mounted on the rotor shaft, a rotor at the rear end which is driven by a second rotor shaft directed transversally to the longitudinal axis, and multiple controls located at different locations of the rotor shaft for moving an angle of incidence of at least one blade of the rotor cyclically along at least part of a 360 degree rotation path around the rotor shaft, causing a variation in a lift force of the blade along at least part of the rotations path and thereby cause the body to be urged in a relatively horizontal direction from a relative position of rest, and including a slider between an actuator and an assembly, and wherein slider includes a pin, the pin being fixedly mounted on the slider and extending in a direction transverse to a direction of a sliding movement of the slider, the pin being for engaging a ring associated with the assembly, and the sliding movement being transverse to the rotor shaft.

13. A helicopter according to claim 12 wherein the multiple controls are located to move multiple respective intermediate members, the intermediate members in turn reacting with the assembly from the rotor.

14. A helicopter according to claim 12 or 13 wherein the multiple controls are respective sliders, the sliders being mounted relatively on top of each other, and being adapted to slide in a reciprocating manner transversely relative to the rotor shaft.

15. A helicopter according to claim 14 wherein each slider is reactive with a respective actuator, and wherein each slider includes a pair of spaced pins, the pins being for reacting respectively oppositely with the assembly depending from the rotor.

16. A helicopter of claim 12 wherein the slider is a plate, and the plate does not engage the actuator or assembly.

* * * * *